US008861996B2

(12) United States Patent
Tomioka et al.

(10) Patent No.: US 8,861,996 B2
(45) Date of Patent: Oct. 14, 2014

(54) IMAGE FORMING APPARATUS USING PLURALITY OF ROTATION MEMBERS, AND CONTROL METHOD THEREOF

(75) Inventors: Yasuhiro Tomioka, Mishima (JP); Yasuhiro Sendoda, Suntou-gun (JP); Yoshimichi Ikeda, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 219 days.

(21) Appl. No.: 12/953,712

(22) Filed: Nov. 24, 2010

(65) Prior Publication Data

US 2011/0129241 A1 Jun. 2, 2011

(30) Foreign Application Priority Data

Nov. 27, 2009 (JP) ..... 2009-270786
Nov. 19, 2010 (JP) ..... 2010-258887

(51) Int. Cl.
*G03G 15/00* (2006.01)
*G03G 15/16* (2006.01)

(52) U.S. Cl.
CPC ..... *G03G 15/5008* (2013.01); *G03G 15/1615* (2013.01); *G03G 15/757* (2013.01)
USPC ..... 399/36

(58) Field of Classification Search
USPC ..... 399/36, 66, 297, 302, 308; 318/6, 7; 198/575, 576, 577; 324/160, 207.25
See application file for complete search history.

(56) References Cited

U.S. PATENT DOCUMENTS 5,995,717 A * 11/1999 Tanaka ..... 358/1.9
2002/0136568 A1* 9/2002 Hashimoto et al. ..... 399/228
2004/0021839 A1* 2/2004 Kato ..... 355/23
2007/0231021 A1* 10/2007 Kinoshita et al. ..... 399/301
2008/0298856 A1* 12/2008 Koike ..... 399/302
2009/0052922 A1* 2/2009 Aoyagi ..... 399/66
2009/0123168 A1* 5/2009 Aoki et al. ..... 399/66
2009/0141296 A1* 6/2009 Ichinose et al. ..... 358/1.9

FOREIGN PATENT DOCUMENTS

JP 2007017691 A * 1/2007
JP 2008-268453 A 11/2008
JP 2009128698 A * 6/2009

OTHER PUBLICATIONS

JP 2009128698 English translation, Aoyanagi, Jun. 2009.*

* cited by examiner

*Primary Examiner* — David Gray
*Assistant Examiner* — Thomas Giampaolo, II
(74) *Attorney, Agent, or Firm* — Fitzpatrick, Cella, Harper & Scinto

(57) ABSTRACT

An image forming apparatus includes first and second rotation members which are a plurality of rotation members for performing image formation and rotate in contact with each other. A first driving motor drives the first rotation member. A second driving motor drives the second rotation member. The obtaining unit obtains pieces of motor driving information about driving states of the first or second driving motor at respective relative driving speeds when the relative driving speed of the second driving motor with respect to the driving speed of the first driving motor is changed to a plurality of relative driving speeds. The control unit controls the driving speed of at least either the first or second driving motor in image formation to reduce the relative speed difference between the circumferential velocities of the first and second rotation members based on the pieces of motor driving information obtained by the obtaining unit.

6 Claims, 34 Drawing Sheets

FIG. 7A

| N, M | ROTATIONAL SPEED OF SECONDARY TRANSFER DRIVING MOTOR (rpm) | OUTPUT VOLTAGE OF OP AMP (V) | AFTER A / D CONVERSION (DECIMAL) | INPUT VOLTAGE OF OP AMP (V) | AVERAGE CURRENT OF PRIMARY TRANSFER DRIVING MOTOR (A) | ABSOLUTE VALUE OF DIFFERENCE FROM AVERAGE VALUE |
|---|---|---|---|---|---|---|
| −1 | 990 | 2.903 | 224 | 0.581 | 1.161 | 34 |
| −0.9 | 991 | 2.900 | 224 | 0.580 | 1.160 | 34 |
| −0.8 | 992 | 2.895 | 224 | 0.579 | 1.158 | 34 |
| −0.7 | 993 | 2.888 | 223 | 0.578 | 1.155 | 33 |
| −0.6 | 994 | 2.875 | 222 | 0.575 | 1.150 | 32 |
| −0.5 | 995 | 2.850 | 220 | 0.570 | 1.140 | 30 |
| −0.4 | 996 | 2.813 | 217 | 0.563 | 1.125 | 27 |
| −0.3 | 997 | 2.675 | 207 | 0.535 | 1.070 | 17 |
| −0.2 | 998 | 2.600 | 201 | 0.520 | 1.040 | 11 |
| −0.1 | 999 | 2.525 | 195 | 0.505 | 1.010 | 5 |
| 0 | 1000 | 2.363 | 183 | 0.473 | 0.945 | 7 |
| 0.1 | 1001 | 2.250 | 174 | 0.450 | 0.900 | 16 |
| 0.2 | 1002 | 2.225 | 172 | 0.445 | 0.890 | 18 |
| 0.3 | 1003 | 2.138 | 165 | 0.428 | 0.855 | 25 |
| 0.4 | 1004 | 2.125 | 164 | 0.425 | 0.850 | 26 |
| 0.5 | 1005 | 2.105 | 163 | 0.421 | 0.842 | 27 |
| 0.6 | 1006 | 2.095 | 162 | 0.419 | 0.838 | 28 |
| 0.7 | 1007 | 2.090 | 162 | 0.418 | 0.836 | 28 |
| 0.8 | 1008 | 2.088 | 161 | 0.418 | 0.835 | 29 |
| 0.9 | 1009 | 2.088 | 161 | 0.418 | 0.835 | 29 |
| 1 | 1010 | 2.085 | 161 | 0.417 | 0.834 | 29 |

FIG. 9

| N, M | ROTATIONAL SPEED OF SECONDARY TRANSFER DRIVING MOTOR (rpm) | OUTPUT VOLTAGE OF OP AMP (V) | AFTER A / D CONVERSION (DECIMAL) | INPUT VOLTAGE OF OP AMP (V) | AVERAGE CURRENT OF PRIMARY TRANSFER DRIVING MOTOR (A) | ABSOLUTE VALUE OF DIFFERENCE FROM AVERAGE VALUE |
|---|---|---|---|---|---|---|
| −1 | 990 | 2.993 | 231 | 0.599 | 1.197 | 38 |
| −0.8 | 992 | 2.983 | 230 | 0.597 | 1.193 | 37 |
| −0.6 | 994 | 2.973 | 230 | 0.595 | 1.189 | 37 |
| −0.4 | 996 | 2.938 | 227 | 0.588 | 1.175 | 34 |
| −0.2 | 998 | 2.750 | 213 | 0.550 | 1.100 | 20 |
| 0 | 1000 | 2.375 | 184 | 0.475 | 0.950 | 9 |
| 0.2 | 1002 | 2.150 | 166 | 0.430 | 0.860 | 27 |
| 0.4 | 1004 | 2.100 | 162 | 0.420 | 0.840 | 31 |
| 0.6 | 1006 | 2.070 | 160 | 0.414 | 0.828 | 33 |
| 0.8 | 1008 | 2.060 | 159 | 0.412 | 0.824 | 34 |
| 1 | 1010 | 2.050 | 158 | 0.410 | 0.820 | 35 |

FIG. 15A

| N, M | ROTATIONAL SPEED OF PHOTOSENSITIVE MEMBER DRIVING MOTOR (rpm) | OUTPUT VOLTAGE OF OP AMP (V) | AFTER A / D CONVERSION (DECIMAL) | INPUT VOLTAGE OF OP AMP (V) | AVERAGE CURRENT OF PRIMARY TRANSFER DRIVING MOTOR (A) | ABSOLUTE VALUE OF DIFFERENCE FROM AVERAGE VALUE |
|---|---|---|---|---|---|---|
| −1.0 | 990 | 3.131 | 243 | 0.783 | 0.39 | 84 |
| −0.9 | 991 | 3.126 | 243 | 0.782 | 0.388 | 84 |
| −0.8 | 992 | 3.065 | 238 | 0.765 | 0.38 | 79 |
| −0.7 | 993 | 3.015 | 234 | 0.755 | 0.377 | 75 |
| −0.6 | 994 | 2.99 | 232 | 0.748 | 0.375 | 73 |
| −0.5 | 995 | 2.913 | 226 | 0.728 | 0.365 | 67 |
| −0.4 | 996 | 2.85 | 221 | 0.712 | 0.355 | 63 |
| −0.3 | 997 | 2.801 | 217 | 0.701 | 0.35 | 59 |
| −0.2 | 998 | 2.735 | 212 | 0.685 | 0.34 | 54 |
| −0.1 | 999 | 2.563 | 199 | 0.64 | 0.32 | 40 |
| 0 | 1000 | 2.374 | 184 | 0.593 | 0.295 | 26 |
| 0.1 | 1001 | 1.773 | 138 | 0.443 | 0.22 | 21 |
| 0.2 | 1002 | 1.263 | 98 | 0.316 | 0.16 | 61 |
| 0.3 | 1003 | 1.174 | 91 | 0.293 | 0.145 | 67 |
| 0.4 | 1004 | 1.09 | 85 | 0.272 | 0.135 | 74 |
| 0.5 | 1005 | 1.053 | 82 | 0.263 | 0.132 | 77 |
| 0.6 | 1006 | 1.033 | 80 | 0.258 | 0.13 | 78 |
| 0.7 | 1007 | 1.005 | 78 | 0.252 | 0.126 | 81 |
| 0.8 | 1008 | 0.998 | 77 | 0.249 | 0.125 | 81 |
| 0.9 | 1009 | 0.982 | 76 | 0.245 | 0.122 | 82 |
| 1.0 | 1010 | 0.977 | 76 | 0.244 | 0.122 | 83 |

IMAGE FORMING APPARATUS USING PLURALITY OF ROTATION MEMBERS, AND CONTROL METHOD THEREOF

BACKGROUND OF THE INVENTION

1. Field of the Invention

The present invention relates to an image forming apparatus using a plurality of rotation members, and a control method thereof.

2. Description of the Related Art

In an electro-photographic image forming apparatus, a plurality of rotation members such as a photosensitive drum, image carrier belt, and print sheet conveyance roller rotate to form an image. Japanese Patent Laid-Open No. 2008-268453 discloses an apparatus in which primary and secondary transfer belts clamp a print sheet at the nip to secondarily transfer an image.

SUMMARY OF THE INVENTION

It is desired for the primary and secondary transfer belts to rotate at the same or almost the same rotational speed. This is because, if their rotational speeds are neither the same nor almost the same, the frictional force between the rotation members will not act properly on toner or a print sheet entering the nip, forming a defective image. Therefore, control is required to reduce the relative rotational speed difference between a plurality of rotation members that are concerned in image formation and rotate in contact with each other. Note that the rotational speed is, for example, the moving speed of the belt surface, and is also called a linear velocity or circumferential speed.

It is a feature of the present invention to solve at least one of the above problems and other problems. For example, it is a feature of the present invention to reduce generation of an image defect by controlling the relative speeds of a plurality of rotation members at high precision. Note that other problems will be understood throughout the specification.

An image forming apparatus includes first and second rotation members which are a plurality of rotation members for performing image formation and rotate in contact with each other. A first driving motor drives the first rotation member. A second driving motor drives the second rotation member. The obtaining unit obtains pieces of motor driving information about driving states of the first or second driving motor at respective relative driving speeds when the relative driving speed of the second driving motor with respect to the driving speed of the first driving motor is changed to a plurality of relative driving speeds. The control unit controls the driving speed of at least either the first or second driving motor in image formation to reduce the relative speed difference between the circumferential velocities of the first and second rotation members based on the pieces of motor driving information obtained by the obtaining unit.

Further features of the present invention will become apparent from the following description of exemplary embodiments (with reference to the attached drawings).

BRIEF DESCRIPTION OF THE DRAWINGS

FIG. 7A is a table exemplifying obtained data;

FIG. 9 is a table exemplifying data according to the second embodiment;

FIG. 15A is a table exemplifying obtained data;

DESCRIPTION OF THE EMBODIMENTS

Preferred embodiments of the present invention will be described below. Individual embodiments to be described below would help understand various concepts such as superordinate, intermediate, and subordinate concepts of the invention. The technical scope of the present invention is defined by the scope of the claims, and is not limited by the following individual embodiments.

First Embodiment

Figure 1:
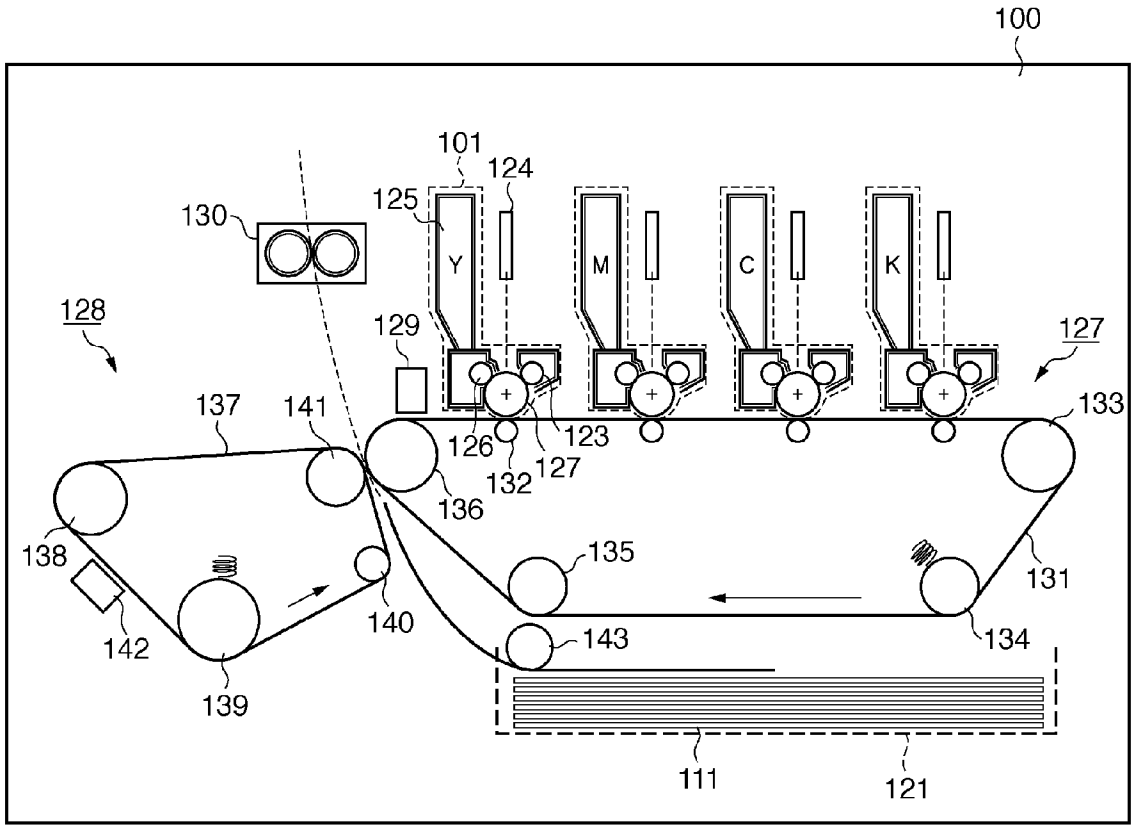
FIG. 1 is a sectional view showing the schematic structure of an image forming apparatus.

FIG. 1 is a sectional view showing the schematic structure of an image forming apparatus. An image forming apparatus 100 forms an image using an electro-photographic process. Note that the image forming apparatus in the present invention may form an image using an electrostatic printing process or magnetic printing process. An example of the developer is toner formed from, for example, a heat fusible resin. Examples of the print medium are print paper, transfer sheet, OHT sheet, glossy paper, glossy film, electrofax paper, and electrostatic print paper. The image forming apparatus 100 forms a multicolor image using four, yellow (Y), magenta (M), cyan (C), and black (K) color toners. Note that the present invention is also applicable to a monochrome image forming apparatus.

The image forming apparatus 100 includes four cartridges 101. Each cartridge 101 includes a photosensitive member 122, charging sleeve 123, toner container 125, and developing sleeve 126. The photosensitive member 122 is an example of an image carrier called a photosensitive drum. The charging sleeve 123 uniformly charges the photosensitive member 122, and an electrostatic latent image is formed on it by a beam output from a scanner unit 124. The developing sleeve 126 develops the electrostatic latent image into a toner image using toner stored in the toner container 125. Each primary transfer roller 132 primarily transfers, onto a primary transfer belt 131, the toner image formed on the surface of the photosensitive member 122.

A primary transfer unit 127 includes the primary transfer belt 131, the primary transfer roller 132, a primary transfer driving roller 133, a primary transfer tension roller 134, a primary transfer driven roller 135, and a secondary transfer counter roller 136. The primary transfer belt 131, primary transfer roller 132, primary transfer driving roller 133, primary transfer tension roller 134, primary transfer driven roller 135, and secondary transfer counter roller 136 are also examples of rotation members for forming an image. A high primary transfer bias voltage is applied to the primary transfer rollers 132, transferring, onto the primary transfer belt 131, toner images of multiple colors formed on the photosensitive members 122. The primary transfer belt 131 is an example of a primary transfer member (which can correspond to either of the first and second rotation members that rotate in contact with each other) onto which a toner image formed on the image carrier is primarily transferred. A primary transfer driving motor (to be described later) drives the primary transfer driving roller 133. The primary transfer tension roller 134 applies pressure to the primary transfer belt 131 via an elastic member. The primary transfer driven roller 135 rotates following the primary transfer belt 131. The secondary transfer counter roller 136 has its rotating shaft grounded, and provides the current path of a secondary transfer bias applied to a secondary transfer unit 128. A cleaner 129 removes toner remaining on the primary transfer belt 131. Note that the primary transfer belt 131 is also called an intermediate transfer belt, and the primary transfer motor is also called an intermediate transfer belt motor. A bias is applied to the cleaner 129, and the cleaner 129 temporarily recovers waste toner remaining on the intermediate transfer belt 131 after transfer. When a reverse bias is applied to the cleaner 129 at a timing different from the image formation timing, the waste toner is discharged onto the intermediate transfer belt 131. The discharged toner is moved onto the photosensitive drum 122 by applying a bias reverse to the image formation bias from the primary transfer roller 132, and is recovered by a photosensitive member cleaner (not shown).

The secondary transfer unit 128 includes a secondary transfer belt 137, secondary transfer driving roller 138, secondary transfer tension roller 139, secondary transfer driven roller 140, secondary transfer roller 141, and cleaner 142. The secondary transfer belt 137, secondary transfer driving roller 138, secondary transfer tension roller 139, secondary transfer driven roller 140, and secondary transfer roller 141 are examples of rotation members for forming an image. A high secondary transfer bias voltage is applied to the secondary transfer roller 141. This facilitates transfer of a multicolor toner image held on the primary transfer belt 131 onto a print sheet 111. A secondary transfer driving motor drives the secondary transfer driving roller 138. The secondary transfer tension roller 139 applies pressure to the secondary transfer belt 137 via an elastic member. The secondary transfer driven roller 140 rotates following the secondary transfer belt 137. The cleaner 142 removes toner remaining on the secondary transfer belt 137. The secondary transfer belt 137 is an example of a secondary transfer member (which can correspond to either of the first and second rotation members that rotate in contact with each other), which clamps a print medium together with the primary transfer member to transfer a toner image from the primary transfer member to the print medium. In the first embodiment, the first rotation member is the primary transfer member which bears a toner image, and the second rotation member is a secondary transfer member which clamps a print medium together with the primary transfer member to transfer a toner image from the primary transfer member to the print medium. Note that disturbance of a toner image easily stands out when at least either the primary or secondary transfer member is a belt. The present invention is therefore effective for suppressing disturbance of a toner image.

A print sheet 111 stored in a paper feed unit 121 is fed by a pickup roller 143, and conveyed while being clamped between the primary transfer belt 131 and the secondary transfer belt 137. At this time, toner images of multiple colors are secondarily transferred onto the print sheet 111. After that, a fixing device 130 heats the toner image under pressure, fixing it onto the print sheet 111.

Figure 2:
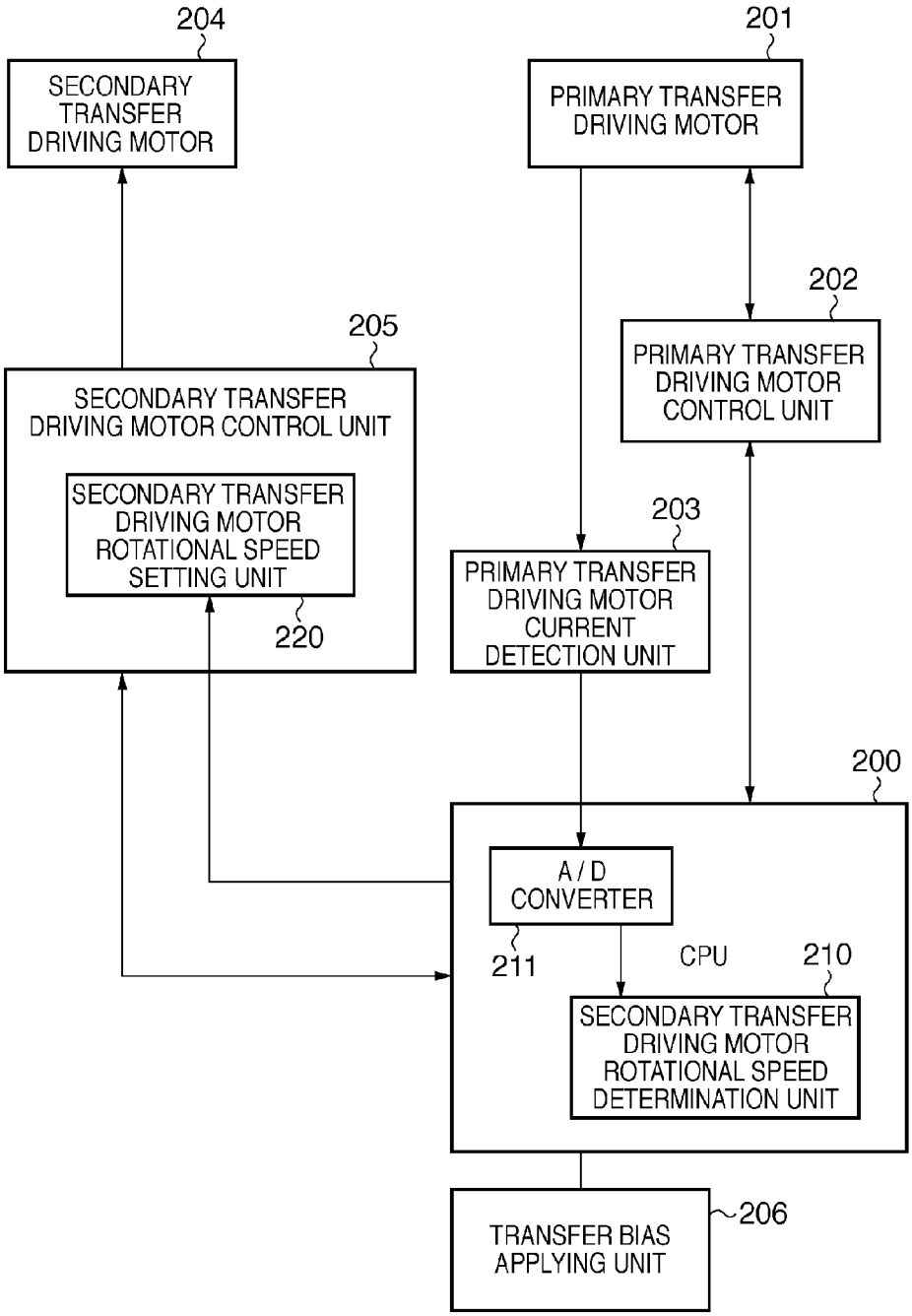
FIG. 2 is a block diagram showing a control circuit which controls a primary transfer driving motor and secondary transfer driving motor.

FIG. 2 is a block diagram showing a control circuit that controls a primary transfer driving motor 201 and secondary transfer driving motor 204. A CPU 200 is a control unit that comprehensively controls the overall image forming apparatus 100. The primary transfer driving motor 201 and secondary transfer driving motor 204 are examples of the first driving motor which drives the first rotation member, and the second driving motor which drives the second rotation member. The current of the primary transfer driving motor 201 is detected to set the target rotational speed of the secondary transfer driving motor 204. Instead, the current of the secondary transfer driving motor 204 may be detected to set the target rotational speed of the primary transfer driving motor 201. In the following description, the primary and secondary transfer driving motors are interchangeable.

The primary transfer driving motor 201 is a motor which drives the primary transfer driving roller 133 to rotate. The primary transfer driving motor 201 is an example of a primary transfer driving motor that drives the primary transfer member. The primary transfer driving motor 201 is, for example, a DC brushless motor. A primary transfer driving motor control unit 202 is a control unit that controls the primary transfer driving motor 201. The primary transfer driving motor control unit 202 receives a rotational state signal from the primary transfer driving motor 201, and controls to set the driving speed (rotational speed) of the primary transfer driving motor 201 to a rotational speed suited to image formation. A primary transfer driving motor current detection unit 203 is a detection circuit that detects a current as motor driving information of the primary transfer driving motor 201. Note that the motor driving information is information about the motor output and rotational state, and means information indicating the motor output and rotational state or information which allows estimating them. Hence, the motor current is an example of the motor driving information, and various kinds of information are applicable, including motor driving signals (deceleration and acceleration signals) and their count value. An A/D converter 211 in the CPU 200 receives a signal output from the primary transfer driving motor current detection unit 203. The primary transfer driving motor current detection unit 203 is an example of a current detection unit which detects the value of a current supplied to the primary transfer driving motor.

The secondary transfer driving motor 204 is a motor which drives the secondary transfer driving roller 138, and is, for example, a stepping motor. The secondary transfer driving motor 204 is an example of a secondary transfer driving motor which drives the secondary transfer member. A secondary transfer driving motor control unit 205 is a control circuit which controls the secondary transfer driving motor 204. A secondary transfer driving motor rotational speed setting unit 220 is a circuit which sets a rotational speed determined by the CPU 200 as the target rotational speed of the secondary transfer driving motor 204. The secondary transfer driving motor control unit 205 controls the secondary transfer driving motor 204 based on the rotational speed set by the secondary transfer driving motor rotational speed setting unit 220.

A secondary transfer driving motor rotational speed determination unit 210 controls to reduce the relative speeds of the secondary transfer belt 137 and primary transfer belt 131 based on a current value serving as motor driving information obtained by the primary transfer driving motor current detection unit 203. As an example of reducing the relative speed difference, the secondary transfer driving motor rotational speed determination unit 210 determines, based on the current value of the primary transfer driving motor 201, the target rotational speed of the secondary transfer driving motor 204 that is applied in image formation. The secondary transfer driving motor rotational speed determination unit 210 is an example of a control unit which controls the target rotational speed of the secondary transfer driving motor to reduce the difference between the circumferential velocities of the primary and secondary transfer members in accordance with a detected current value. The A/D converter 211 converts an analog signal indicating the current value of the primary transfer driving motor 201 that is detected by the primary transfer driving motor current detection unit 203, into digital data so that the CPU 200 can read it, and outputs the digital data.

For example, the secondary transfer driving motor control unit 205 includes a sub-CPU and stepping motor driver IC, and the sub-CPU incorporates the secondary transfer driving motor rotational speed setting unit as a register. The CPU 200 sets, in the internal register of the sub-CPU, the target rotational speed of the secondary transfer driving motor 204 that is determined by the secondary transfer driving motor rotational speed determination unit 210. The sub-CPU outputs pulses based on the target rotational speed to the stepping motor driver IC, controlling the rotational speed of the secondary transfer driving motor 204.

A bias applying unit 206 is a circuit which applies a secondary transfer bias to the secondary transfer belt 137 in accordance with an application instruction from the CPU 200. The bias applying unit 206 applies a high secondary transfer bias voltage to the secondary transfer roller 141. Since the rotating shaft of the secondary transfer counter roller 136 is grounded, the secondary transfer roller 141, secondary transfer belt 137, print sheet 111, primary transfer belt 131, and secondary transfer counter roller 136 form the current path of the secondary transfer belt. Thus, the bias applying unit 206 functions as a transfer bias applying unit which applies a transfer bias to the secondary transfer member. Also, the bias applying unit 206 is a circuit which applies a development bias to the developing sleeve 126 (developing roller), and a primary transfer bias to the primary transfer roller 132.

Figure 3:
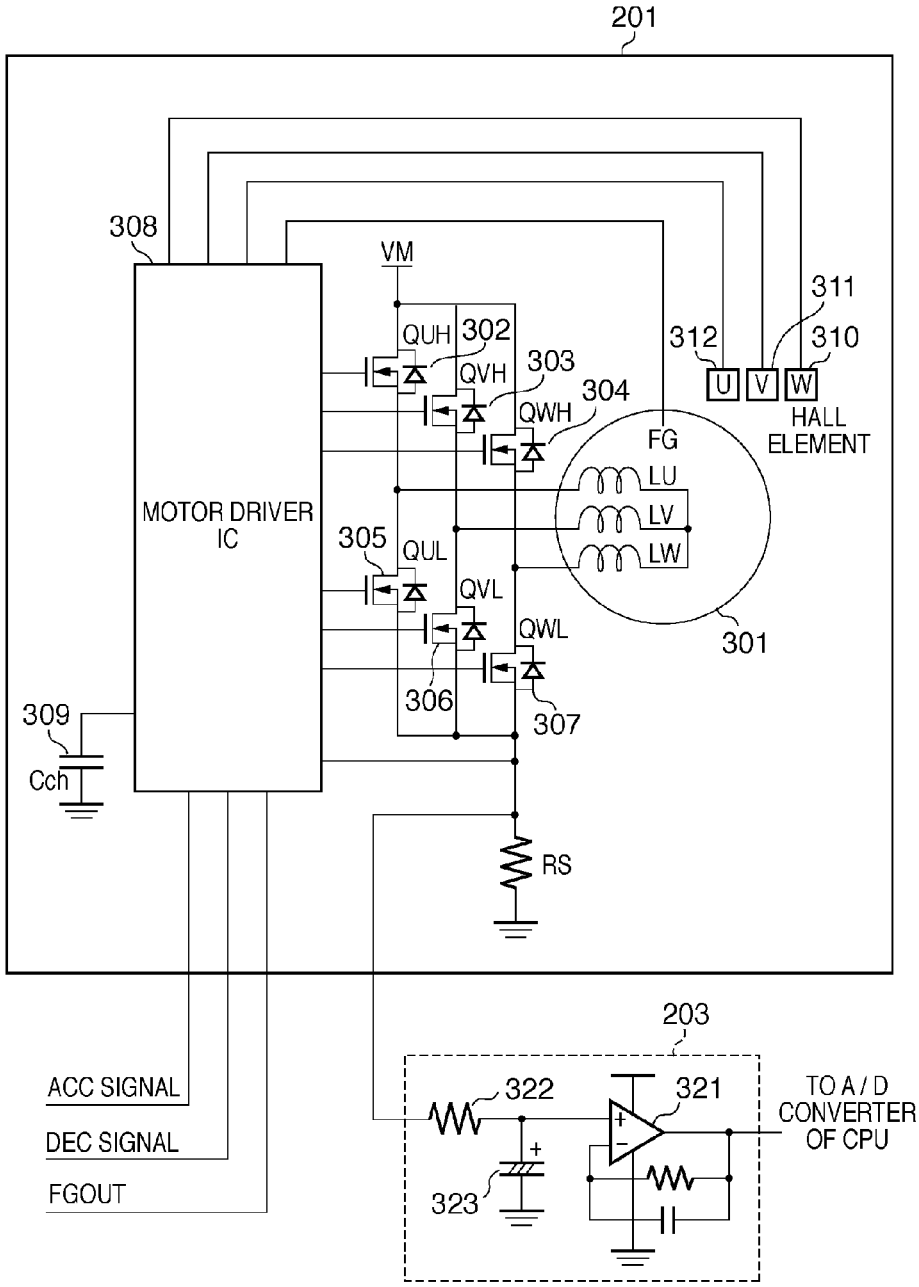
FIG. 3 is a circuit diagram showing the circuit configuration of the primary transfer driving motor.

FIG. 3 is a circuit diagram showing the circuit configuration of the primary transfer driving motor. A DC brushless motor 301 is a motor of three phases (LU, LV, and LW), and outputs an FG signal indicating the rotational speed in accordance with an FG pattern arranged immediately below a rotor magnet. The FG signal is input to a motor driver IC 308, amplified and compared by an FG amplifier incorporated in the motor driver IC 308, and output as an FGOUT signal to the primary transfer driving motor control unit 202. Hall elements 310 to 312 are arranged to detect the switching timings of the respective phases of the DC brushless motor 301. High-side driving FETs 302 to 304 have drain terminals connected to a motor driving power supply, gate terminals connected to the motor driver IC 308, and source terminals connected to the respective phases. Low-side driving FETs 305 to 307 have drain terminals connected to the respective phases, gate terminals connected to the motor driver IC 308, and source terminals connected to the motor driver IC 308, a resistor RS, and the primary transfer driving motor current detection unit 203. The resistor RS detects a current flowing through the DC brushless motor 301. The motor driver IC 308 detects a voltage IV-converted by the resistor RS, and limits a current flowing through the motor winding. A torque-designated voltage capacitor 309 holds a voltage determined by an ACC (acceleration) signal and DEC (deceleration) signal serving as output signals from the primary transfer driving motor control unit 202, and controls the rotational speed of the DC brushless motor 301. That is, a voltage across the torque-designated voltage capacitor 309 corresponds to a target rotational speed.

The primary transfer driving motor current detection unit 203 mainly includes a resistor 322, capacitor 323, and OP amplifier 321. The primary transfer driving motor current detection unit 203 averages a voltage obtained by IV-converting a primary transfer driving motor current flowing through the resistor RS, and amplifies the voltage, outputting it to the A/D converter 211 of the CPU 200. Based on data output from the A/D converter 211, the CPU 200 recognizes the current value of the primary transfer driving motor 201.

The circumferential velocities of the primary and secondary transfer belts need to coincide with the process speed of image formation. To achieve this, the CPU 200 determines the target rotational speeds of the primary transfer driving motor 201 and secondary transfer driving motor 204. T1 is the target rotational speed of the primary transfer driving motor 201, and T2 is that of the secondary transfer driving motor 204.

<Image Defect Generation Principle>

Figure 4:
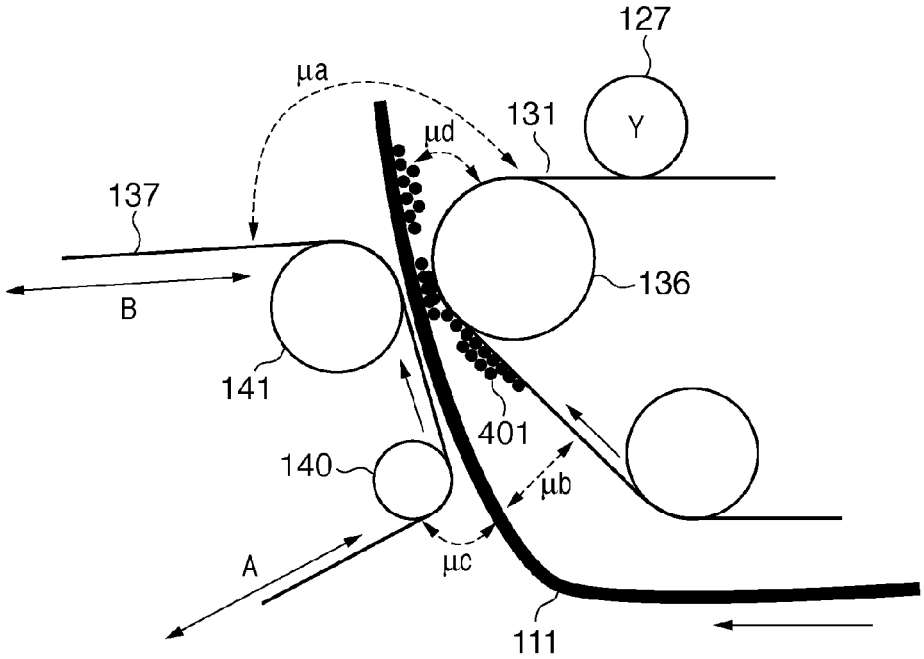
FIG. 4 is a view showing in detail a transfer portion in image formation.

FIG. 4 is a view showing in detail a transfer portion in image formation. As described above, the secondary transfer belt 137 secondarily transfers a toner image 401 while clamping and conveying the print sheet 111 together with the primary transfer belt 131. The coefficient μa of kinetic friction between the primary transfer belt 131 and the secondary transfer belt 137 is, for example, about 0.35. The coefficient μb of kinetic friction between the primary transfer belt 131 and the print sheet 111 is, for example, about 0.45. The coefficient μc of kinetic friction between the secondary transfer belt 137 and the print sheet 111 is, for example, about 0.4. The coefficient μd of kinetic friction between the primary transfer belt 131 and toner is, for example, about 0.15. That is, these coefficients of kinetic friction have a relation: μb>μc>μa>μd.

On this assumption, the primary transfer belt 131 and secondary transfer belt 137 are driven at the coefficient μa of kinetic friction until the print sheet 111 enters the nip. After the print sheet 111 enters the nip, the primary transfer belt 131 is driven at the coefficient μb of kinetic friction with the image forming surface of the print sheet 111, and the secondary transfer belt 137 is driven at the coefficient μc of kinetic friction with the non-image forming surface of the print sheet 111. When the coefficient of kinetic friction changes from μa to μb and from μa to μc, the degree of change is small, so the behaviors of the primary transfer belt 131 and secondary transfer belt 137 change a little.

When a toner image is transferred onto the print sheet 111, the coefficient of kinetic friction of the primary transfer belt 131 changes to μd though that of the secondary transfer belt 137 does not change. Since the coefficient of kinetic friction abruptly decreases from μb to μd, the primary transfer belt 131 and toner image 401 easily slip. When the circumferential speed of the secondary transfer belt 137 is higher than that of the primary transfer belt 131, a portion B of the secondary transfer belt 137 that has been tense up to now, and a sagged portion A abruptly return to a normal state. In this case, the conveyance speed of the print sheet 111 temporarily increases, and an image at the nip is finally rubbed, generating an image defect. To the contrary, when the circumferential speed of the primary transfer belt 131 is higher than that of the secondary transfer belt 137, an image defect is generated by the opposite mechanism. Thus, it is important to minimize the difference between the circumferential velocities of the primary transfer belt 131 and secondary transfer belt 137 in order to suppress an image defect.

<Relationship between Rotational Speed of Secondary Transfer Driving Motor and Current of Primary Transfer Driving Motor>

Figure 5A:
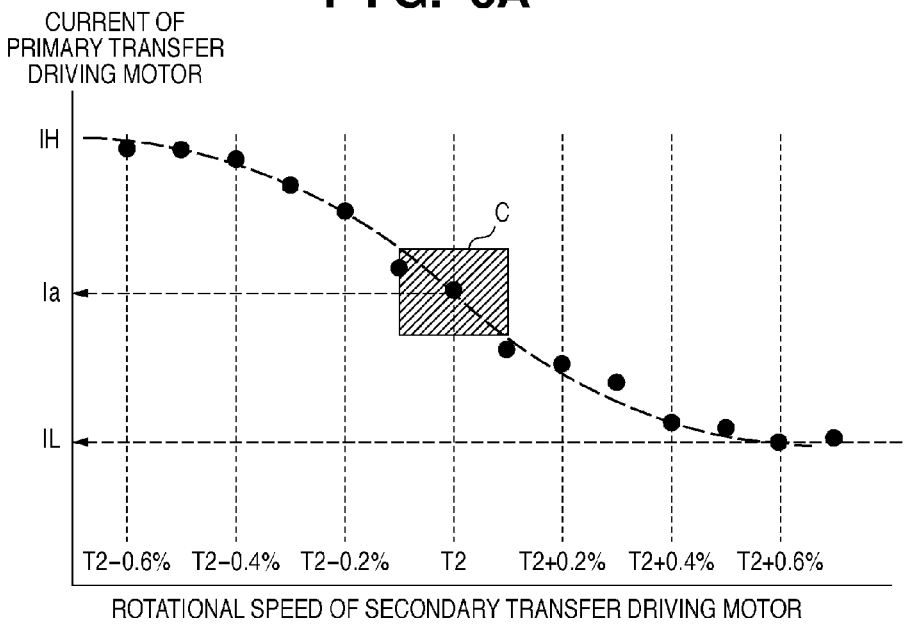
FIGS. 5A and 5B are graphs showing the relationship between the rotational speed of the secondary transfer driving motor and the current of the primary transfer driving motor.
Figure 5B:
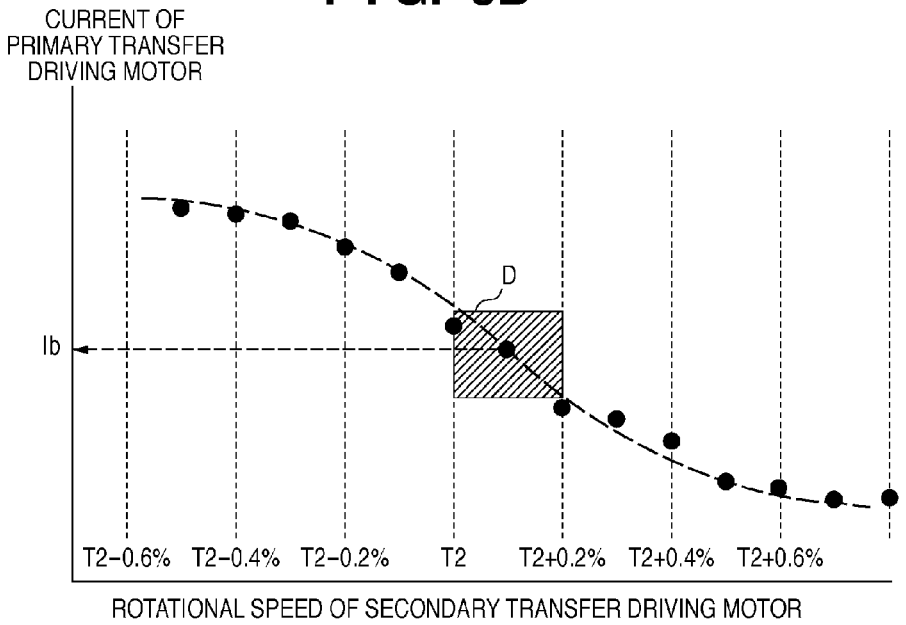

FIGS. 5A and 5B are graphs showing the relationships between the rotational speed of the secondary transfer driving motor and the current of the primary transfer driving motor in different image forming apparatuses. The average current value of the primary transfer driving motor 201 detected when the target rotational speed of the secondary transfer driving motor 204 is changed while the target rotational speed of the primary transfer driving motor 201 is set to T1 will be explained. Note that the change width (step) is 0.1% of the reference rotational speed T2.

In both FIGS. 5A and 5B, the average current value of the primary transfer driving motor 201 is larger for a lower rotational speed of the secondary transfer driving motor 204, and smaller for a higher rotational speed of the secondary transfer driving motor 204. When the rotational speed of the secondary transfer driving motor 204 decreases, the circumferential speed of the secondary transfer belt 137 also decreases, increasing the load on the primary transfer belt 131. As a result, a larger output from the primary transfer driving motor 201 is required, increasing the current of the primary transfer driving motor 201. In contrast, when the rotational speed of the secondary transfer driving motor 204 increases, an output from the primary transfer driving motor 201 decreases because of the counteraction, decreasing the current of the primary transfer driving motor 201.

When the difference (circumferential speed difference) between the circumferential velocities of the primary transfer belt 131 and secondary transfer belt 137 increases, the average current value does not change any more. More specifically, when the rotational speed of the secondary transfer driving motor 204 reaches T2+0.6% or more, the average current value converges to almost IL. When the rotational speed of the secondary transfer driving motor 204 reaches T2−0.6% or less, the average current value converges to almost IH. This is because, when the absolute value of the circumferential speed difference becomes a predetermined value or more, a stress exceeding the coefficient of kinetic friction generated between the primary transfer belt 131 and the secondary transfer belt 137 acts, and the primary transfer belt 131 and secondary transfer belt 137 slip. The circumferential speed difference between the primary transfer belt 131 and the secondary transfer belt 137 becomes almost negligible in an almost intermediate range (range C in FIG. 5A and range D in FIG. 5B) between the current values IL and IH. For this reason, the influence of the primary transfer belt 131 on the secondary transfer belt 137 becomes almost local minimum. In other words, both the primary transfer belt 131 and secondary transfer belt 137 are maintained in an almost distortion-free state.

In FIG. 5A, the rotational speed of the secondary transfer driving motor 204 at the center of the range C is T2, and the average current value of the primary transfer driving motor 201 is Ia. In FIG. 5B, the rotational speed of the secondary transfer driving motor 204 at the center of the range D is T2+0.1%, and the average current value of the primary transfer driving motor 201 is Ib. The difference in rotational speed arises from variations of the outer shapes of the primary transfer driving roller 133 and secondary transfer driving roller 138, variations of the rotational speed offset by the control unit, and the like. The difference in the average current value is generated from variations of the load of the primary transfer unit 127, and variations of the efficiency of the primary transfer driving motor 201. To cope with these variations, it is desirable to dynamically determine the target rotational speed and the average current value, instead of determining them in advance. The embodiment almost minimizes the circumferential speed difference between the primary transfer belt 131 and the secondary transfer belt 137 using the current characteristic of the primary transfer driving motor 201, thereby suppressing an image blur which may occur in secondary transfer.

<Measure Against Image Blur>

Figure 6:
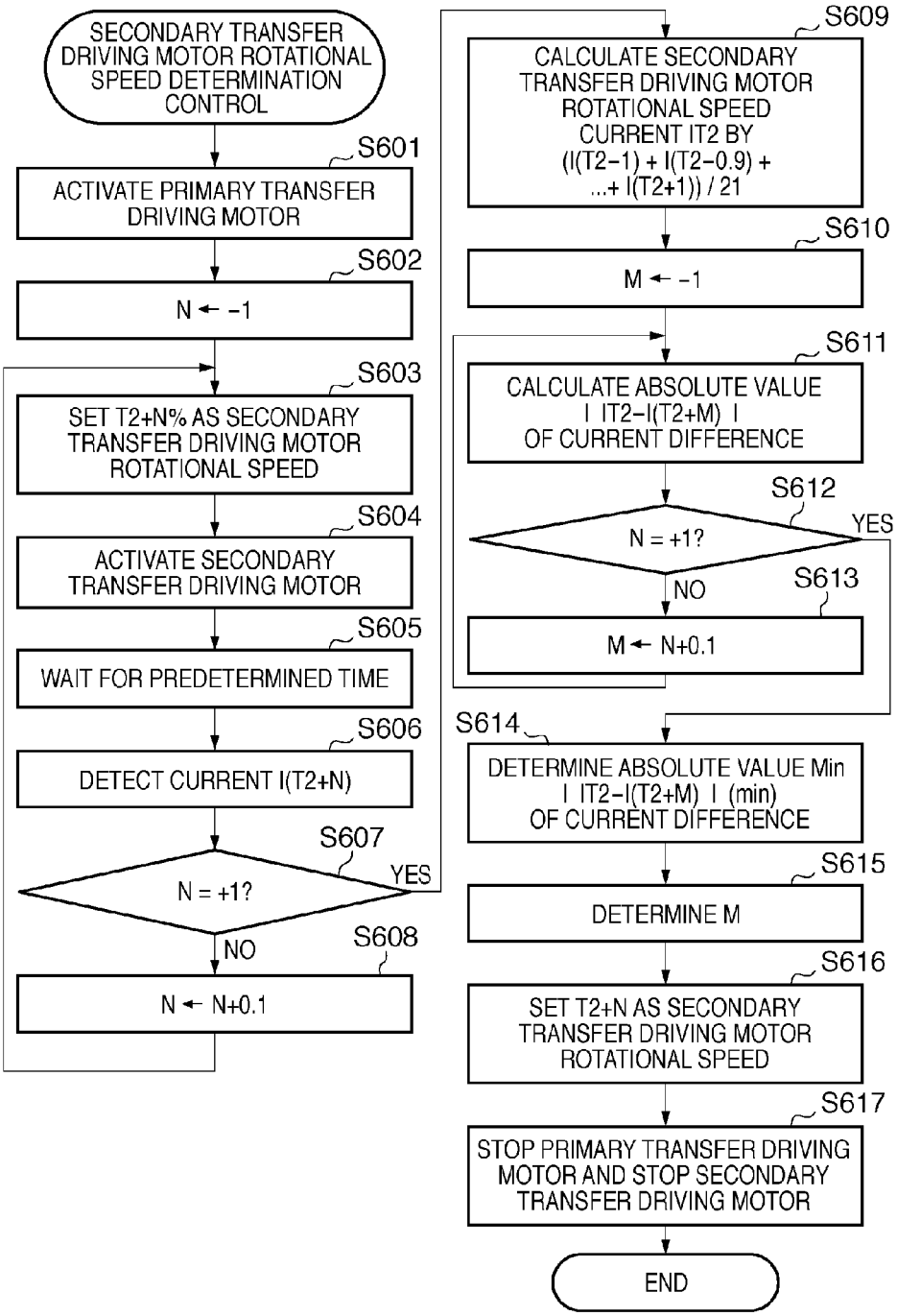
FIG. 6 is a flowchart showing a control sequence executed by a CPU 200 according to the first embodiment.

FIG. 6 is a flowchart showing a control sequence executed by the CPU 200. This control sequence is executed immediately after activating the image forming apparatus 100 or upon explicitly receiving a control sequence execution instruction.

In S601, the CPU 200 activates the primary transfer driving motor 201 (corresponding to the first driving motor) for driving the primary transfer member corresponding to the first rotation member. For example, the CPU 200 instructs the primary transfer driving motor control unit 202 to turn on the primary transfer driving motor 201. In S602, the CPU 200 assigns "−1" to a variable N in order to implement a plurality of relative driving speeds. The variable N indicates the ratio to the reference rotational speed T2 of the secondary transfer driving motor 204 (corresponding to the second driving motor) for driving the secondary transfer belt 137 corresponding to the second rotation member.

In S603, the CPU 200 sets the target rotational speed of the secondary transfer driving motor 204 in the secondary transfer driving motor rotational speed setting unit 220. The set value is T2+N %, which means T2(1+N/100). If N=−1, T2−1% is set in the secondary transfer driving motor rotational speed setting unit 220. In S604, the CPU 200 instructs the secondary transfer driving motor control unit 205 to turn on the secondary transfer driving motor in order to activate the secondary transfer driving motor 204. In S605, the CPU 200 waits for a predetermined time until the rotational speeds of the two motors stabilize. The predetermined time is generally about 1 sec, but is determined depending on the motor specifications. In S606, the CPU 200 detects the current value of the primary transfer driving motor 201 as motor driving information. The currents of the primary transfer driving motor 201 are averaged and amplified by the primary transfer driving motor current detection unit 203, and the amplified current value is input to the A/D converter 211 of the CPU 200. The CPU 200 recognizes the current value I(T2+N). In S607, the CPU 200 determines whether the variable N is +1. If N=+1, the process advances to S609; if N≠+1, to S608. In S608, the CPU 200 adds a step width (ratio) of 0.1 to N. Thereafter, the process returns to S603 to repeat S603 to S608. That is, the current of the primary transfer driving motor 201 is detected with the variable N of −1 to +1 in steps of 0.1 in order to obtain pieces of motor driving information corresponding to a plurality of relative driving speeds. In this way, the CPU 200 and the like function as an obtaining unit which obtains motor driving information indicating the value of a current supplied to the first or second driving motor or the value of a voltage corresponding to the current at each of the relative driving speeds.

FIG. 7A is a table exemplifying obtained data which are stored in a memory (not shown). FIG. 7A shows the input voltage of the A/D converter 211 (output voltage of the OP amplifier 321) when the rotational speed of the secondary transfer driving motor 204 is changed. On a column on the right side of the output voltage column, an A/D-converted value is shown. The embodiment adopts a resolution obtained by equally dividing a voltage of 3.3 V into 255. On a column on the right side of the A/D-converted value column, the input voltage of the OP amplifier 321 is shown. In the embodiment, the amplification factor of the OP amplifier 321 is 5, and the input voltage is ⅕ of the output voltage. On a column on the right side of the input voltage column, the average current value of the primary transfer driving motor 201 is shown. The current value is determined by the resistance value of the current detection resistor RS of the primary transfer driving motor and the input voltage of the OP amplifier 321. In the embodiment, the resistance value of the resistor RS is 0.5Ω.

Figure 7B:
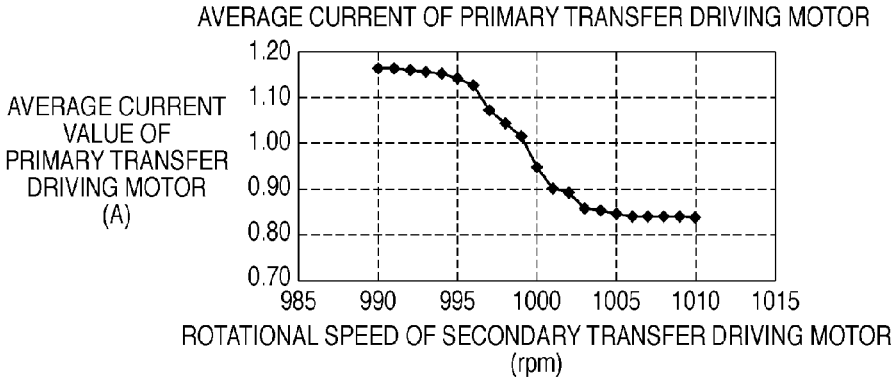
FIG. 7B is a graph exemplifying average current data of the primary transfer driving motor.
Figure 7C:
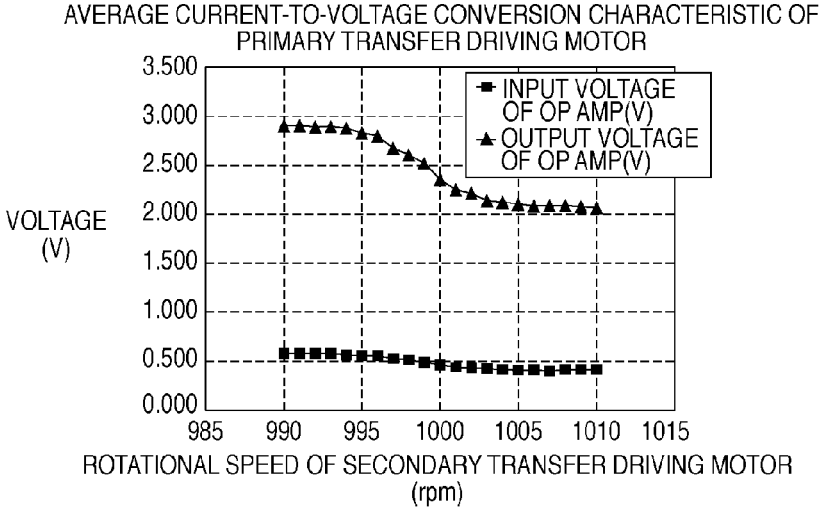
FIG. 7C is a graph exemplifying the input and output voltages of an OP amplifier 321.
Figure 7D:
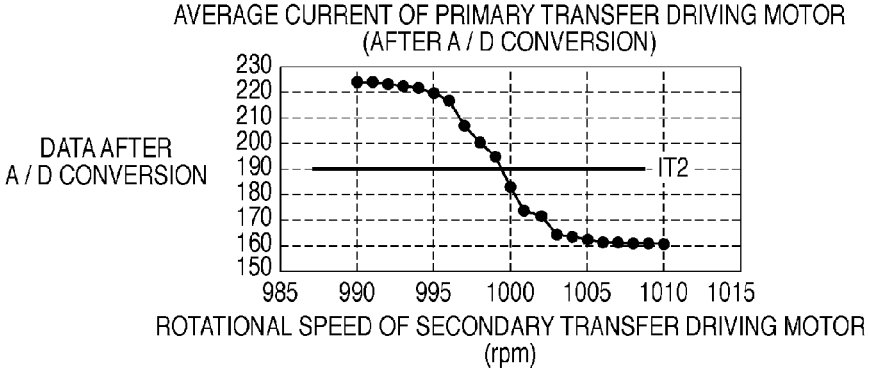
FIG. 7D is a graph exemplifying digital data after A/D conversion.

FIG. 7B is a graph exemplifying average current data of the primary transfer driving motor. FIG. 7C is a graph exemplifying the input and output voltages of the OP amplifier 321. FIG. 7D is a graph exemplifying digital data after A/D conversion. In this fashion, the average current value of the primary transfer driving motor 201 is A/D-converted and recognized as a digital value by the CPU 200. In the embodiment, the N value ranges from −1 to +1. However, the N value is not limited to this range, and is determined from the current value characteristic of the primary transfer driving motor that is obtained by experiment. The N step is 0.1%, but is not limited to this and is determined from the current value characteristic of the primary transfer driving motor that is obtained by experiment.

In S609, the CPU 200 calculates a secondary transfer driving motor rotational speed current value IT2. The secondary transfer driving motor rotational speed current value IT2 is the current value of the primary transfer driving motor 201 when the circumferential speed difference between the primary transfer belt 131 and the secondary transfer belt 137 is almost 0. The CPU 200 calculates the average value of obtained digital data. In FIG. 7D, IT2=190. In this way, the CPU 200 functions as a unit which calculates the average value of currents or voltages indicated by pieces of motor driving information of the first driving motor (primary transfer driving motor 201) that are detected for different driving speeds of the second driving motor (secondary transfer driving motor 204). Note that the average value of motor driving information (current value) of the primary transfer driving motor 201 may be calculated by another calculation method. For example, the CPU 200 may first obtain the current values IL (lower convergent value) and IH (upper convergent value) and then calculate an intermediate value between them, instead of simply calculating the average of all obtained digital data. In FIG. 7D, IL=161, IH=224, and the intermediate value=192.5. Not a strict intermediate value, but an almost intermediate value may be adopted within the allowable range. Needless to say, this alternative calculation method is applicable to other embodiments to be described later.

Referring back to FIG. 6, in S610, the CPU 200 assigns "−1" to a variable M. The variable M is equivalent to the foregoing variable N. In S611, the CPU 200 calculates the absolute value of the difference between IT2 (=190) and I(T2+M). If M=−1, the absolute value of the difference between IT2 and I(T2−1) is calculated. In FIG. 7A, I(T2−1) =224, and thus the difference is 34. In S612, the CPU 200 determines whether the value of the variable M is +1. If M=+1, the process shifts to S614; if M≠+1, to S613. In S613, the CPU 200 adds 0.1 to M, and the process returns to S611. Then, the CPU 200 repetitively executes S611 to S613.

While changing the variable M from −1 to +1 in steps of 0.1, the absolute value of the difference between IT2 and I(T2+M) is calculated. FIG. 7A shows the calculation results on the rightmost column. Note that the average value is calculated in S609, but any calculation method can be similarly employed as long as it can be determined whether the influence of the primary transfer belt 131 and secondary transfer belt 137 on each other is small.

In S614, the CPU 200 specifies a local minimum value (minimum value) among the obtained calculation results. In FIG. 7A, the minimum value is 5. In S615, the CPU 200 determines an M value obtained when the absolute value of the difference from the average current value becomes local minimum. In the calculation example shown in FIG. 7A, M=−0.1. The secondary transfer driving motor rotational speed determination unit 210 functions as a driving speed determination unit which determines the target driving speed of the second driving motor based on the driving speed of the second driving motor at which the difference between the current or voltage value serving as motor driving information, and the average value becomes local minimum. That is, the secondary transfer driving motor rotational speed determination unit 210 is an example of a driving speed determination unit which determines, as the target driving speed of the second driving motor, the driving speed of the second driving motor that corresponds to an intermediate value among values indicated by pieces of motor driving information obtained by the obtaining unit while changing the relative driving speed.

In S616, the CPU 200 sets T2+M % as the target rotational speed in image formation in the secondary transfer driving motor rotational speed setting unit 220. In the calculation example shown in FIG. 7A, M=−0.1, so T2−0.1% is set. The set information is stored in a nonvolatile memory or the like and used for subsequent image formation. In S617, the CPU 200 transmits an instruction to the driving control units of the respective motors to stop the primary transfer driving motor 201 and secondary transfer driving motor 204. Thereafter, the control sequence ends. In image formation executed later, the secondary transfer driving motor 204 is driven in accordance with the target rotational speed obtained in this sequence.

According to the first embodiment, generation of an image blur can be suppressed by controlling the circumferential speed of the secondary transfer belt 137 at high precision based on the current value (motor driving information) of the primary transfer driving motor 201. More specifically, the circumferential speed difference between the two motors (primary transfer belt 131 and secondary transfer belt 137) is reduced in accordance with, for example, the average value or intermediate value of the currents of one motor (primary transfer driving motor 201) that is detected while changing the rotational speed of the other motor (secondary transfer driving motor 204). When reducing the circumferential speed difference, it suffices to control the rotational speed of either motor (secondary transfer driving motor 204 in the above description). In the above description, the influence of the primary transfer belt 131 and secondary transfer belt 137 on each other becomes almost minimum, suppressing generation of an image blur. As another control, it is also conceivable to form color misregistration detection patches while two rotation members have a circumferential speed difference, and reduce the circumferential speed difference between the two rotation members based on the detection result. Unlike this solution, the above-described control does not consume toner. Further, the above-described control can reduce the time (downtime) taken for formation of color misregistration detection patches, cleaning of them, and the like.

Second Embodiment

The second embodiment will describe an invention in which, while applying a secondary transfer bias to a secondary transfer belt 137, the current value of a primary transfer driving motor 201 is detected to control the target rotational speed of a secondary transfer driving motor 204.

Figure 8A:
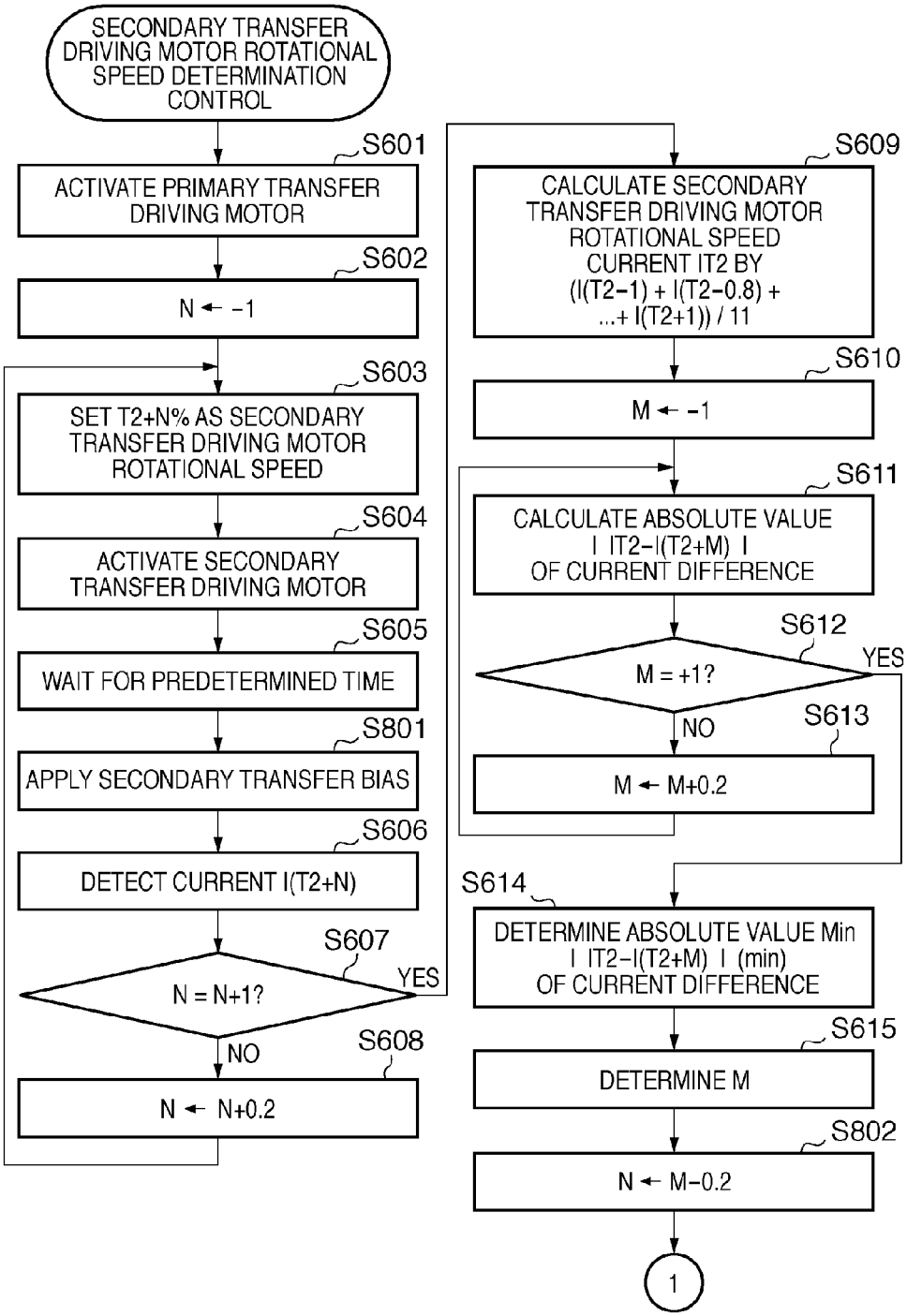
FIGS. 8A and 8B are flowcharts showing a control sequence executed by a CPU 200 according to the second embodiment.
Figure 8B:
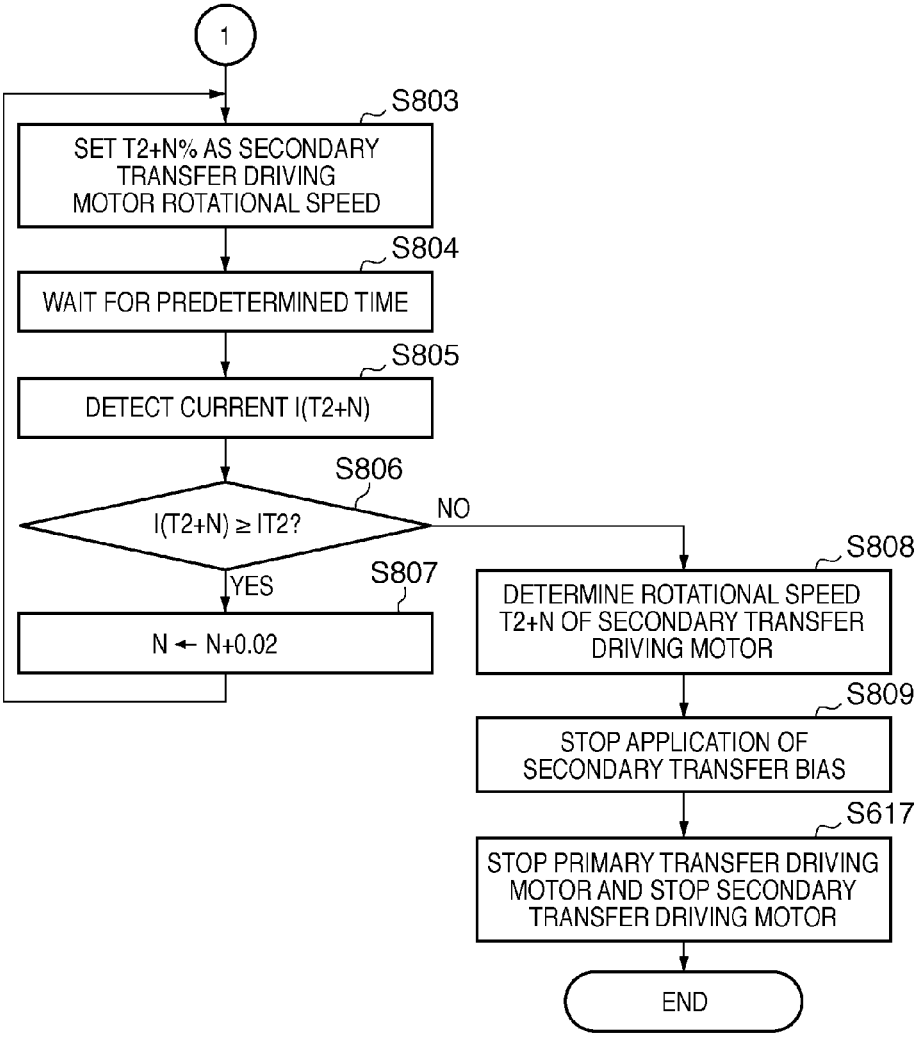

FIGS. 8A and 8B are flowcharts showing a control sequence executed by a CPU 200. The same reference symbols as those in FIG. 6 denote the same processes to simplify the description. In FIG. 8A, S801 is inserted between S605 and S606 in FIG. 6. Also, S802 to S809 replace S616.

In S801, the CPU 200 instructs a bias applying unit 206 to apply the secondary transfer bias. In response to this, the bias applying unit 206 starts applying the secondary transfer bias. The secondary transfer bias is positive when transferring a toner image from a primary transfer belt 131 onto a print sheet 111, and negative in cleaning. In S801, a positive bias is applied. In S606, the current of the primary transfer driving motor 201 is detected. The bias applying unit 206 functions as a transfer bias applying unit which applies a transfer bias to the secondary transfer member. The primary transfer driving motor current detection unit 203 detects a current while applying the transfer bias to the secondary transfer member.

Although the step width added in S608 and S613 is 0.1 in the first embodiment, it may be 0.2 in the second embodiment. Generally when the secondary transfer bias is applied, electrostatic adsorbability acts between the primary transfer belt 131 and the secondary transfer belt 137, increasing the degree of adhesion. In the second embodiment, therefore, the primary transfer driving motor current characteristic is obtained more stably than in the first embodiment, and the precision can be maintained even with a smaller number of current value samples.

FIG. 9 is a table exemplifying data obtained in the second embodiment. The data items are the same as those described with reference to FIG. 7A. Note that the number of samples is decreased from 21 to 11. S610 to S616 are the same as those in the first embodiment, and a description thereof will not be repeated. In the calculation example of FIG. 7A, the minimum value of the average current values is calculated to be 9 in S614, and M is determined to be 0 in S615.

In step S802, the CPU 200 assigns "M−0.2" to the variable N. The reason of setting −0.2 is to perform the following processing based on data adjacent to I(T2+M) closest to the obtained value IT2. In the calculation example of FIG. 9, IT2=193.

In step S803, the CPU 200 sets T2+N (T2−0.2% in this case) as the rotational speed of the secondary transfer driving motor 204. In step S804, the CPU 200 waits for a predetermined time until the rotational speed of the secondary transfer driving motor 204 almost coincides with T2+N and stabilizes. In step S805, the CPU 200 detects the average current value of the primary transfer driving motor 201. In step S806, the CPU 200 determines whether the average current value I(T2+N) is equal to or larger than IT2 (=193). If I(T2+N) is smaller than IT2, the process shifts to step S808; if I(T2+N) is equal to or larger than IT2, to S807. In S807, the CPU 200 adds 0.02% to N, and returns to S803. Thereafter, the CPU 200 executes again S803 to S806.

In this manner, while incrementing N in steps of 0.02%, the average current value of the primary transfer driving motor 201 can be detected to determine an N value closest to IT2. Note that the step width of the rotational speed for deriving an N value closest to IT2 is 0.02%, but this step width is merely an example. For higher precision, it suffices to set a smaller step width.

In S808, the CPU 200 determines T2+N as the rotational speed of the secondary transfer driving motor 204, and sets it as the secondary transfer driving motor rotational speed. In S809, the CPU 200 instructs the bias applying unit 206 to stop the application of the secondary transfer bias. In S617, the primary transfer driving motor 201 and secondary transfer driving motor 204 stop.

As described above, the second embodiment can attain the same effects as those in the first embodiment. Further, in the second embodiment, while applying the secondary transfer bias, the current value of the primary transfer driving motor 201 and the rotational speed characteristic of the secondary transfer driving motor 204 are obtained. This can further increase the determination precision of the rotational speed of the secondary transfer driving motor 204.

Third Embodiment

In the first or second embodiment, the rotational speed of the secondary transfer driving motor 204 is controlled by detecting the current value of the primary transfer driving motor 201. However, when the motor current of the secondary transfer driving motor 204 draws a linear characteristic with respect to the load, the rotational speed of the secondary transfer driving motor 204 can be controlled by detecting the current value of the secondary transfer driving motor 204. A method of controlling the rotational speed of the secondary transfer driving motor 204 by detecting the current value of the secondary transfer driving motor 204 is applicable to both the first and second embodiments, and an application to the first embodiment will be explained below.

Figure 10:
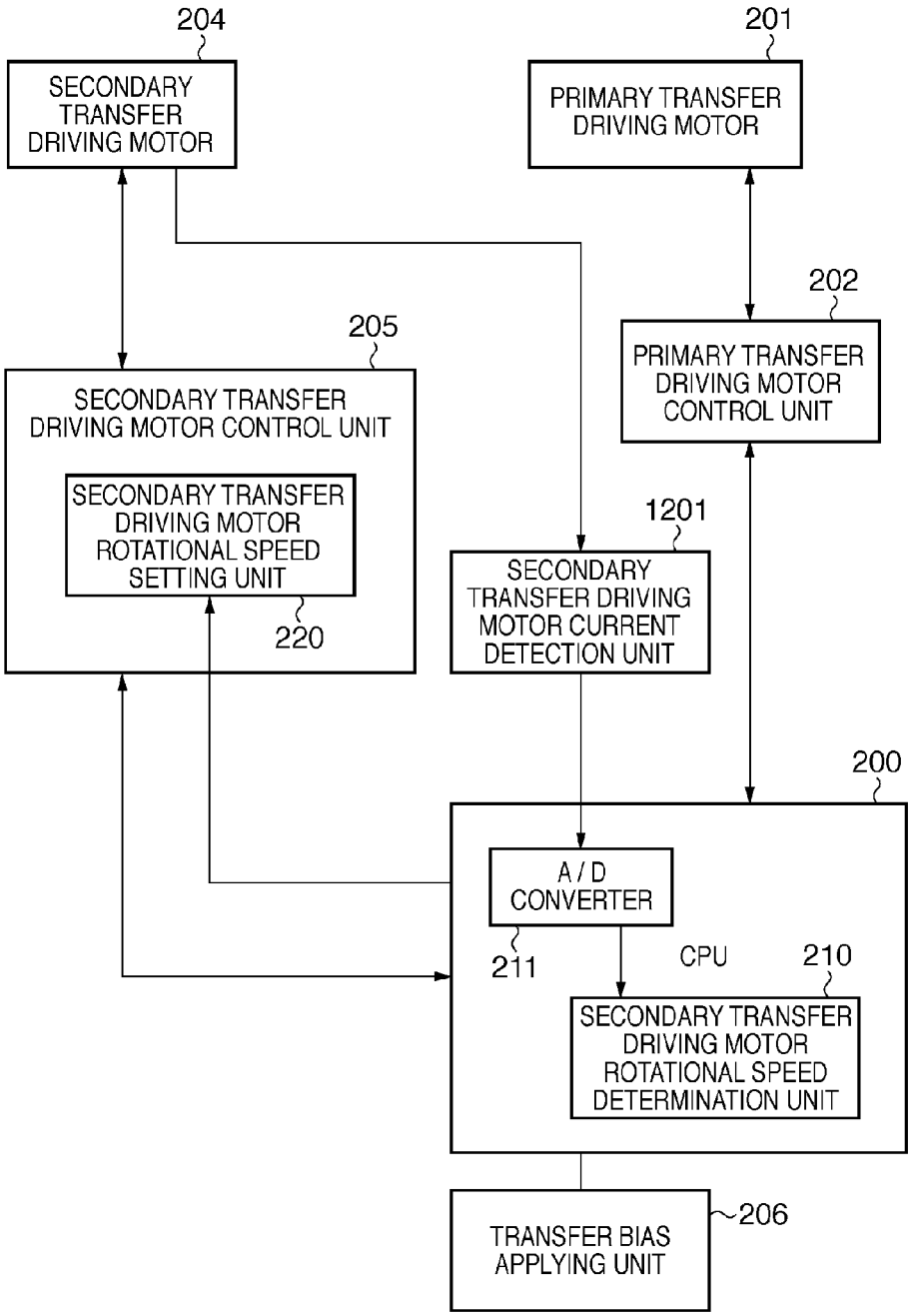
FIG. 10 is a block diagram showing the control circuit of an image forming apparatus according to the third embodiment.

FIG. 10 is a block diagram showing the control circuit of an image forming apparatus according to the third embodiment. The same reference numerals as those in FIG. 2 denote the same parts, and a description thereof will not be repeated. Assume that a secondary transfer driving motor 204 according to the third embodiment employs a DC brushless motor. A secondary transfer driving motor current detection unit 1201 replaces the primary transfer driving motor current detection unit 203. The secondary transfer driving motor current detection unit 1201 detects the current of the secondary transfer driving motor 204, and outputs the detection signal to an A/D converter 211. The arrangement example of the secondary transfer driving motor current detection unit 1201 is the same as the arrangement of the primary transfer driving motor current detection unit 203. This is because the secondary transfer driving motor 204 is also a DC brushless motor similar to a primary transfer driving motor 201.

Figure 11:
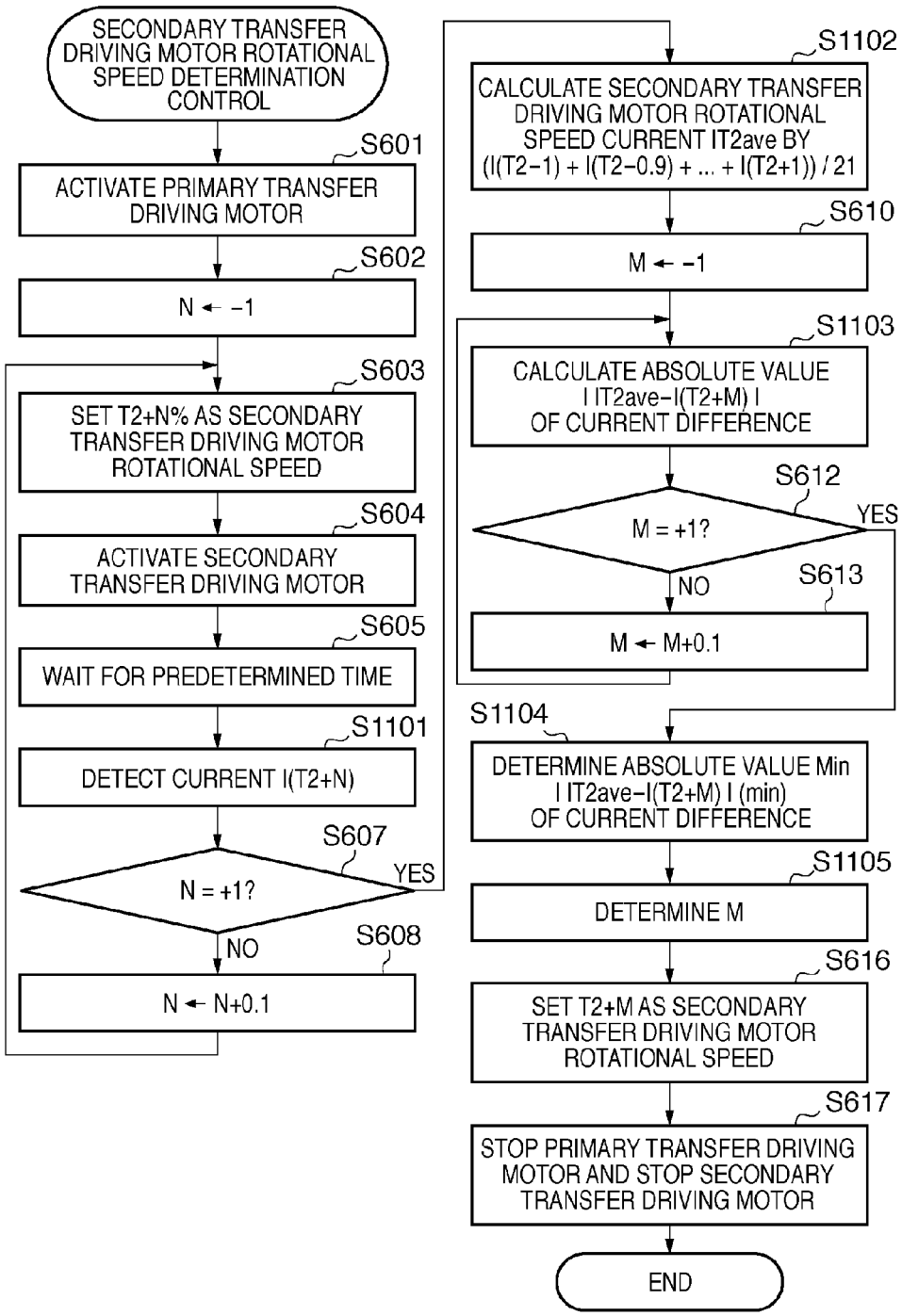
FIG. 11 is a flowchart showing a control sequence executed by a CPU 200 according to the third embodiment.

FIG. 11 is a flowchart showing a control sequence executed by a CPU 200 according to the third embodiment. The same reference symbols as those in FIG. 6 denote the same processes to simplify the description. In FIG. 11, S1101 to S1105 replace S606, S609, S611, S614, and S615 in FIG. 6. This is because a current value to be detected is changed from the current value of the primary transfer driving motor 201 to that of the secondary transfer driving motor 204.

In S1101, the CPU 200 detects the current value I(T2+N) of the secondary transfer driving motor 204 using the secondary transfer driving motor current detection unit 1201. In S1102, the CPU 200 calculates the average value IT2ave of a plurality of current values of the secondary transfer driving motor 204 that have been detected while changing the rotational speed of the secondary transfer driving motor 204. In S1103, the CPU 200 calculates the absolute value of the difference between the average value IT2ave and each detected current value I(T2+M). In S1104, the CPU 200 determines a minimum value among the calculated absolute values. In S1105, the CPU 200 determines a variable M corresponding to the minimum value. In S616, the CPU 200 sets T2+M % as the target rotational speed in a secondary transfer driving motor rotational speed setting unit 220.

As described above, the third embodiment can also obtain the same effects as those in the first embodiment. As a matter of course, the second embodiment can adopt the current value of the secondary transfer driving motor instead of that of the primary transfer driving motor, similar to the third embodiment.

Fourth Embodiment

Figure 12:
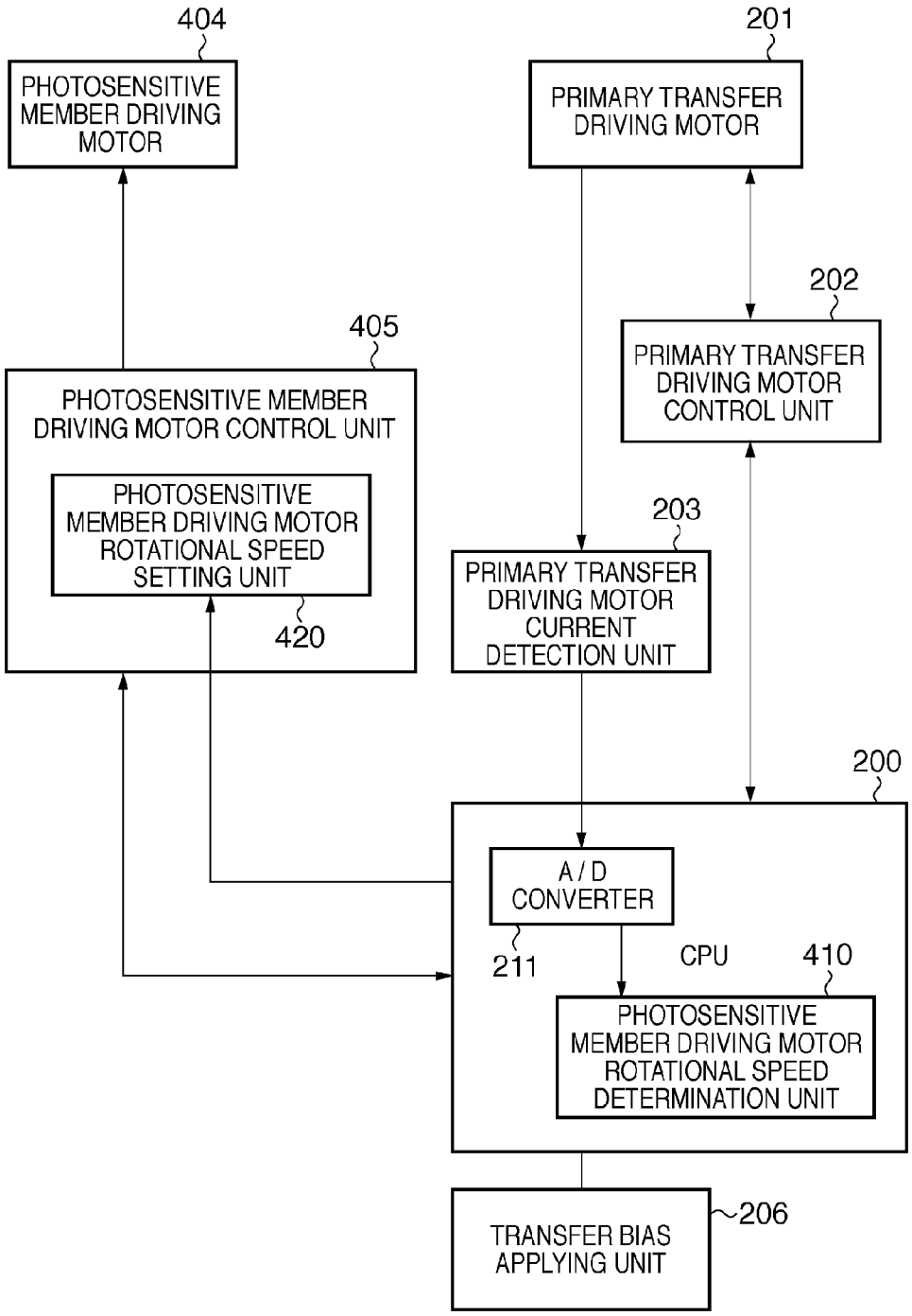
FIG. 12 is a block diagram showing control circuits which control a primary transfer driving motor and photosensitive member driving motor.

FIG. 12 is a block diagram showing the control block arrangement of a primary transfer driving motor 201 (corresponding to the first driving motor) and photosensitive member driving motor 404 (corresponding to the second driving motor) according to the fourth embodiment. For descriptive convenience, only a difference from FIG. 2 will be mainly described.

The photosensitive member driving motor 404 is a motor which drives four photosensitive members 122 to rotate, and is, for example, a stepping motor. Note that the photosensitive member driving motor 404 may be one motor which drives the four photosensitive members 122 at once, or correspond to a plurality of motors each of which drives one or more photosensitive members 122. A photosensitive member driving motor control unit 405 controls driving of the photosensitive member driving motor 404. A photosensitive member driving motor rotational speed setting unit 420 sets the rotational speed of the photosensitive member driving motor 404. The photosensitive member driving motor control unit 405 controls the photosensitive member driving motor 404 based on the set rotational speed. A photosensitive member driving motor rotational speed determination unit 410 is incorporated in a CPU 200, and determines the rotational speed of the photosensitive member driving motor 404 in image formation based on a primary transfer driving motor current value converted into digital data by an A/D converter 211. For example, the photosensitive member driving motor control unit 405 can be formed from a sub-CPU and stepping motor driver IC. A register arranged in the sub-CPU functions as the photosensitive member driving motor rotational speed setting unit 420. The CPU 200 sets, in the register via a communication unit, the photosensitive member driving motor rotational speed determined by the photosensitive member driving motor rotational speed determination unit 410. The photosensitive member driving motor control unit 405 controls rotation of the photosensitive member driving motor 404 by outputting pulses corresponding to the rotational speed to the stepping motor driver IC.

<Relationship between Rotational Speed of Photosensitive Member Driving Motor and Current of Primary Transfer Driving Motor>

The speed of a primary transfer belt 131 and that of the photosensitive member 122 are determined in advance to coincide with the process speed of image formation. To obtain this speed, the rotational speeds of the primary transfer driving motor 201 and photosensitive member driving motor 404 are determined. The rotational speed of the primary transfer driving motor 201 is defined as T1, and the target rotational speed of the photosensitive member driving motor 404 is defined as D.

Figure 13A:
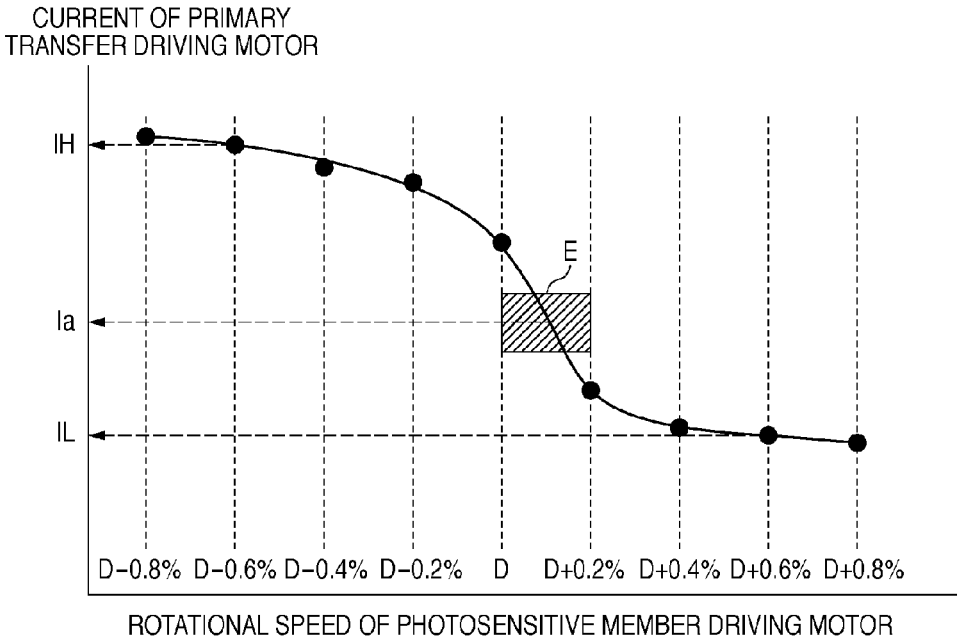
FIGS. 13A and 13B are graphs showing the relationship between the rotational speed of the photosensitive member driving motor and the current of the primary transfer driving motor.
Figure 13B:
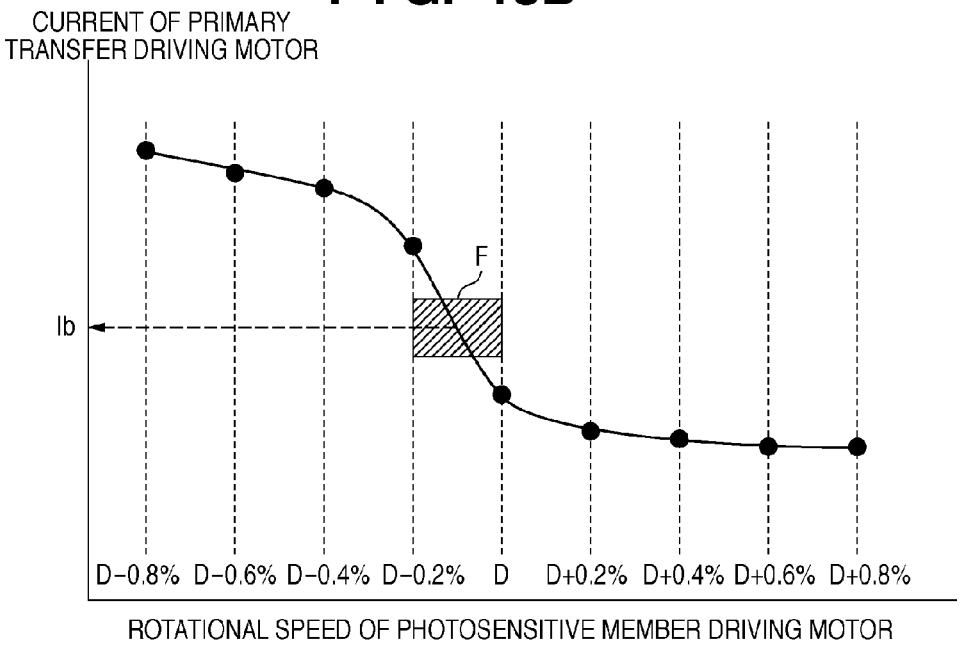

FIGS. 13A and 13B are graphs showing changes of the average value of a current flowing through the primary transfer driving motor 201 when the rotational speed of the photosensitive member driving motor 404 is changed while that of the primary transfer driving motor 201 is fixed to T1 in two different image forming apparatuses. The average current value of the primary transfer driving motor 201 when the rotational speed D of the photosensitive member driving motor 404 is changed in steps of 0.2% are plotted. In both FIGS. 13A and 13B, the average current value of the primary transfer driving motor 201 is larger for a lower rotational speed of the photosensitive member driving motor 404, and smaller for a higher rotational speed of the photosensitive member driving motor 404 because of the following reason. When the rotational speed of the photosensitive member driving motor 404 decreases, the speed of the photosensitive member 122 also decreases, increasing the load on the primary transfer belt 131. As a result, a larger output from the primary transfer driving motor 201 is required. When the rotational speed of the photosensitive member driving motor 404 increases, an output from the primary transfer driving motor 201 decreases because of the counteraction, decreasing the current of the primary transfer driving motor 201. The circumferential speed difference between the primary transfer belt 131 and the photosensitive member 122 hardly changes within a predetermined range or more with respect to the rotational speed of the photosensitive member driving motor. In FIG. 13A, the average current value converges to almost IL at D+0.6% or more, and IH at D−0.6% or less. This is because, when the circumferential speed difference between the primary transfer belt 131 and the photosensitive member 122 falls within a predetermined range or more, a stress exceeding the coefficient of kinetic friction between the primary transfer belt 131 and the photosensitive member 122 acts, and the primary transfer belt 131 and photosensitive member 122 slip. The circumferential speed difference between the primary transfer belt 131 and the photosensitive member 122 becomes almost 0 within an almost intermediate range (range E in FIG. 13A and range F in FIG. 13B) between the average current values IL and IH. For this reason, the influence of the photosensitive member 122 on the primary transfer belt 131 becomes almost 0. In the ranges E and F, the primary transfer belt 131 and photosensitive member 122 are maintained in an almost distortion-free state. In FIG. 13A, the rotational speed of the photosensitive member driving motor at the center of the range E is D+0.1%, and the average current value of the primary transfer driving motor is Ia. In FIG. 13B, the rotational speed of the photosensitive member driving motor at the center of the range F is D+0.1%, and the average current of the primary transfer driving motor is Ib. The difference in rotational speed arises from variations of the outer shape of the primary transfer driving roller, and variations of the rotational speed offset by the driving motor control unit. The difference in average current value is generated from variations of the load of the primary transfer unit, and variations of the efficiency of the primary transfer driving motor 201. Hence, determining the rotational speed and average current value in advance may cause a control error.

From this, the fourth embodiment almost eliminates the circumferential speed difference between the primary transfer belt 131 and the photosensitive member 122 using the current characteristic of the primary transfer driving motor 201, thereby reducing color misregistration when transferring a toner image onto to the primary transfer belt 131.

<Measure Against Image Blur>

Figure 14:
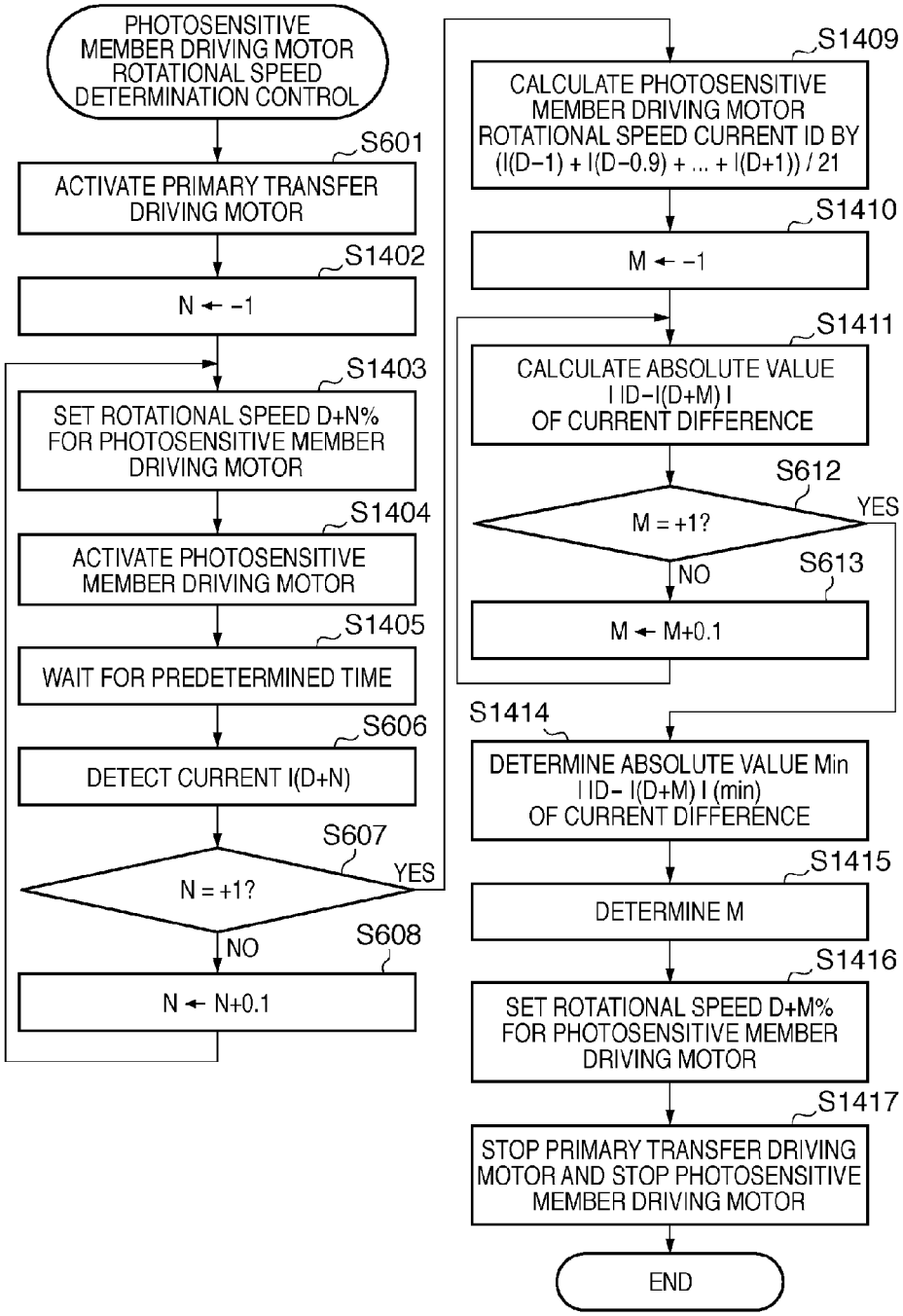
FIG. 14 is a flowchart showing a control sequence executed by a CPU 200 according to the fourth embodiment.

FIG. 14 is a flowchart showing a control sequence executed by the CPU 200. This control sequence is executed immediately after activating an image forming apparatus 100 or upon explicitly receiving a control sequence execution instruction. Assume that a bias applying unit 206 does not apply a bias to a developing sleeve 126 when the flowchart of FIG. 14 is executed, so as to prevent fog toner or the like from entering a nip formed between the photosensitive member 122 and the primary transfer belt 131. Further, each developing sleeve may be separated from the corresponding photosensitive member 122. Depending on the characteristics of the image forming apparatus, application to the developing sleeve 126 or separation of the developing sleeve 126 from the photosensitive member 122 may be unnecessary in terms of control precision. A difference from FIG. 6 will be mainly explained.

In S601, the primary transfer driving motor 201 is activated, and the process advances to S1402. In S1402, the CPU 200 assigns "−1" to the variable N. The variable N is used as the ratio to the reference rotational speed D of the photosensitive member driving motor 404. In S1403, the CPU 200 sets the photosensitive member driving motor rotational speed in the photosensitive member driving motor rotational speed setting unit 420. The set value is a rotational speed of D+N %. If N=−1, D−1% is set in the photosensitive member driving motor rotational speed setting unit 420. In S1404, the CPU 200 instructs the photosensitive member driving motor control unit 405 to turn on the photosensitive member driving motor in order to activate the photosensitive member driving motor 404. In S1405, the CPU 200 waits for a predetermined time until the rotational speeds of the two motors stabilize. The predetermined time is generally about 1 sec, but is determined depending on the motor specifications.

FIG. 15A is a table exemplifying obtained data. FIG. 15A shows the input voltage of the A/D converter 211 (output voltage of an OP amplifier 321) from the CPU 200 when the rotational speed of the photosensitive member driving motor 404 is changed. On a column on the right side of the output voltage column, a value obtained by A/D-converting the output voltage is shown. The embodiment adopts a resolution obtained by equally dividing a voltage of 3.3 V into 255. On a column on the right side of the A/D-converted value column, the input voltage of the OP amplifier is shown. In the embodiment, the amplification factor of the OP amplifier is 4, and the input voltage is ¼ of the output voltage. On a column on the right side of the input voltage column, the average current value of the primary transfer driving motor 201 is shown. The current value is determined by the resistance value of the current detection resistor Rs of the primary transfer driving motor 201 and the input voltage of the OP amplifier. In the embodiment, the Rs resistance value is 2.0Ω.

Figure 15B:
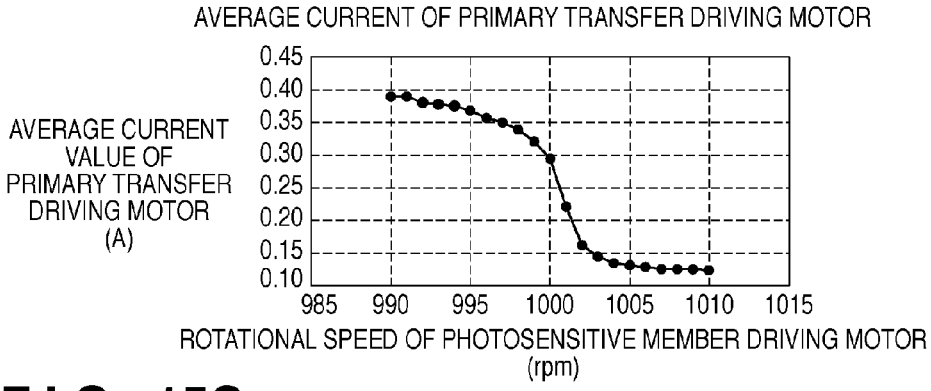
FIG. 15B is a graph exemplifying average current data of a primary transfer driving motor 201.
Figure 15C:
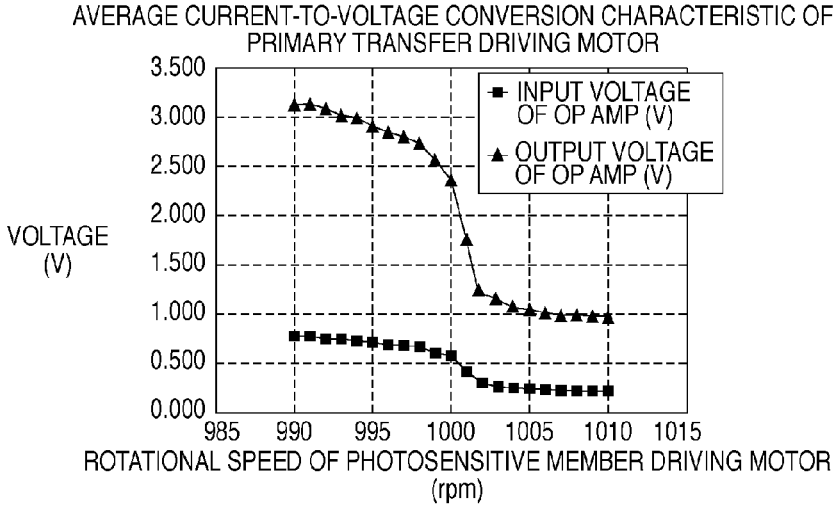
FIG. 15C is a graph exemplifying data of the input and output voltages of an OP amplifier 321.
Figure 15D:
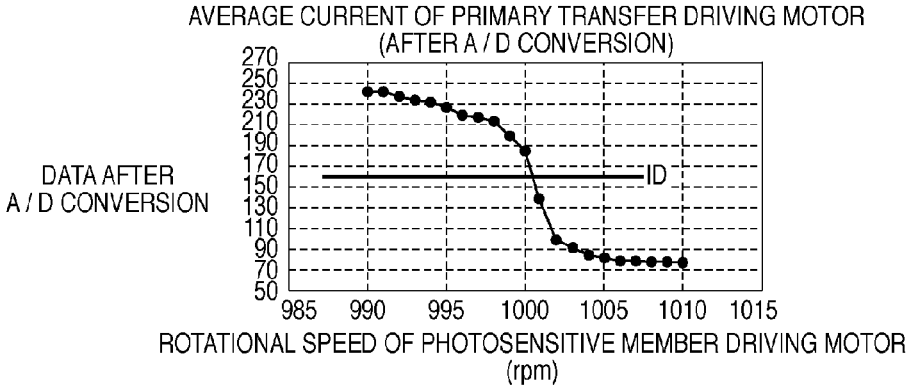
FIG. 15D is a graph exemplifying digital value data after A/D conversion.

FIG. 15B is a graph exemplifying average current data of the primary transfer driving motor 201. FIG. 15C is a graph exemplifying data of the input and output voltages of the OP amplifier 321. FIG. 15D is a graph exemplifying digital value data after A/D conversion. In this manner, the average current value of the primary transfer driving motor 201 is A/D-converted and recognized as a digital value by the CPU 200. In the embodiment, the N value ranges from −1 to +1, but is not limited to this range. The N range is determined from the current value characteristic of the primary transfer driving motor 201 that is obtained by experiment. The N step is 0.1%, but is not limited to this. The N step is determined from the current value characteristic of the primary transfer driving motor 201 that is obtained by experiment.

In S1409, the CPU 200 calculates a photosensitive member driving motor rotational speed current value ID. The photosensitive member driving motor rotational speed current value ID is the current consumption value of the primary transfer driving motor 201 when the circumferential speed difference between the primary transfer belt 131 and the photosensitive member 122 is almost 0. The CPU 200 calculates ID as the above-mentioned average value of digital value data. In FIG. 15D, ID=159.

In S1410, the CPU 200 assigns "−1" to the variable M. The variable M is equivalent to the foregoing variable N. In S1411, the CPU 200 calculates the absolute value of the difference between ID (=159) and I(D+M). If M=−1, the absolute value of the difference between ID and I(D−1) (=243) is calculated to be 84. The CPU 200 calculates the absolute value of the difference between ID and I(D+M) in steps of 0.1 from −1 to +1 through S612 and S613. FIG. 15A shows the calculation results. Note that the average value is calculated in S1409, but the calculation method is not limited to this. The calculation method is arbitrary as long as it can be determined whether the influence of the primary transfer belt 131 and photosensitive member 122 on each other is small.

In S1414, the CPU 200 selects a minimum value from the obtained calculation results. In FIG. 15A, the minimum value is 21. In S1415, the CPU 200 determines an M value. In this example, M=+0.1. In S1416, the CPU 200 sets D+M % in the photosensitive member driving motor rotational speed setting unit 420. In the embodiment, M=+0.1, so D+0.1% is set. The set information is stored in a nonvolatile memory or the like and used for subsequent image formation. In S1417, the CPU 200 transmits an instruction to the driving control units of the respective motors to stop the primary transfer driving motor 201 and photosensitive member driving motor 404. The process then ends. In subsequent image formation, the photosensitive member driving motor 404 is driven in accordance with the photosensitive member driving motor rotational speed obtained in this sequence.

As described above, the rotational speed of the photosensitive member driving motor 404 at which the influence of the primary transfer belt 131 and photosensitive member 122 on each other becomes minimum can be obtained from the current value of the primary transfer driving motor 201 and the rotational speed characteristic of the photosensitive member driving motor 404. The obtained rotational speed of the photosensitive member driving motor 404 may be periodically updated or stored in a nonvolatile memory or the like.

In the above description, the current value of the primary transfer driving motor 201 is detected to determine the rotational speed of the photosensitive member driving motor 404. Alternatively, the current value of the primary transfer driving motor 201 may be detected to determine the rotational speed of the primary transfer driving motor 201. If the photosensitive member driving motor 404 is a brushless motor, the current value of the photosensitive member driving motor 404 may be detected to determine the rotational speed of the primary transfer driving motor 201. The same effects can be obtained even by detecting the current value of the photosensitive member driving motor 404 and determining the rotational speed of the photosensitive member driving motor 404.

Fifth Embodiment

The basic arrangement of an image forming apparatus is the same as that in the first embodiment, and a description thereof will not be repeated. First, contact and separation of a photosensitive member 122 and primary transfer belt 131 will be explained with reference to FIGS. 16A and 16B. The photosensitive member 122 and primary transfer belt 131 are brought into contact with each other or separated from each other by vertically moving a primary transfer roller 132 by a primary transfer separation motor and eccentric cam (neither is shown). In general, contact/separation of the photosensitive members 122 and primary transfer belt 131 is simultaneously performed for respective colors. In the fifth embodiment, however, contact/separation of the photosensitive members 122 and primary transfer belt 131 can be individually done.

Figure 16A:
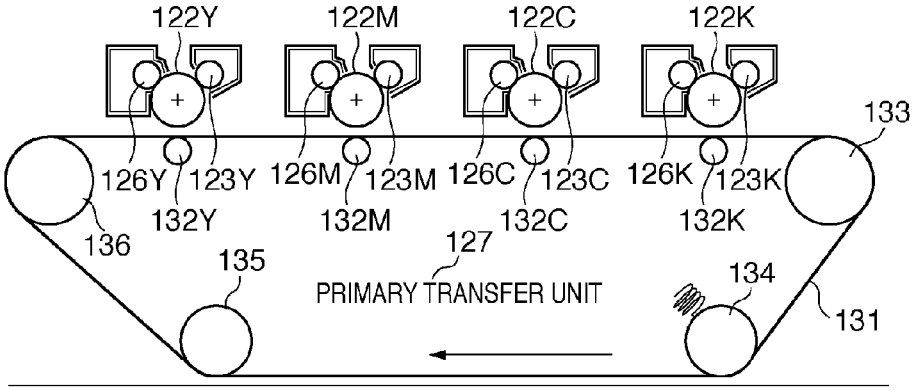
FIG. 16A is a view showing a state in which photosensitive members 122 of all colors and a primary transfer belt 131 are spaced apart from each other.

FIG. 16A is a view showing a state in which the photosensitive members 122 of all colors and the primary transfer belt 131 are spaced apart from each other. The separated state is generally used in power-off or on printing standby. The purpose of the separated state is to prevent deformation of the primary transfer roller 132 and primary transfer belt 131 when the photosensitive member 122 and primary transfer belt are not driven.

Figure 16B:
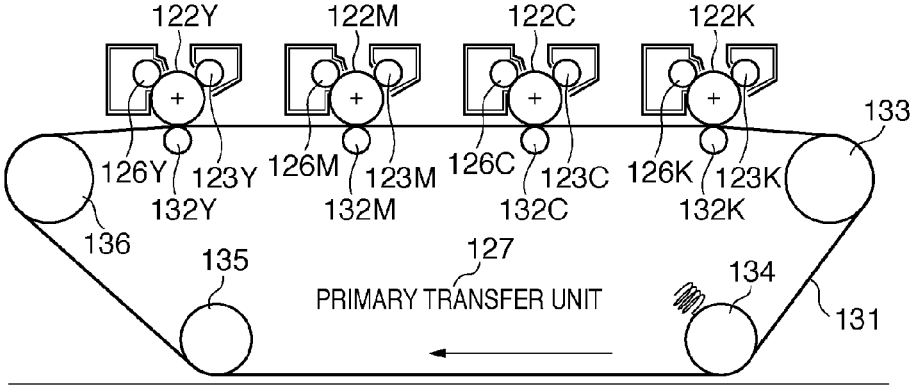
FIG. 16B is a view showing a state (all-contact state) in which the photosensitive members 122 of all colors and the primary transfer belt 131 are in contact with each other.

FIG. 16B is a view showing a state (all-contact state) in which the photosensitive members 122 of all colors and the primary transfer belt 131 are in contact with each other. The all-contact state is generally used in full-color printing. In the separated state of FIG. 16A, the photosensitive member 122 and primary transfer belt 131 do not contact each other. Thus, even if the photosensitive member 122 and primary transfer belt 131 have a speed difference, a load generated by the speed difference does not act on the primary transfer belt 131. In the all-contact state of FIG. 16B, if the photosensitive member 122 and primary transfer belt 131 have a speed difference, a load generated by the speed difference acts on the primary transfer belt 131. However, even in the all-contact state, if the photosensitive member 122 and primary transfer belt 131 do not have a speed difference, a load generated by the speed difference from the photosensitive member 122 does not act on the primary transfer belt 131. In other words, in the fifth embodiment, the speed of a photosensitive member driving motor 404 is controlled so that the current consumption of a primary transfer driving motor 201 in a state in which the photosensitive member 122 and primary transfer belt 131 are in contact with each other becomes equal to that of the primary transfer driving motor 201 in the separated state. This can further minimize the influence of the primary transfer belt 131 and photosensitive member 122 on each other.

Next, contact and separation of the photosensitive member 122 and a developing sleeve 126 will be explained with reference to FIG. 16C. The developing sleeves 126 are an example of a plurality of developing units which can be brought into contact with or separated from a plurality of photosensitive drums corresponding to different colors. The photosensitive member 122 and developing sleeve 126 are brought into contact with each other or separated from each other by moving the developing sleeve 126 toward the photosensitive member 122 by a developing motor and eccentric cam (neither is shown). In general, contact/separation of the photosensitive members 122 and developing sleeves 126 is simultaneously done for respective colors. In the fifth embodiment, however, contact/separation of the photosensitive members 122 and developing sleeves 126 can be individually executed.

Figure 16C:
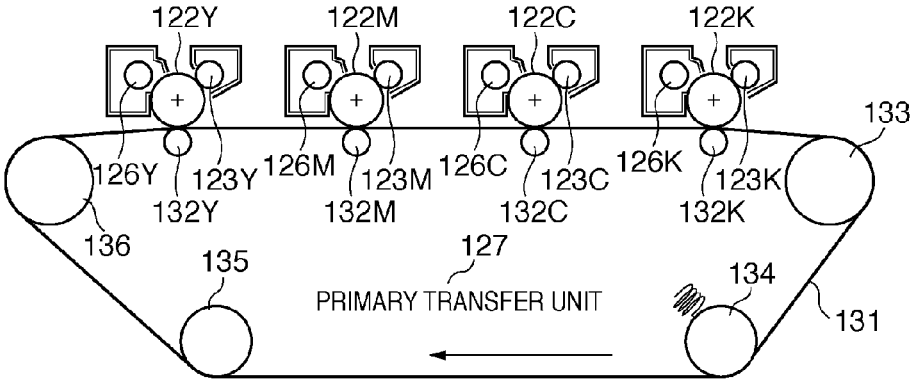
FIG. 16C is a view showing a state in which the photosensitive members 122 of all colors and developing sleeves 126 are spaced apart from each other.

FIG. 16C is a view showing a state in which the photosensitive members 122 of all colors and the developing sleeves 126 are spaced apart from each other. The separated state is generally used in no-image formation such as power-off, printing standby, or rotation before or after printing. The purpose of separating the photosensitive member 122 and developing sleeve 126 in power-off or on printing standby is to prevent deformation of the roller layer of the developing sleeve 126. The purpose of separating the photosensitive member 122 and developing sleeve 126 in rotation before or after printing is to prevent shortening of the service life of the photosensitive member 122. This is because, if the photosensitive member 122 rotates at a timing other than the developing operation, the surface layer of the photosensitive member 122 is shaved by rubbing between the developing sleeve 126 and the photosensitive member 122.

Figure 17A:
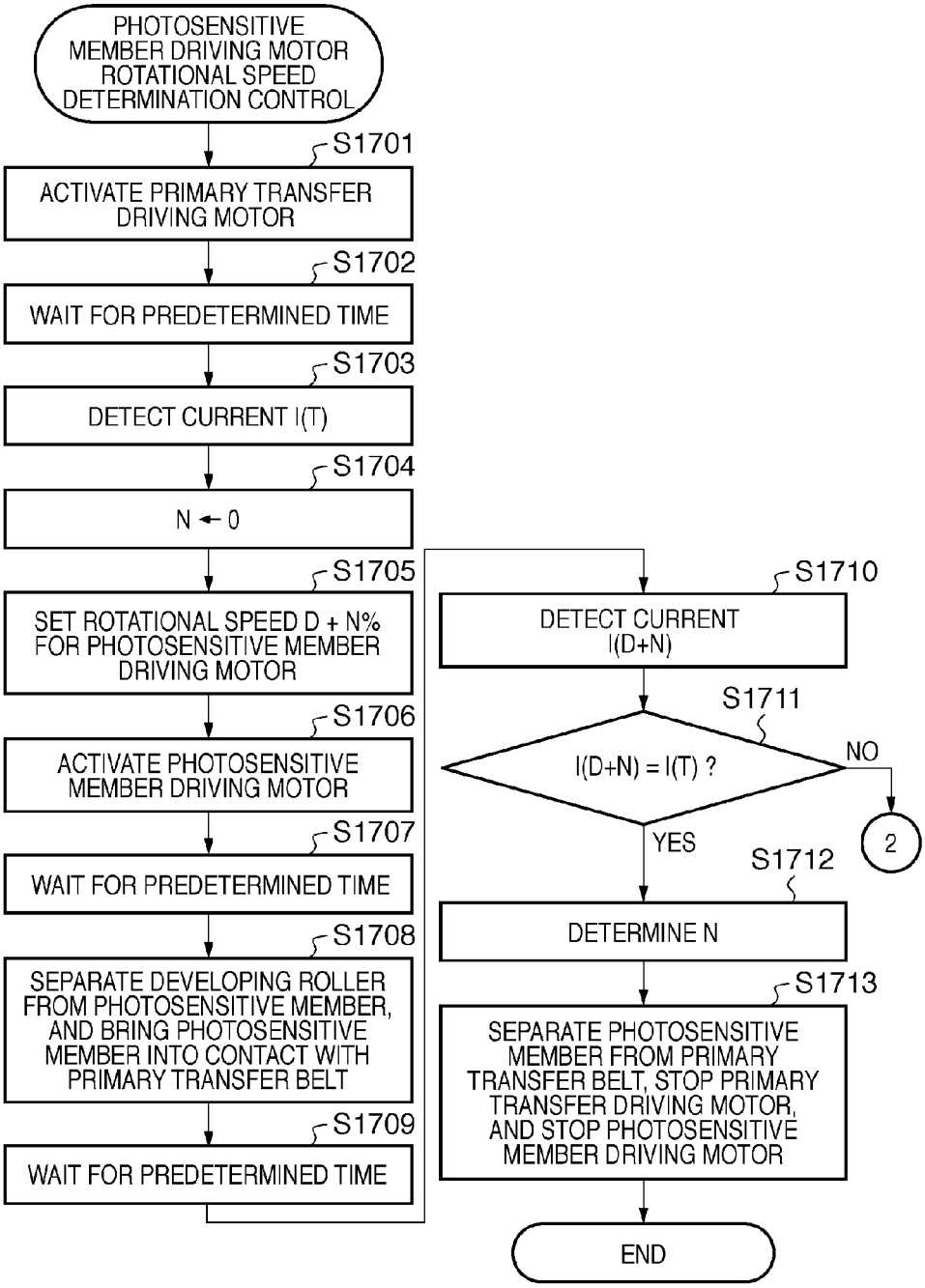
FIGS. 17A and 17B are flowcharts showing a control sequence executed by a CPU 200 according to the fifth embodiment.
Figure 17B:
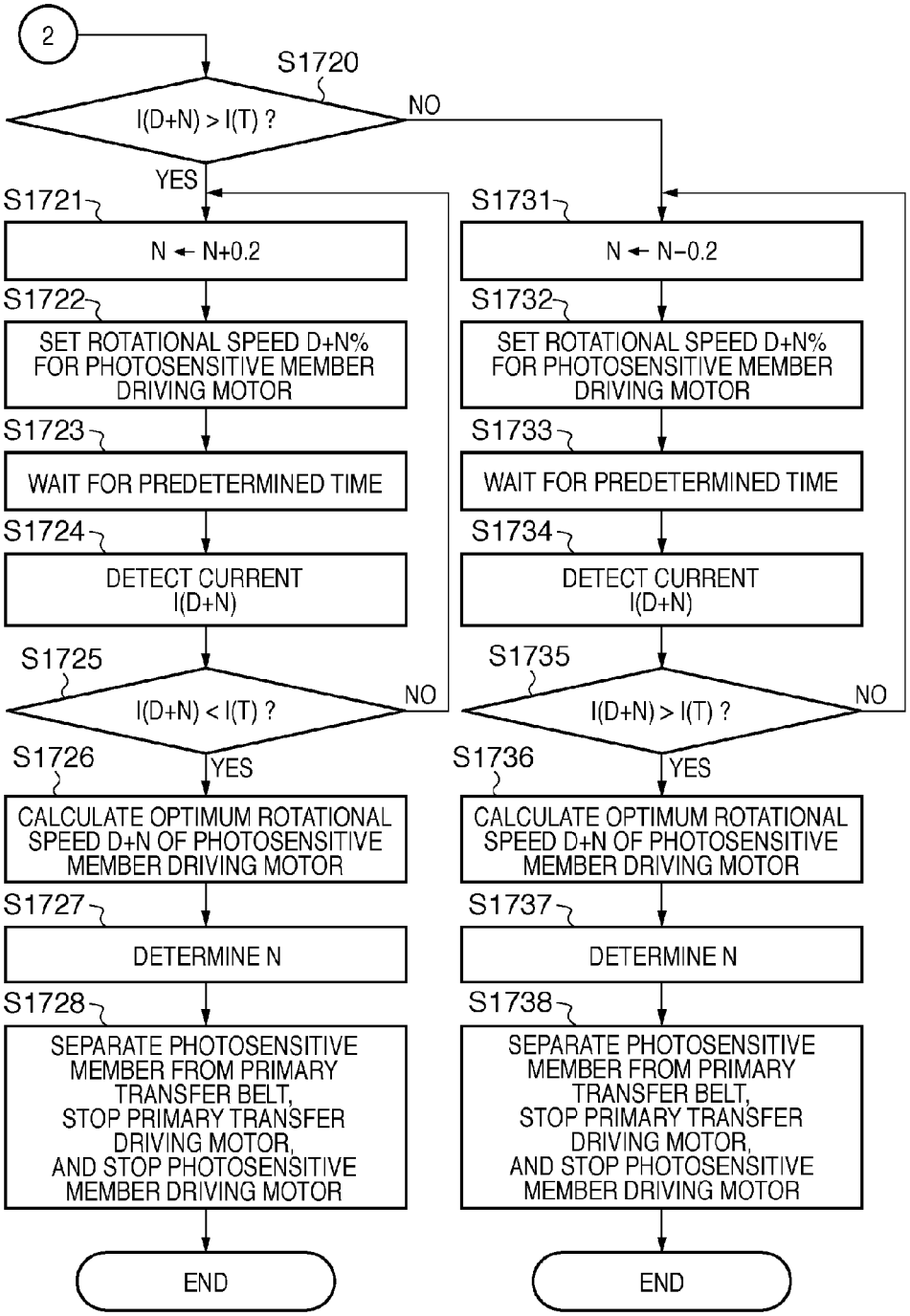

A control sequence executed by a CPU 200 according to the fifth embodiment of the present invention will be described with reference to FIGS. 17A and 17B. Upon turning on the image forming apparatus or receiving an instruction to execute the sequence, the CPU 200 starts the sequence in the separated state shown in FIG. 16A.

In S1701, the CPU 200 activates the primary transfer driving motor 201. In this case, the primary transfer driving motor 201 is activated by instructing a primary transfer driving motor control unit 202 to turn on the primary transfer driving motor. In S1702, the CPU 200 waits for a predetermined time until the rotational speed of the primary transfer driving motor 201 stabilizes. In S1703, the CPU 200 detects the current consumption value I(T) of the primary transfer driving motor 201. The current consumption value I(T) of the primary transfer driving motor 201 is averaged and amplified by a primary transfer driving motor current detection unit 203, and is input to an A/D converter 211 of the CPU 200. The CPU 200 recognizes the current consumption value I(T) of the primary transfer driving motor 201 as a digital value. The detected current consumption value I(T) of the primary transfer driving motor 201 is a current consumption value obtained when only a primary transfer unit 127 is driven. The current consumption value I(T) is an example of motor driving information obtained from the first driving motor by an obtaining unit upon rotating the first rotation member while the first and second rotation members are spaced apart from each other. The current consumption value I(T) is stored as reference motor driving information in the built-in memory of the CPU 200.

In S1704, the CPU 200 assigns "0" to the variable N. The variable N is used as the ratio to the reference rotational speed D of the photosensitive member driving motor 404. In S1705, the CPU 200 sets the photosensitive member driving motor rotational speed in a photosensitive member driving motor rotational speed setting unit 420. The set value is a rotational speed of D+N. At this time, N=0, so D+0% is set.

In S1706, the CPU 200 instructs a photosensitive member driving motor control unit 405 to turn on the photosensitive member driving motor in order to activate the photosensitive member driving motor 404. In S1707, the CPU 200 waits for a predetermined time until the photosensitive member driving motor 404 is activated and its rotational speed stabilizes.

In S1708, the CPU 200 controls the developing motor and eccentric cam to separate each developing sleeve 126 from a corresponding photosensitive member (FIG. 16C), and controls the primary transfer separation motor and eccentric cam to bring all the photosensitive members 122 into contact with the primary transfer belt 131. In S1709, the CPU 200 waits for a predetermined time until the rotational speeds of the photosensitive member driving motor 404 and primary transfer driving motor 201 stabilize. Each developing sleeve 126 may be separated from a corresponding photosensitive member in S1701.

In S1710, the CPU 200 detects the current consumption value I(D+0) of the primary transfer driving motor 201. In S1711, the CPU 200 compares the motor driving information obtained by the obtaining unit with the reference motor driving information stored in the memory. That is, the current consumption value I(D+0) of the primary transfer driving motor 201 in a state in which the photosensitive member 122 and primary transfer belt 131 are in contact with each other is compared with the current consumption value I(T) of the primary transfer driving motor 201 in a state in which the photosensitive member 122 and primary transfer belt 131 are spaced apart from each other. When I(D+0)=I(T), the speed difference between the photosensitive member 122 and the primary transfer belt 131 is small. In other words, the difference between the circumferential velocities of the first and second rotation members can be reduced. Hence, the process advances to S1712. Note that the condition to determine YES in S1711 by the CPU 200 is not limited to I(D+0)=I(T), and may be I(D+0)≈I(T). In this case, the CPU 200 determines YES in S1711 if the current consumption value I(D+0) falls within a predetermined range centered on the I(T) value.

In S1712, the CPU 200 determines N=0. In S1713, the CPU 200 stops the primary transfer driving motor 201 and photosensitive member driving motor 404. In the embodiment, the initial value of N is 0, but is not limited to this. When comparing the current consumption values I(D+0) and I(T) in S1711, a predetermined range may be given to I(T). Further, when determining N in S1712, a predetermined offset may be given to N to minimize color misregistration.

If I(D+0)≠I(T) in S1711, the process advances to S1720. In S1720, the CPU 200 compares I(D+0) and I(T). If I(D+0)>I(T), the process advances to S1721. In S1721, the CPU 200 sets N to N+0.2. Since the initial value of N is 0, N=N+0.2=0.2. In S1722, the CPU 200 sets the photosensitive member driving motor rotational speed in the photosensitive member driving motor rotational speed setting unit 420. In S1723, the CPU 200 waits for a predetermined time until the speed of the photosensitive member driving motor 404 changes and its rotational speed stabilizes. In S1724, the CPU 200 detects the current consumption value I(D+0.2) of the primary transfer driving motor 201. In S1725, the CPU 200 compares the current consumption value I(D+0.2) of the primary transfer driving motor 201 in a state in which the photosensitive member 122 and primary transfer belt 131 are in contact with each other, with the current consumption value I(T) of the primary transfer driving motor 201 in a state in which the photosensitive member 122 and primary transfer belt 131 are spaced apart from each other. If I(D+0.2)≥I(T), the process returns to S1721. The CPU 200 repeats S1721 to S1725 until I(D+N)<I(T) holds. If I(D+0.2)<I(T), the process advances to S1726.

In S1726, the CPU 200 calculates an optimum rotational speed D+N. In S1727, the CPU 200 determines an optimum N value from the optimum rotational speed D+N. The set information is stored in a nonvolatile memory or the like and used for subsequent image formation. This also applies to S212 and S237 described above. In S1728, the CPU 200 separates the photosensitive member 122 and primary transfer belt 131 from each other, stops the primary transfer driving motor 201 and photosensitive member driving motor 404, and ends the control.

If I(D+0)≤I(T) in S1720, the process advances to S1731. In S1731, the CPU 200 sets N to N−0.2. Processes in S1732 to S1738 are almost the same as those in S1722 to S1728 except that, if I(D+N)>I(T) in S1735, the process advances to S1736; if I(D+N)≤I(T), returns to S1731.

Figure 18A:
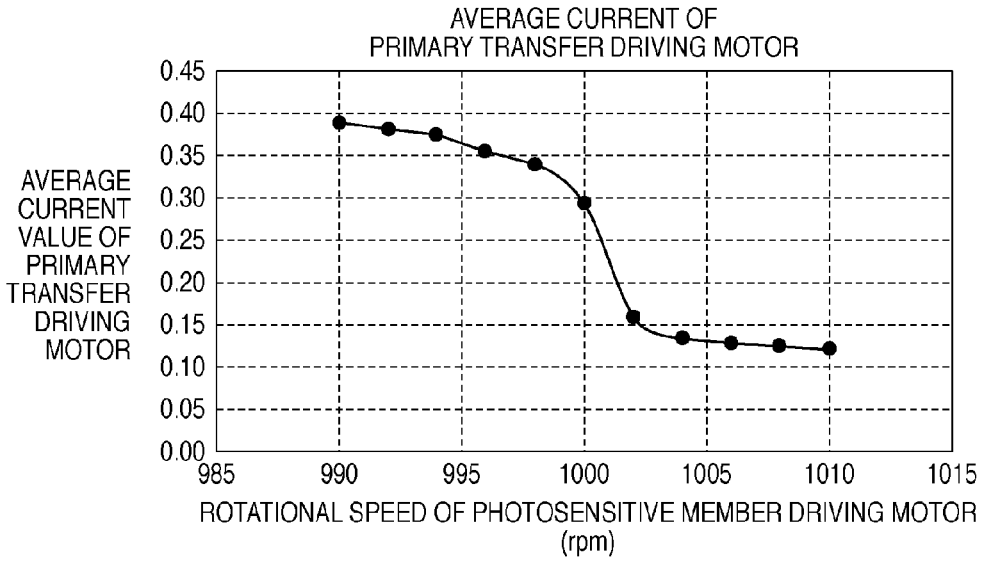
FIG. 18A is a graph showing a change of the current consumption of a primary transfer driving motor 201 when the rotational speed D of a photosensitive member driving motor 404 is set to 1,000 rpm and the variable N is changed from −1 to +1 in steps of 0.2.
Figure 18B:
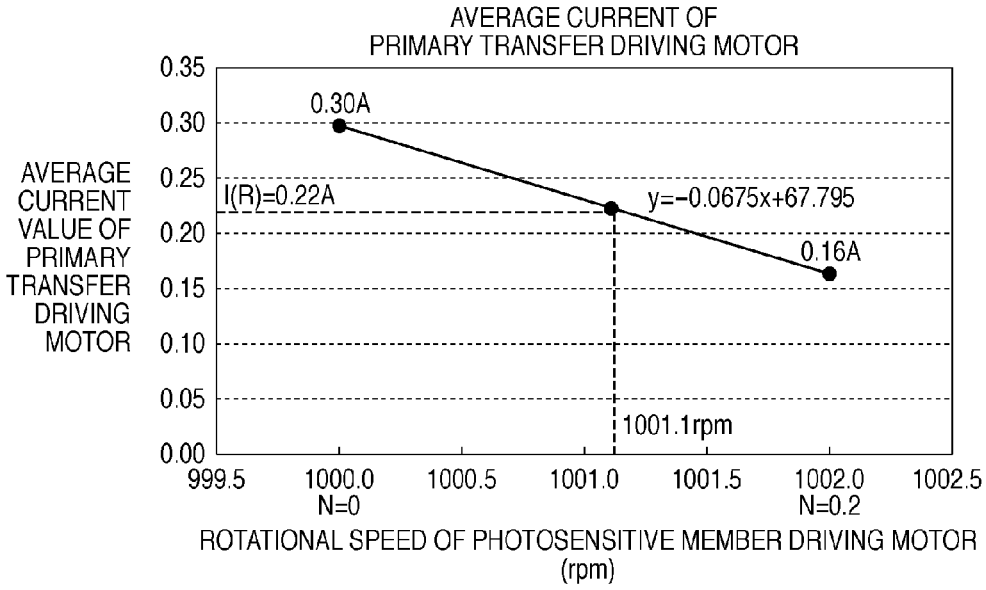
FIG. 18B is an enlarged graph of a section from N=0 to N=0.2 shown in FIG. 18A.

Finally, a method of calculating the optimum rotational speed D+N of the photosensitive member driving motor 404 in S1726 or S1736 will be explained with reference to FIGS. 18A and 18B. FIG. 18A is a graph showing a change of the current consumption of the primary transfer driving motor 201 when the rotational speed D of the photosensitive member driving motor 404 is set to 1,000 rpm and the variable N is changed from −1 to +1 in steps of 0.2. FIG. 18B is an enlarged graph of a section from N=0 to N=0.2 shown in FIG. 18A.

The current consumption value I(T) of the primary transfer driving motor 201 that is detected in S1703 in the separated state of FIG. 16A is 0.22 A. Further, the current consumption value I(D+0) of the primary transfer driving motor 201 that is detected in S1710 in a state in which the photosensitive member 122 having a rotational speed of D+0 and the primary transfer belt 131 are in contact with each other is 0.30 A. The current consumption value I(D+0.2) of the primary transfer driving motor 201 in a state in which the photosensitive member 122 having a rotational speed of D+0.2 and the primary transfer belt 131 are in contact with each other is 0.16 A. When the current value relationship between the rotational speeds of D+0 and D+0.2 is linearly approximated, and the current consumption value I(T)=0.22 A in the separated state is substituted, the rotational speed of the photosensitive member driving motor 404 is calculated to be 1001.1 rpm. That is, the optimum N value is 0.11. Even in this case, a predetermined offset may be given to minimize color misregistration.

As described above, the speed of the photosensitive member driving motor 404 is controlled so that the current consumption value of the primary transfer driving motor 201 in a state in which the photosensitive member 122 and primary transfer belt 131 are in contact with each other becomes equal to that of the primary transfer driving motor 201 in a state in which the photosensitive member 122 and primary transfer belt 131 are spaced apart from each other. Accordingly, the rotational speed of the photosensitive member driving motor 404 can be obtained, at which the influence of the primary transfer belt 131 and photosensitive member 122 on each other can be minimized. The obtained rotational speed of the photosensitive member driving motor 404 may be periodically updated or stored in a nonvolatile memory or the like.

In the fifth embodiment, similar to the above-described embodiments, the current value of the primary transfer driving motor 201 is detected to determine the rotational speed of the photosensitive member driving motor 404. However, the current value of the primary transfer driving motor 201 may be detected to determine the rotational speed of the primary transfer driving motor 201. If the photosensitive member driving motor 404 is a brushless motor, the current value of the photosensitive member driving motor 404 may be detected to determine the rotational speed of the primary transfer driving motor 201. The same effects can be obtained even by detecting the current value of the photosensitive member driving motor 404 and determining the rotational speed of the photosensitive member driving motor 404.

The fifth embodiment is effective even when a plurality of motors are arranged to drive the four photosensitive members 122 and the individual photosensitive member driving motors 404 drive all the photosensitive members 122 of respective colors. In this case, a plurality of photosensitive member driving motors 404 are regarded as one motor to set a uniform rotational speed.

The fifth embodiment is also effective when a plurality of motors are arranged to drive the four photosensitive members 122, and the photosensitive members 122 and primary transfer belt 131 can be brought into contact with each other or separated from each other individually for respective colors. In this case, the influence of the primary transfer belt 131 and photosensitive member 122 on each other can be further minimized by optimizing the rotational speeds of the photosensitive member driving motors for the respective colors and that of the primary transfer driving motor 201.

Sixth Embodiment

The fifth embodiment has described an invention in which the photosensitive member 122 and primary transfer belt 131 are spaced apart from each other and the current consumption value I(T) of the primary transfer driving motor 201 is employed as a reference. The sixth embodiment will describe an invention in which the current consumption value I(R) of a primary transfer driving motor 201 is detected in a state which a photosensitive member 122 is in contact with a primary transfer belt 131 and a developing sleeve 126 is in contact with the photosensitive member 122, as shown in FIG. 16B. The basic arrangement of an image forming apparatus is the same as that in the above-described embodiments. Thus, the same reference numerals as those in the above-described embodiments denote the same parts, and a description thereof will not be repeated.

In FIG. 16C, the developing sleeve 126 is spaced apart from the photosensitive member 122. Hence, if the photosensitive member 122 and primary transfer belt 131 have a speed difference upon driving them, a load generated by the speed difference greatly acts on the primary transfer belt 131. This is because no fog toner exists on the photosensitive member 122 and the frictional force between the photosensitive member 122 and the primary transfer belt 131 is large.

In FIG. 16B, the developing sleeve 126 is in contact with the photosensitive member 122. When the photosensitive member 122 and primary transfer belt 131 are driven in this state, a load generated by the speed difference from the photosensitive member 122 hardly acts on the primary transfer belt 131. This is because fog toner exists on the photosensitive member 122 and acts as a lubricant to decrease the frictional force between the photosensitive member 122 and the primary transfer belt 131. In the sixth embodiment, the speed of the photosensitive member driving motor 404 is controlled so that the current consumption of the primary transfer driving motor 201 in the state of FIG. 16C becomes equal or almost equal to the foregoing current consumption value I(R). This can further minimize the influence of the primary transfer belt 131 and photosensitive member 122 on each other.

A control sequence executed by a CPU 200 according to the sixth embodiment of the present invention will be described with reference to FIGS. 19A and 19B. The same reference symbols as those in FIGS. 17A and 17B denote the same processes to simplify the description. Upon turning on the image forming apparatus or receiving an instruction to execute the sequence, the CPU 200 separates the developing sleeve 126 from the photosensitive member 122 using a developing motor and eccentric cam. That is, S1701 and S1704 to S1706 are executed in the separated state shown in FIG. 16C. In this fashion, the CPU 200 separates the developing sleeve 126 from the photosensitive member 122 when obtaining motor driving information by an obtaining unit.

In S1901, the CPU 200 moves the developing sleeve 126 toward the photosensitive member 122 using the developing motor and eccentric cam. Then, the photosensitive member 122 and developing sleeve 126 come into contact with each other. All the photosensitive members 122 come into contact with the primary transfer belt 131, as represented by the state of FIG. 16B. Thereafter, the CPU 200 executes S1707, and the process advances to S1902. In S1902, the CPU 200 detects the current consumption value I(R) of the primary transfer driving motor 201. The detected current consumption value I(R) of the primary transfer driving motor 201 is a current consumption value obtained when a load generated by the speed difference from the photosensitive member 122 hardly acts on the primary transfer belt 131. This is because fog toner serving as a lubricant exists on the photosensitive member 122 to decrease the frictional force between the photosensitive member 122 and the primary transfer belt 131. Thus, the current consumption value I(R) becomes equal to the current consumption value I(T) detected in S1703 of FIG. 17A.

In S1903, the CPU 200 separates all the photosensitive members 122 and developing sleeves 126 from each other. The CPU 200 then executes S1709 to S1738. However, in FIGS. 19A and 19B, I(R) replaces I(T) in FIGS. 17A and 17B.

Figure 19A:
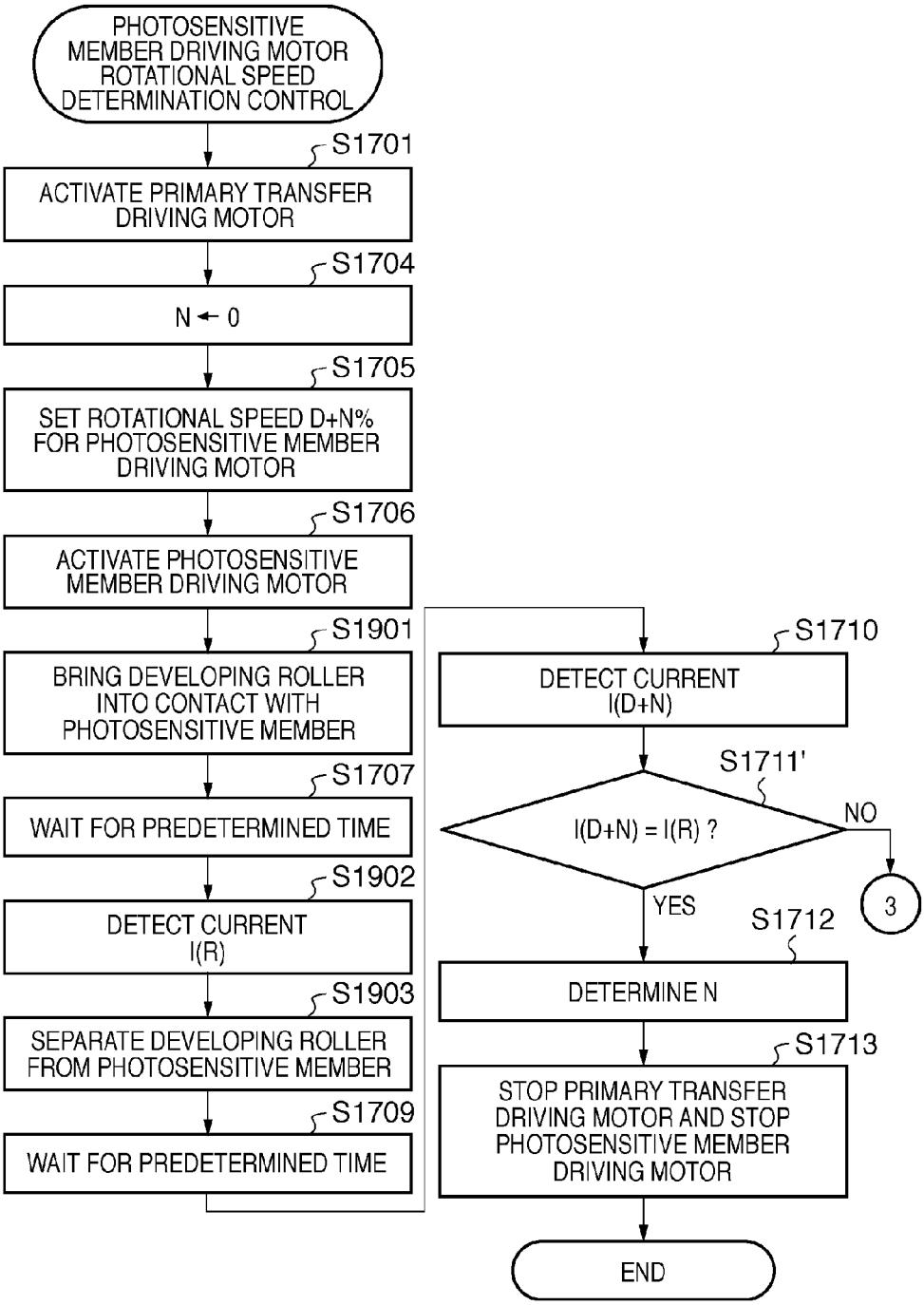
FIGS. 19A and 19B are flowcharts showing a control sequence executed by a CPU 200 according to the sixth embodiment.
Figure 19B:
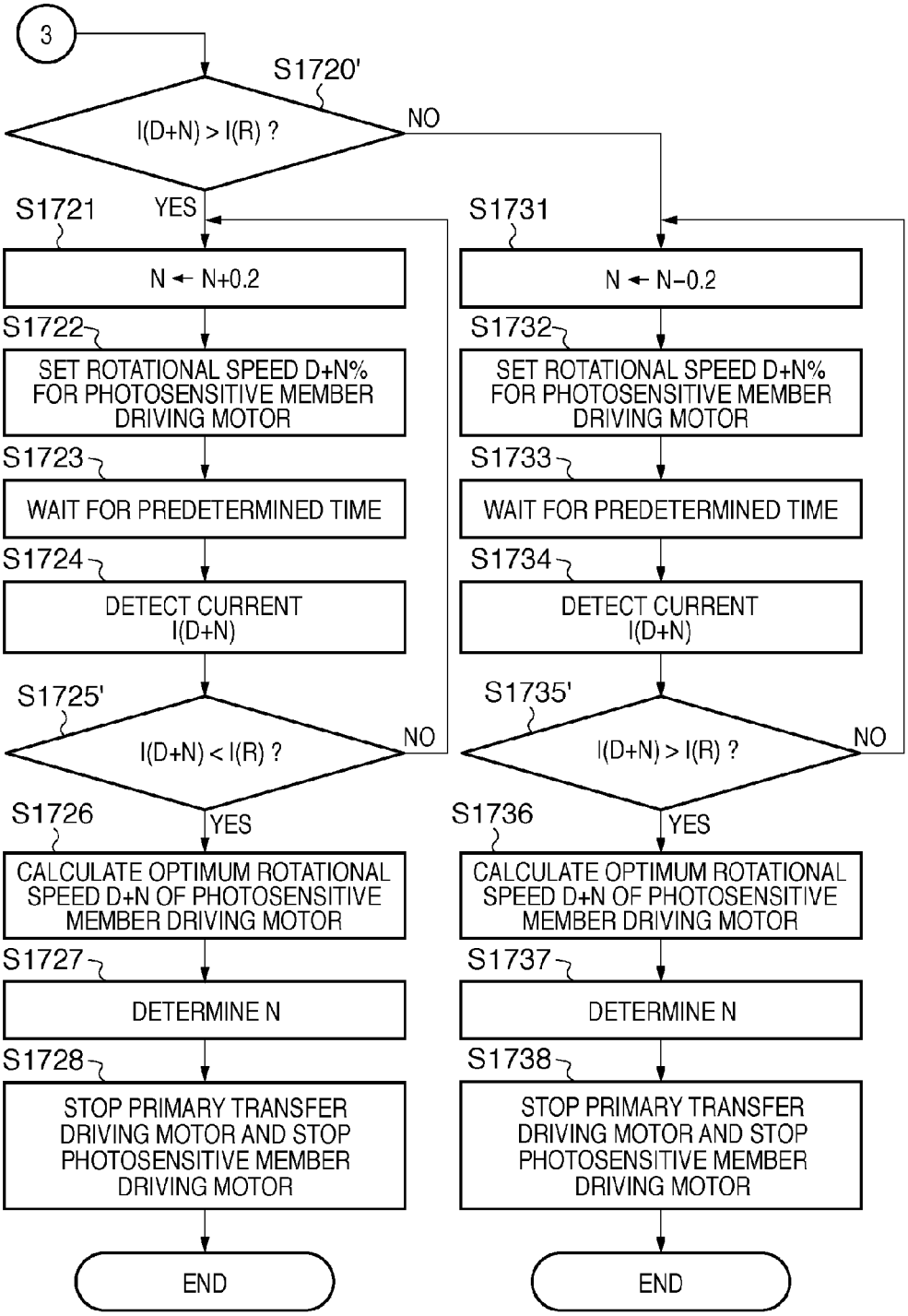

To clarify this, a sign ' is added in FIGS. 19A and 19B, like S1711', S1720', S1725', and S1735'.

In this manner, the current consumption I(D+N) of the primary transfer driving motor 201 is detected in a state in which the photosensitive member 122 and developing sleeve 126 are spaced apart from each other. The speed of the photosensitive member driving motor 404 is controlled so that the detected current consumption I(D+N) becomes equal to the current consumption I(R) of the primary transfer driving motor 201 in a state in which the photosensitive member 122 and primary transfer belt 131 are in contact with each other and the developing sleeve 126 is in contact with the photosensitive member 122. The sixth embodiment can therefore obtain the same effects as those in the fourth and fifth embodiments. Note that modifications of the sixth embodiment are the same as those of the fourth and fifth embodiments, and a description thereof will not be repeated.

Seventh Embodiment

In the first to sixth embodiments, control is done based on the value of a current supplied to the motor as motor driving information indicating the driving state of the motor. Instead, control may be executed based on a voltage value. In general, a current value can be converted into a voltage value by supplying a current to a detection resistor. Also, the current value may be replaced with another information as long as the information corresponds to the value of a current supplied to the motor. For example, the current value may be replaced with a driving signal (speed control signal such as an ACC signal or DEC signal in FIG. 3) output in correspondence with the value of a current supplied to the motor.

The above-described embodiments have described a form in which either motor is finally controlled, for example, the rotational speed of the secondary transfer driving motor 204 is controlled or in the fourth embodiment, that of the photosensitive member driving motor 404 is controlled. However, the present invention is not limited to this form. This is because the present invention suffices to satisfactorily reduce the circumferential speed difference between two rotation members in contact with each other. That is, this purpose can be achieved even by adjusting the rotational speed of only one driving motor or adjusting those of both of the driving motors. For example, in S1414 of the fourth embodiment, (D+0.1%) is set as the target rotational speed of the photosensitive member driving motor 404 in image formation. However, it is also possible to, for example, obtain the relative speeds of the primary transfer belt 131 and photosensitive member 122 when the target rotational speed of the photosensitive member driving motor 404 is set to (D+0.05%) and the rotational speed of the primary transfer driving motor 201 is set to T1(D+0.1%). For example, it suffices to set (T1−0.05%) as the speed T1. The same effects can be obtained even by controlling the rotational speed of at least one rotation member in image formation out of two rotation members in contact with each other.

Eighth Embodiment

Figure 21A:
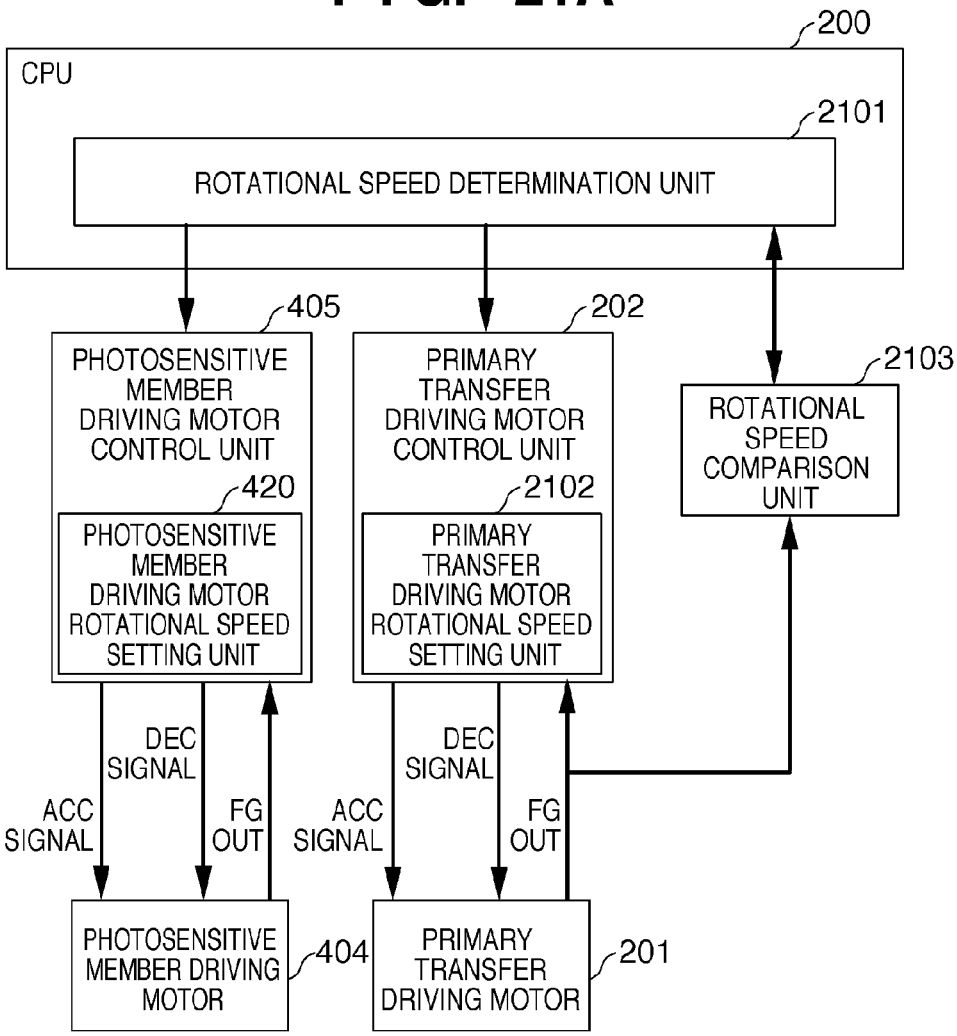
FIG. 21A is a block diagram showing a control circuit which controls a photosensitive member driving motor and primary transfer driving motor.

The eighth embodiment will explain a concrete modification of motor driving information described in the seventh embodiment. More specifically, a part concerning driving control of a primary transfer driving motor 201 (intermediate transfer belt motor) and photosensitive member driving motor 404 (photosensitive drum motor) will be described with reference to FIG. 21A. The same reference numerals as those in any of the above embodiments denote the same parts. The basic arrangement of an image forming apparatus is the same as those in the above embodiments, and a description thereof will not be repeated.

A CPU 200 sets a predetermined rotational speed in a primary transfer driving motor rotational speed setting unit 2102 (intermediate transfer belt motor rotational speed setting unit). A primary transfer driving motor control unit 202 (intermediate transfer belt motor driving control unit) controls driving of the primary transfer driving motor 201 based on the predetermined rotational speed set in the primary transfer driving motor rotational speed setting unit 2102, and a speed signal FGOUT from the primary transfer driving motor 201. More specifically, the primary transfer driving motor control unit 202 adjusts the speed of the primary transfer driving motor 201 using an ACC signal serving as an acceleration signal and a DEC signal serving as a deceleration signal. As for the photosensitive member driving motor 404, the CPU 200 sets a predetermined rotational speed in a photosensitive member driving motor rotational speed setting unit 420 (photosensitive drum motor rotational speed setting unit). A photosensitive member driving motor control unit 405 (photosensitive drum motor driving control unit) controls driving of the photosensitive member driving motor 404 based on the predetermined rotational speed set in the photosensitive member driving motor rotational speed setting unit 420, and the speed signal FGOUT from the photosensitive member driving motor 404. More specifically, the photosensitive member driving motor control unit 405 controls the driving using the ACC signal and DEC signal.

Figure 21B:
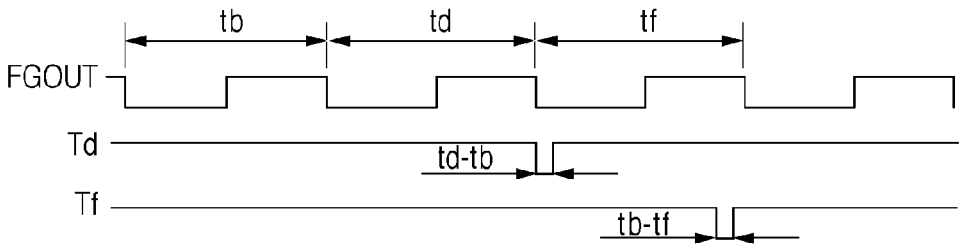
FIG. 21B is a chart showing the relationship between the signal FGOUT, the delay time Td, and the lead time Tf.

A rotational speed comparison unit 2103 will be described in detail with reference FIG. 21B. The rotational speed comparison unit 2103 measures the time of one cycle of the speed signal FGOUT of the primary transfer driving motor 201. Then, the rotational speed comparison unit 2103 compares the measured time with a reference time tb set in advance by the CPU 200. If td is longer than tb, the rotational speed of the motor is low. If tf is longer than tb, the rotational speed of the motor is high. When the rotational speed of the motor is low, a value td−tb is calculated as a delay time Td. When the rotational speed of the motor is high, a value tb−tf is calculated as a lead time Tf. The delay time Td corresponds to output of the ACC signal serving as an acceleration signal. That is, a longer delay time Td means a larger output count/longer output time of the ACC signal. In this way, the delay time Td indirectly represents the degree of output of the ACC signal. The lead time Tf corresponds to output of the DEC signal serving as a deceleration signal. A longer lead time Tf means a larger output count/longer output time of the DEC signal. In other words, the lead time Tf indirectly represents the degree of output of the DEC signal.

Further, the rotational speed comparison unit 2103 has a function of accumulating the delay time Td and lead time Tf of the rotational speed of the motor in a predetermined time Δt. The CPU 200 obtains information about the cumulative times ΣTd and ΣTf, use it for calculation, and can evaluate a change of the speed. Since speed control is done in response to a change of the speed, evaluating a change of the speed is evaluating the executed speed control. The eighth embodiment uses FGOUT (so-called FG signal) as the speed signal of the primary transfer driving motor 201, but may adopt a speed signal output from an optical or magnetic encoder. The rotational speed comparison unit 2103 may be built in the CPU 200.

Figure 22A:
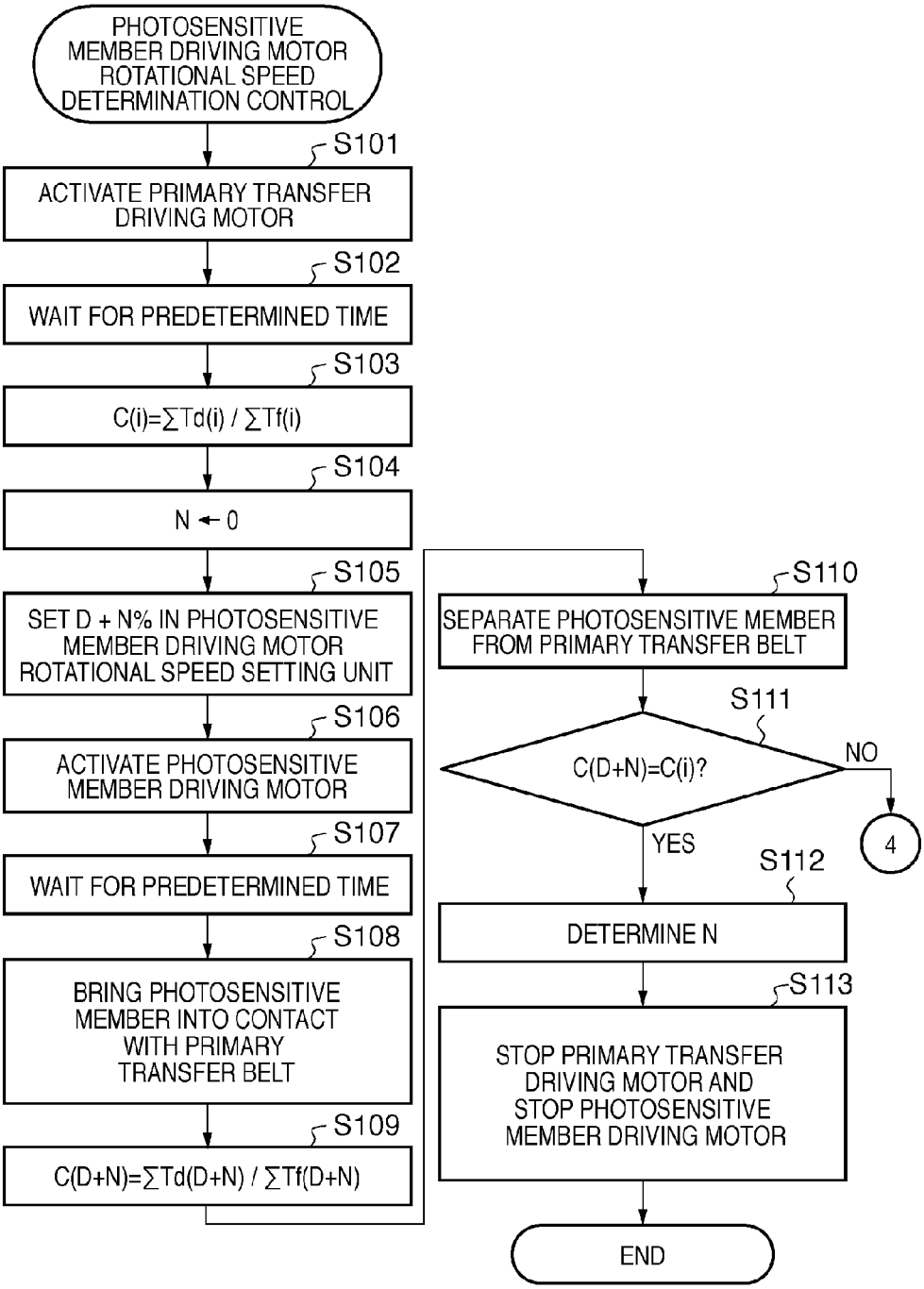
FIGS. 22A and 22B are flowcharts showing a control sequence executed by a CPU 200 according to the eighth embodiment.
Figure 22B:
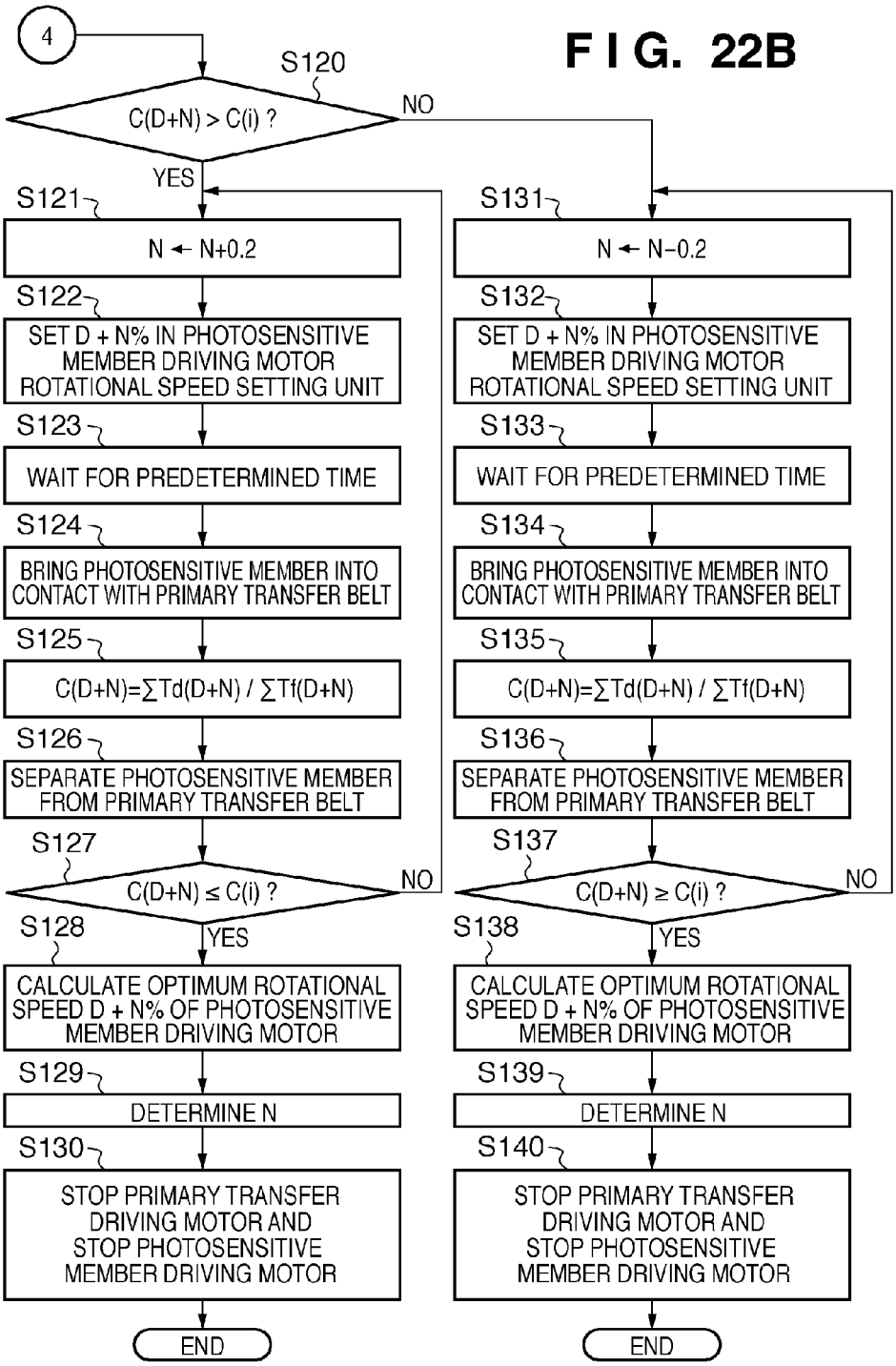

FIGS. 22A and 22B are flowcharts showing a control sequence executed by the CPU 200. Upon turning on the image forming apparatus or receiving an instruction to execute the sequence in response to input of a print job, the CPU 200 activates the primary transfer driving motor 201 while a primary transfer belt 131 (intermediate transfer belt) and a photosensitive member 122 (photosensitive drum) are completely spaced apart from each other (S101). Then, the CPU 200 performs processes in S102 to S109. These processes correspond to S1701 to S1710 in the flowchart of FIG. 17A described above. The sequence of FIGS. 22A and 22B is different from that of FIG. 17A in detailed processing contents of S103 and S109 and in that wait processing in S1709 is omitted from FIG. 22A. Details of S103 and S109 will be explained.

In S103, the CPU 200 measures the delay time Td and lead time Tf of the rotational speed of the primary transfer driving motor 201 in the predetermined time Δt. Further, the CPU 200 calculates the cumulative values of the delay time Td and lead time Tf as ΣTd(i) and ΣTf(i), and the speed variation ratio of them as C(i)=ΣTd(i)/ΣTf(i). ΣTd(i) and ΣTf(i) measured in S103 are obtained when only the primary transfer belt 131 is driven. The CPU 200 assigns 0 to the variable N (S104). The variable N is used as the ratio to the reference rotational speed D of the photosensitive member driving motor 404.

In S109, the CPU 200 measures the delay time Td and lead time Tf of the rotational speed of the primary transfer driving motor 201 in the predetermined time Δt. The CPU 200 calculates the cumulative values of the delay time Td and lead time Tf as ΣTd(D+0) and ΣTf(D+0), and the speed variation ratio of them as C(D+0)=ΣTd(D+0)/ΣTf(D+0).

In S110, the CPU 200 executes control to separate the primary transfer belt 131 and photosensitive member 122 from each other. The CPU 200 compares the speed variation ratio C(i) of the primary transfer driving motor 201 in this state with the speed variation ratio C(D+0) of the primary transfer driving motor 201 when the primary transfer belt 131 is brought into contact with the photosensitive member 122 (S111).

If C(D+0)=C(i), the speed difference between the primary transfer belt 131 and the photosensitive member 122 is small, and thus the CPU 200 determines N=0 in S112. In S113, the CPU 200 stops the primary transfer driving motor 201 and photosensitive member driving motor 404, and ends the control. In the embodiment, the initial value of N is 0, but is not limited to this. In S111, a predetermined range may be given to the speed variation ratio C(i) of the primary transfer driving motor 201 in a state in which the primary transfer belt 131 is spaced apart from the photosensitive member 122. Further, when determining N in S112, a predetermined offset may be given to N to minimize color misregistration.

If C(D+0)≠C(i) as a result of comparison in S111, the CPU 200 compares C(D+0) and C(i) in S120. If C(D+0)>C(i), the CPU 200 sets N to N+0.2 in S121. Then, the CPU 200 sets the rotational speed of the photosensitive member driving motor 404 in the photosensitive member driving motor rotational speed setting unit 420 (S122). The speed of the photosensitive member driving motor 404 changes in accordance with the setting of S122, and the CPU 200 waits for a predetermined time until the rotational speed stabilizes (S123).

In S124, the CPU 200 brings the primary transfer belt 131 and photosensitive member 122 into complete contact with each other. The CPU 200 measures the delay time Td and lead time Tf of the rotational speed of the primary transfer driving motor 201 in the predetermined time Δt including the moment of the contact. The CPU 200 calculates the cumulative values of the delay time Td and lead time Tf as ΣTd(D+0.2) and ΣTf(D+0.2), and the speed variation ratio of them as C(D+0.2)=ΣTd(D+0.2)/ΣTf(D+0.2) (S125).

In S126, the CPU 200 separates the primary transfer belt 131 and photosensitive member 122 from each other. The CPU 200 compares the speed variation ratio C(i) of the primary transfer driving motor 201 in this state with the speed variation ratio C(D+0.2) of the primary transfer driving motor 201 when the primary transfer belt 131 is brought into contact with the photosensitive member 122 (S127).

If C(D+0.2)>C(i), the CPU 200 shifts the process to S121 and repeats the same processes until C(D+N)≤C(i). If C(D+0.2)≤C(i), the CPU 200 calculates an optimum rotational speed D+N of the photosensitive member driving motor 404 in S128, and determines an optimum N value in S129. In S130, the CPU 200 stops the primary transfer driving motor 201 and photosensitive member driving motor 404, and ends the control. Also when C(D+0)≤C(i) as a result of comparing C(D+0) and C(i) in S120, the CPU 200 performs the same operation except that it sets N to N−0.2 in S131, so a description thereof will not be repeated.

Figure 23A:
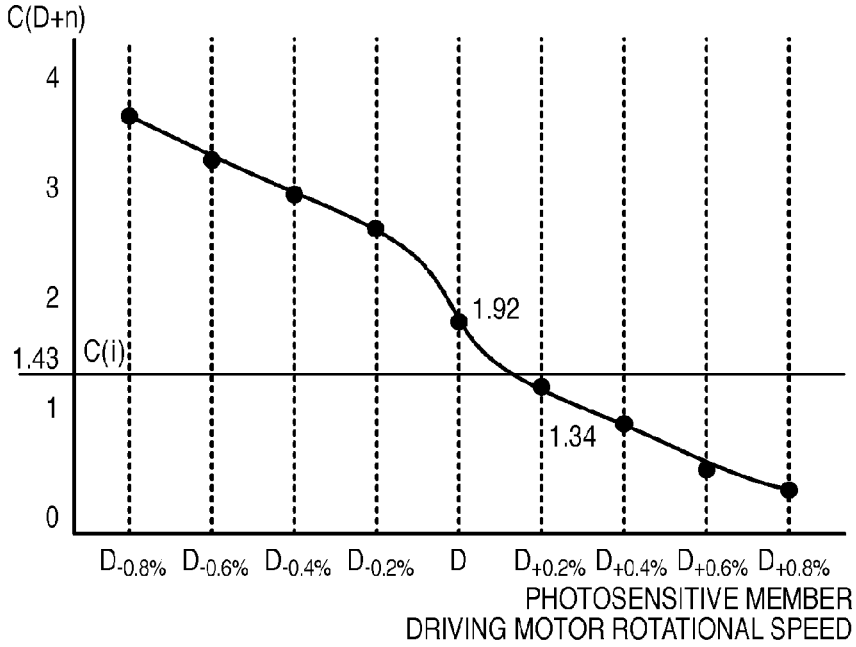
FIGS. 23A and 23B are graphs showing the relationship between the rotational speed of the photosensitive member driving motor and the speed variation ratio.
Figure 23B:
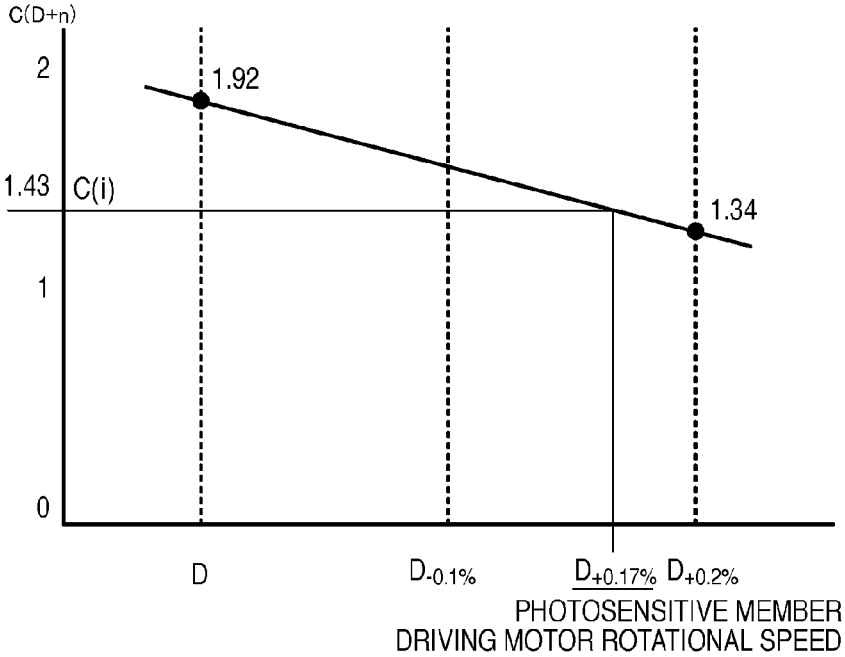

Next, a method of calculating the optimum rotational speed D+N of the photosensitive member driving motor 404 in S128 and S138 will be explained with reference to FIGS. 23A and 23B. In the following description, calculation by the CPU 200 will be explained. FIG. 23A is a graph showing a change of the speed variation ratio C(D+N) of the primary transfer driving motor 201 when the variable N is changed from −0.8% to +0.8% in steps of 0.2% with respect to the reference rotational speed D of the photosensitive member driving motor 404. FIG. 23B is an enlarged graph of a section from N=0 to N=0.2 in FIG. 23A.

The speed variation ratio C(i) of the primary transfer driving motor 201 that is detected in S103 in a state (state of FIG. 16A) in which the primary transfer belt 131 and photosensitive member 122 are completely spaced apart from each other is 1.43. Further, the speed variation ratio C(D+0) of the primary transfer driving motor 201 that is detected in S109 when the primary transfer belt 131 is brought into contact with the photosensitive member 122 having a rotational speed of D+0 is 1.92. The speed variation ratio C(D+0) of the primary transfer driving motor 201 that is detected in S125 when the primary transfer belt 131 is brought into contact with the photosensitive member 122 having a rotational speed of D+0.2 is 1.34. The CPU 200 linearly approximates the relationship between the speed variation ratios C(D+N) of the primary transfer driving motor 201 at the rotational speeds of D+0 and D+0.2. The CPU 200 substitutes the speed variation ratio C(i)=1.43 into the obtained linear function, obtaining N=0.17 as the optimum rotational speed N of the photosensitive member driving motor 404. Even in this case, a predetermined offset may be given to minimize color misregistration.

As described above, the rotational speed of the photosensitive member driving motor 404 is obtained so that the speed variation ratio of the primary transfer driving motor 201 when the primary transfer belt 131 and photosensitive member 122 are brought into contact with each other becomes equal to that of the primary transfer driving motor 201 in a state in which the primary transfer belt 131 and photosensitive member 122 are spaced apart from each other. This can at least suppress the influence of the primary transfer belt 131 and photosensitive member 122 on each other. The obtained rotational speed of the photosensitive member driving motor 404 may be periodically updated or stored in a nonvolatile memory or the like. A certain effect can be attained even when the rotational speed of the photosensitive member driving motor 404 is obtained so that the speed variation ratio of the primary transfer driving motor 201 when the primary transfer belt 131 and photosensitive member 122 are brought into contact with each other becomes not equal but almost equal to that of the primary transfer driving motor 201 in a state in which the primary transfer belt 131 and photosensitive member 122 are spaced apart from each other.

In the eighth embodiment, the speed variation ratio of the primary transfer driving motor 201 is detected to determine the rotational speed of the photosensitive member driving motor 404. Instead, the speed variation ratio of the primary transfer driving motor 201 may be detected to determine the rotational speed of the primary transfer driving motor 201. Further, the speed variation ratio of the photosensitive member driving motor 404 may be detected to determine the rotational speed of the primary transfer driving motor 201. The same effects can be obtained even by detecting the speed variation ratio of the photosensitive member driving motor 404 and determining the rotational speed of the photosensitive member driving motor 404. That is, the eighth embodiment is applicable to two rotation members (first and second rotation members) which can take contact and separated states.

Even when a plurality of motors are arranged to drive the four photosensitive members 122, and individual photosensitive member driving motors 404 drive all the photosensitive members 122 of respective colors, the plurality of photosensitive member driving motors 404 may be regarded as one motor to set a uniform rotational speed. Further, when a plurality of motors are arranged to drive the four photosensitive members 122, and the primary transfer belt 131 and photosensitive member 122 can be brought into contact with or separated from each other individually for each color, the rotational speeds of the photosensitive member driving motor 404 and primary transfer driving motor 201 of each color can be optimized.

In the eighth embodiment, the motor speed signal is used for evaluation, so none of a dedicated sensor and the like need be arranged to evaluate the relative speeds of the motors, which is advantageous to cost.

Ninth Embodiment

The ninth embodiment will also explain a concrete modification of motor driving information described in the seventh embodiment. The ninth embodiment will describe a form in which toner is caused to enter a nip formed by bringing two rotation members (first and second rotation members) into contact with each other, and at this time, reference motor driving information is acquired. More specifically, when detecting the speed variation ratio of a primary transfer driving motor 201, the speed of a photosensitive member driving motor 404 is appropriately set by bringing a developing sleeve 126 (developing roller 126) into contact with a photosensitive member 122 and separating it from the photosensitive member 122. This can further suppress the influence of a primary transfer belt 131 and the photosensitive member 122 on each other. The basic arrangement of an image forming apparatus is the same as that in the above-described embodiments, and a description thereof will not be repeated.

Figure 24A:
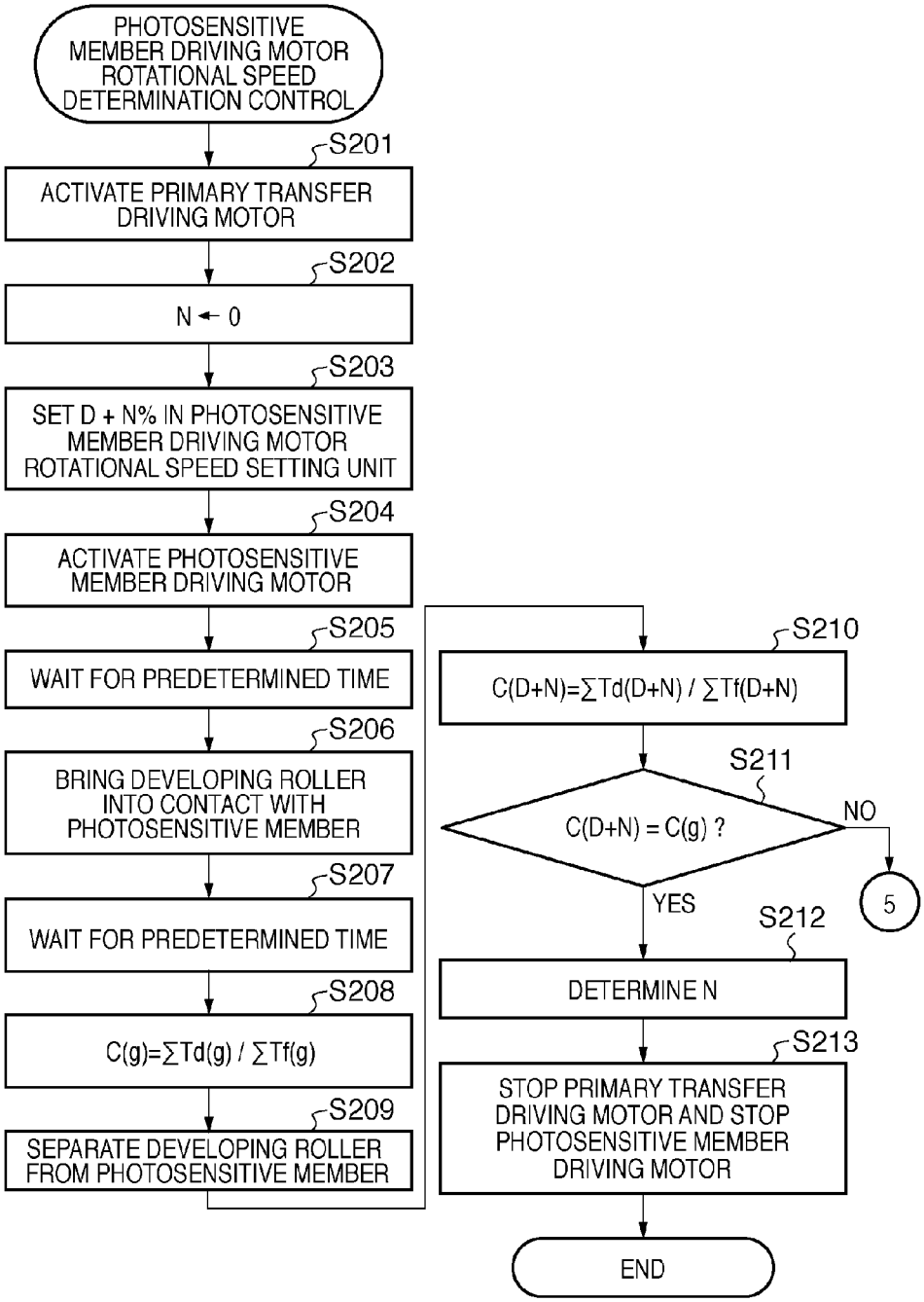
FIGS. 24A and 24B are flowcharts showing a control sequence executed by a CPU 200 according to the ninth embodiment.
Figure 24B:
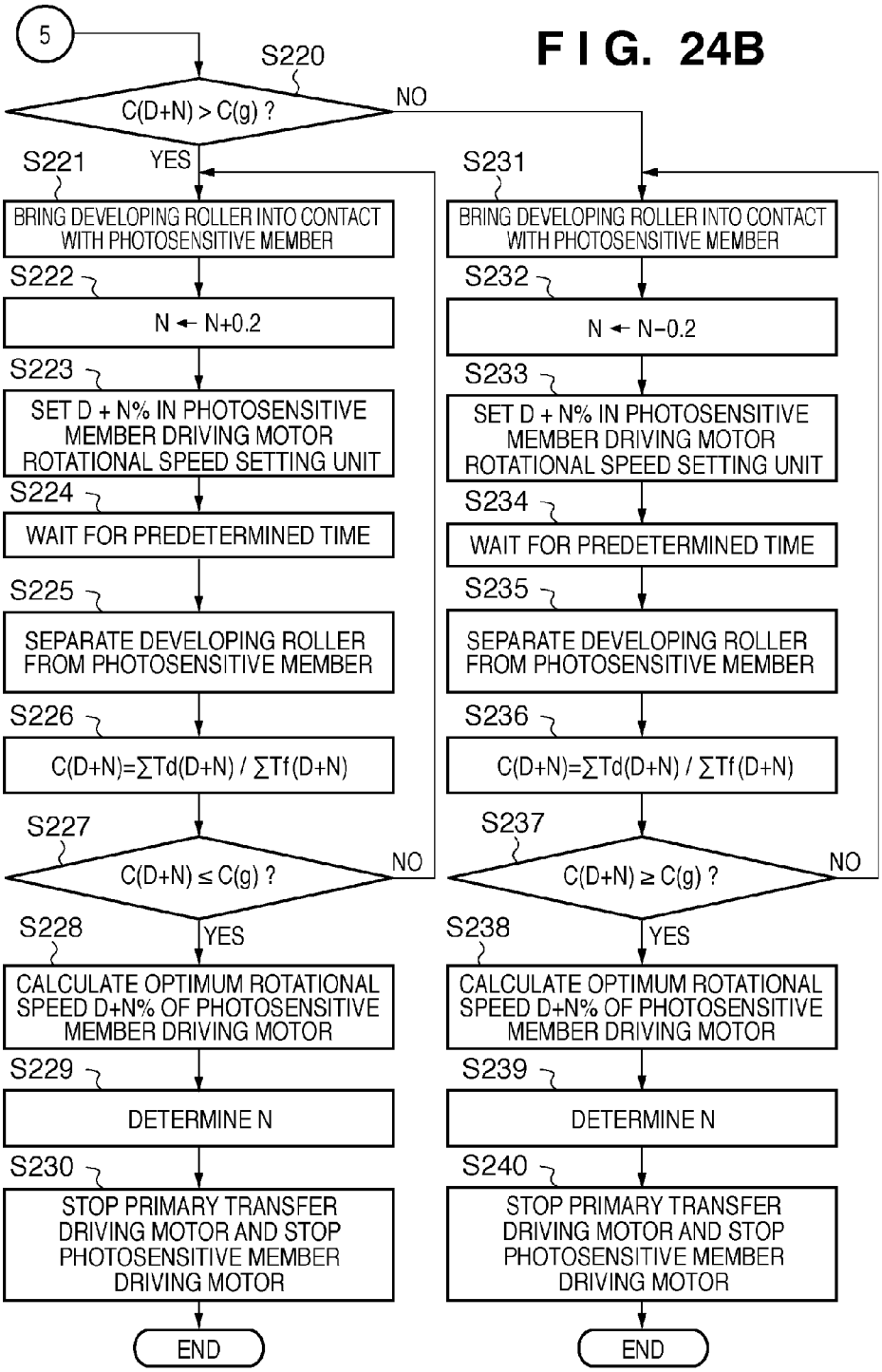

FIGS. 24A and 24B are flowcharts showing a control sequence executed by a CPU 200. Upon turning on the image forming apparatus or receiving an instruction to execute the sequence, the CPU 200 performs processes in S201 to S210. In these steps, the CPU 200 executes the same processes as those in S1701 to S1710 in the flowchart of FIG. 19A described above. However, the sequence of FIGS. 24A and 24B is different from that of FIG. 19A in that the CPU 200 waits before S206, and in detailed processing contents of S208 and S210. These differences will be explained in detail.

In S208, the CPU 200 measures the delay time Td and lead time Tf of the rotational speed of the primary transfer driving motor 201 in the predetermined time Δt. The CPU 200 calculates the cumulative values of the delay time Td and lead time Tf as ΣTd(g) and ΣTf(g), and the speed variation ratio of them as C(g)=ΣTd(g)/ΣTf(g). The detected speed variation ratio C(g) of the primary transfer driving motor 201 is one obtained when fog toner is applied as a lubricant on the photosensitive member 122 and decreases the frictional force between the primary transfer belt 131 and the photosensitive member 122. Hence, the detected speed variation ratio C(g) of the primary transfer driving motor 201 can be regarded as one obtained when a load arising from the speed difference from the photosensitive member 122 does not act on the primary transfer belt 131. In S210, the CPU 200 measures the delay time Td and lead time Tf of the rotational speed of the primary transfer driving motor 201 in the predetermined time Δt. The CPU 200 calculates the cumulative values of the delay time Td and lead time Tf as ΣTd(D+0) and ΣTf(D+0), and the speed variation ratio of them as C(D+0)=ΣTd(D+0)/ΣTf(D+0).

In S211, the CPU 200 compares the speed variation ratio C(g) of the primary transfer driving motor 201 in a state in which the developing sleeve 126 is in contact with the photosensitive member 122, with the speed variation ratio C(D+0) of the primary transfer driving motor 201 when the developing sleeve 126 is separated from the photosensitive member 122. If C(D+0)=C(g), the speed difference between the primary transfer belt 131 and the photosensitive member 122 is small, so the CPU 200 determines N=0 in S212. In S213, the CPU 200 stops the primary transfer driving motor 201 and photosensitive member driving motor 404, and ends the control. In the embodiment, the initial value of N is 0, but is not limited to this. A predetermined range may be given to C(g) when comparing in S211 the speed variation ratio C(g) of the primary transfer driving motor 201 in a state in which the developing sleeve 126 is in contact with the photosensitive drum, with the speed variation ratio C(D+0) of the primary transfer driving motor 201 when the developing sleeve 126 is separated from the photosensitive drum. Also, when determining N in S212, a predetermined offset may be given to N to minimize color misregistration.

If C(D+0)≠C(g) as a result of comparison in S211, the CPU 200 compares C(D+0) and C(g) in S220.

If C(D+0)>C(g), the secondary transfer driving motor rotational speed setting unit 220 performs processes in S221 to S226. The processes in S221 to S226 are modifications of the processes in S1721 to S1728 of FIG. 19. After bringing the developing sleeve 126 into contact with the photosensitive member 122 (S221), the CPU 200 sets N to N+0.2 in S222. Then, the CPU 200 sets the rotational speed of the photosensitive member driving motor 404 in a photosensitive member driving motor rotational speed setting unit 420 (S223). The speed of the photosensitive member driving motor 404 changes in accordance with the setting of S223, and the CPU 200 waits for a predetermined time until the rotational speed stabilizes (S224). In S225, the CPU 200 completely separates the developing sleeve 126 from the photosensitive member 122. The CPU 200 measures the delay time Td and lead time Tf of the rotational speed of the primary transfer driving motor 201 in the predetermined time Δt including the moment of the separation. The CPU 200 calculates the cumulative values of the delay time Td and lead time Tf as ΣTd(D+0.2) and ΣTf(D+0.2), and the speed variation ratio of them as C(D+0.2)=ΣTd(D+0.2)/ΣTf(D+0.2) (S226).

Thereafter, the CPU 200 compares the speed variation ratio C(g) of the primary transfer driving motor 201 in a state in which the developing sleeve 126 is in contact with the primary transfer belt 131, with the speed variation ratio C(D+0.2) of the primary transfer driving motor 201 when the primary transfer belt 131 is separated from the photosensitive member 122 (S227). If C(D+0.2)>C(g), the CPU 200 shifts the process to S221 and repeats the same processes until C(D+N)≤C(g). If C(D+0.2)≤C(g), the CPU 200 calculates an optimum rotational speed D+N of the photosensitive member driving motor 404 in S228, and determines an optimum N value in S229. In S230, the CPU 200 stops the primary transfer driving motor 201 and photosensitive member driving motor 404, and ends the control. Also when C(D+0)≤C(g) as a result of comparing C(D+0) and C(g) in S220, the CPU 200 performs the same operation except that it sets N to N−0.2 in S231, so a description thereof will not be repeated. The method of calculating the optimum rotational speed D+N of the photosensitive member driving motor 404 in S228 and S238 is also the same as that described in the eighth embodiment, and a description thereof will not be repeated.

As described above, the rotational speed of the photosensitive member driving motor 404 is obtained so that the speed variation ratio of the primary transfer driving motor 201 in a state in which the developing sleeve 126 and photosensitive member 122 are spaced apart from each other becomes equal to that of the primary transfer driving motor 201 in a state in which the developing sleeve 126 and photosensitive member 122 are in contact with each other. This can minimize the influence of the developing sleeve 126 and photosensitive member 122 on each other. The obtained rotational speed of the photosensitive member driving motor 404 may be periodically updated or stored in a nonvolatile memory or the like. A certain effect can be attained even when the rotational speed of the photosensitive member driving motor 404 is obtained so that the speed variation ratio of the primary transfer driving motor 201 in a state in which the developing sleeve 126 and photosensitive member 122 are spaced apart from each other becomes almost equal to that of the primary transfer driving motor 201 in a state in which the developing sleeve 126 and photosensitive member 122 are in contact with each other.

In the ninth embodiment, the speed variation ratio of the primary transfer driving motor 201 is detected to determine the rotational speed of the photosensitive member driving motor 404. Alternatively, the speed variation ratio of the primary transfer driving motor 201 may be detected to determine the rotational speed of the primary transfer driving motor 201. Further, the speed variation ratio of the photosensitive member driving motor 404 may be detected to determine the rotational speed of the intermediate transfer belt motor 201. The same effects can be obtained even by detecting the speed variation ratio of the photosensitive member driving motor 404 and determining the rotational speed of the photosensitive member driving motor 404. That is, the ninth embodiment is applicable to two rotation members (first and second rotation members) which can take contact and separated states.

Even when a plurality of motors are arranged to drive the four photosensitive members 122, and individual photosensitive member driving motors 404 drive all the photosensitive members 122 of respective colors, the plurality of photosensitive member driving motors 404 may be regarded as one motor to set a uniform rotational speed. Further, when a plurality of motors are arranged to drive the four photosensitive members 122, and the developing sleeve 126 and photosensitive member 122 can be brought into contact with or separated from each other individually for each color, the rotational speeds of the photosensitive member driving motor 404 and primary transfer driving motor 201 of each color can be optimized.

10th Embodiment

The 10th embodiment will also explain a concrete modification of motor driving information described in the seventh embodiment. The 10th embodiment will describe another form in which toner is caused to enter a nip formed by bringing two rotation members (first and second rotation members) into contact with each other, and at this time, reference motor driving information is acquired. More specifically, when detecting the speed variation ratio of a primary transfer driving motor 201, the speed of a secondary transfer roller 141 is appropriately set by supplying toner serving as a lubricant to the nip between the secondary transfer roller 141 and an intermediate tf belt 131.

Figure 25:
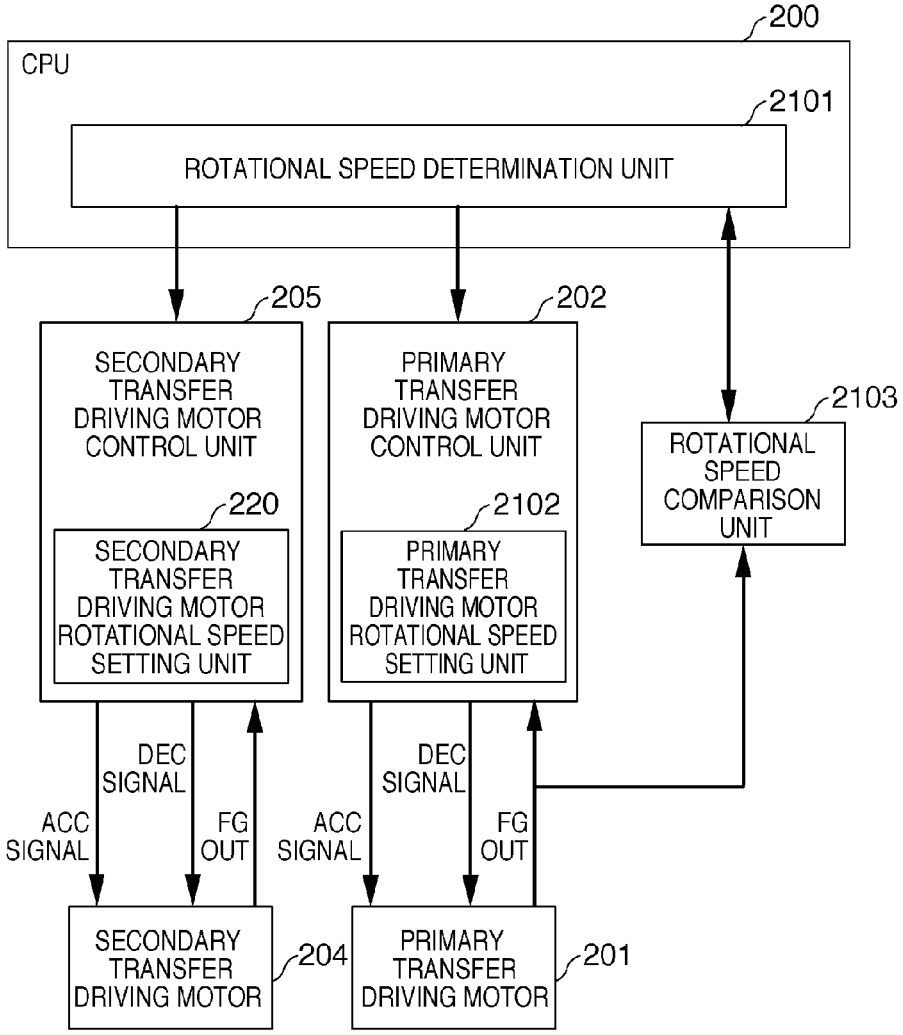
FIG. 25 is a block diagram showing a control circuit which controls a secondary transfer driving roller and primary transfer driving motor.

Driving of the secondary transfer roller 141 will be described with reference to FIG. 25. The arrangement is the same as that in FIG. 21A except for driving of the secondary transfer roller 141. Only a difference from FIG. 21A will be explained. A CPU 200 sets a predetermined rotational speed in a secondary transfer driving motor rotational speed setting unit 220 (secondary transfer belt motor rotational speed setting unit). A secondary transfer driving motor control unit 205 (secondary transfer motor driving control unit) controls driving of the secondary transfer driving motor 204 based on the predetermined rotational speed set in the secondary transfer driving motor rotational speed setting unit 220, and a speed signal FGOUT from a secondary transfer driving motor 204 (secondary transfer motor). More specifically, the secondary transfer driving motor control unit 205 adjusts the speed of the secondary transfer driving motor 204 using an ACC signal serving as an acceleration signal and a DEC signal serving as a deceleration signal.

Supply of toner to the nip between the secondary transfer roller 141 and the primary transfer belt 131 will be explained. Formation of a toner image on a photosensitive member 122 and primary transfer to the primary transfer belt 131 are the same as those described above, and a detailed description thereof will not be repeated. When no toner image exists at the nip between the secondary transfer roller 141 and the primary transfer belt 131, the frictional force between the secondary transfer roller 141 and the primary transfer belt 131 is large. If the secondary transfer roller 141 and primary transfer belt 131 differ in speed owing to the frictional force, a load arising from the speed difference greatly acts on the primary transfer belt 131. For example, when a black process cartridge PK supplies toner, the toner is conveyed on the primary transfer belt 131 and reaches the nip between the secondary transfer roller 141 and the primary transfer belt 131. When a toner image exists at the nip between the secondary transfer roller 141 and the primary transfer belt 131, it functions as a lubricant and decreases the frictional force between the secondary transfer roller 141 and the primary transfer belt 131, and a load arising from the speed difference from the secondary transfer roller 141 hardly acts on the primary transfer belt 131. Considering this, the speed variation ratio in a state in which no toner image exists at the nip between the secondary transfer roller 141 and the primary transfer belt 131 is made to be equal to that in a state in which a toner image exists at the nip. Accordingly, the speed of the secondary transfer driving motor 204 can be controlled to further suppress the influence of the primary transfer belt 131 and secondary transfer roller 141 on each other. Note that an image of toner supplied from the black process cartridge PK needs to be large enough to generate a satisfactory slip when the secondary transfer roller 141 and primary transfer belt 131 differ in speed at the nip between the secondary transfer roller 141 and the primary transfer belt 131.

Figure 26A:
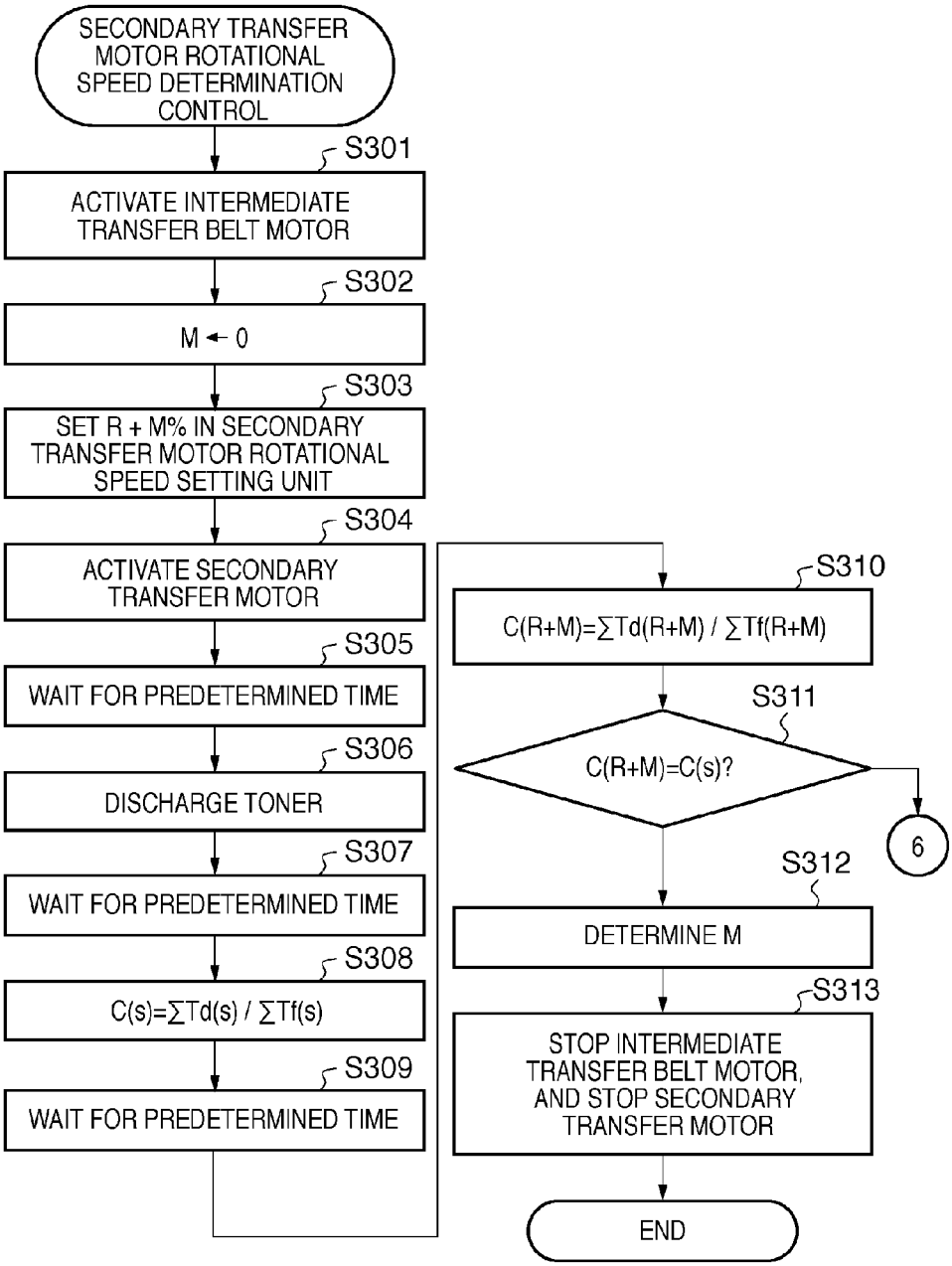
FIGS. 26A and 26B are flowcharts showing a control sequence executed by a CPU 200 according to the 10th Embodiment.
Figure 26B:
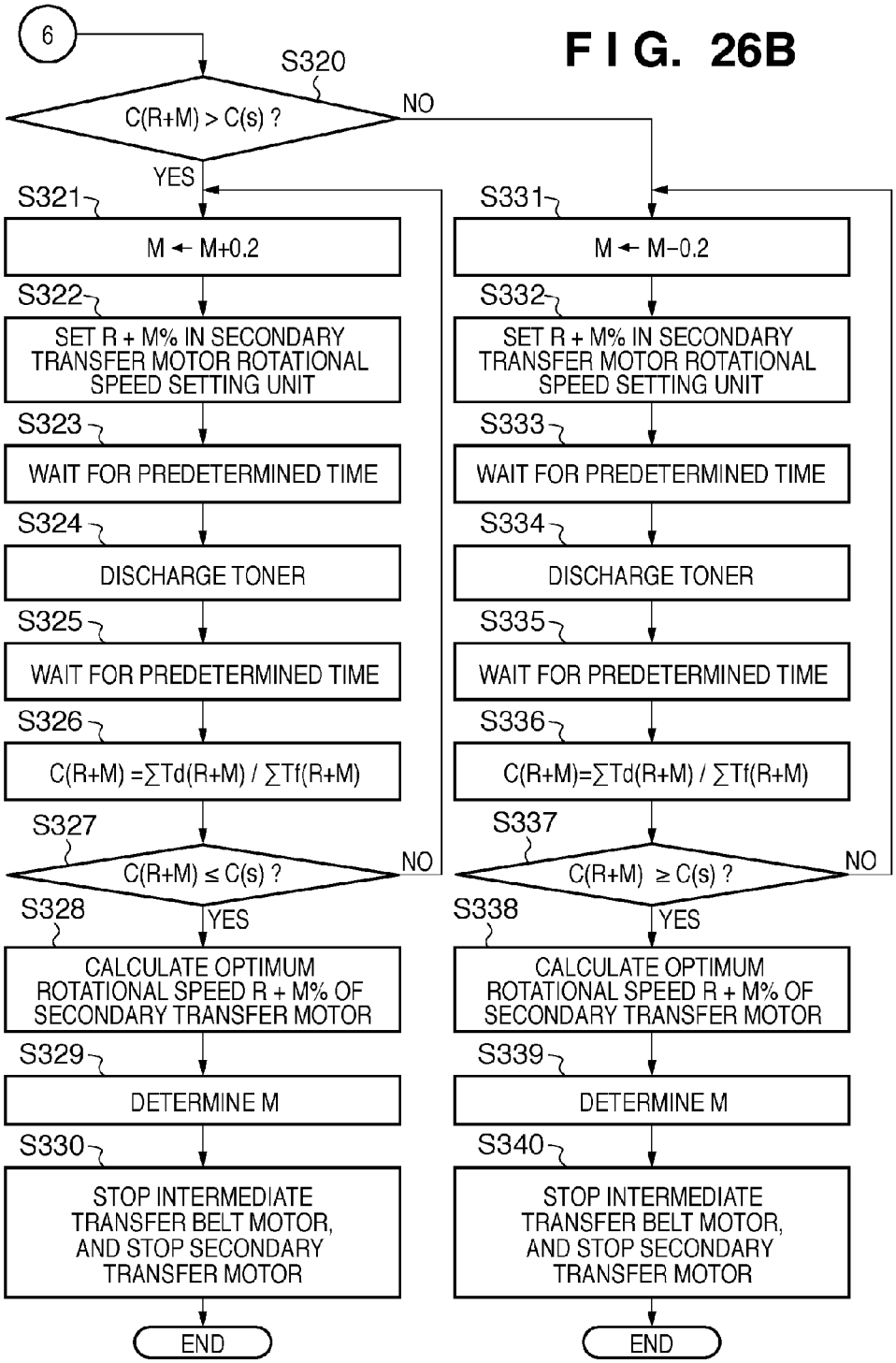

FIGS. 26A and 26B are flowcharts showing a control sequence executed by the CPU 200. Upon turning on the image forming apparatus or receiving an instruction to execute the sequence, the CPU 200 activates the primary transfer driving motor 201 (S301). At this time, the primary transfer driving motor 201 is activated by instructing a primary transfer driving motor control unit 202 to turn on the intermediate transfer driving motor.

The CPU 200 assigns 0 to the variable M (S302). The variable M is used as the ratio to the reference rotational speed D of the secondary transfer driving motor 204. The CPU 200 sets the rotational speed of the secondary transfer driving motor 204 in the secondary transfer driving motor rotational speed setting unit 220 (S303). The CPU 200 sets a rotational speed R+M. Since M=0 now, the CPU 200 sets R+0%. In S304, the CPU 200 instructs the secondary transfer driving motor control unit 205 to turn on the secondary transfer motor in order to activate the secondary transfer driving motor 204.

In S305, the CPU 200 waits for a predetermined time until the rotational speeds of the primary transfer driving motor 201 and secondary transfer driving motor 204 stabilize. In S306, the CPU 200 forms a toner image using the black process cartridge PK for a predetermined time. The CPU 200 waits for a predetermined time until the toner image formed using the black process cartridge PK is conveyed on the primary transfer belt 131 and reaches the nip between the secondary transfer roller 141 and the primary transfer belt 131 (S307). Thereafter, the CPU 200 measures the delay time Td and lead time Tf of the rotational speed of the primary transfer driving motor 201 in the predetermined time Δt in a state in which the toner image exists at the nip between the secondary transfer roller 141 and the primary transfer belt 131. Also, the CPU 200 calculates the cumulative values of the delay time Td and lead time Tf as ΣTd(s) and ΣTf(s), and the speed variation ratio of them as C(s)=ΣTd(s)/ΣTf(s) (S308). At this time, the fog toner image serving as a lubricant exists at the nip between the secondary transfer roller 141 and the primary transfer belt 131 and decreases the frictional force. Thus, the detected speed variation ratio C(s) of the primary transfer driving motor 201 is one obtained when a load arising from the speed difference from the secondary transfer roller 141 does not act on the primary transfer belt 131. In S309, the CPU 200 waits till the timing when the trailing end of the toner image at the nip between the secondary transfer roller and the primary transfer belt 131 passes through the nip. The CPU 200 measures the delay time Td and lead time Tf of the rotational speed of the primary transfer driving motor 201 in the predetermined time Δt including the timing when the trailing end of the toner image passes through the nip between the secondary transfer roller 141 and the primary transfer belt 131 (S310). Further, the CPU 200 calculates the cumulative values of the delay time Td and lead time Tf as ΣTd(R+0) and ΣTf(R+0), and the speed variation ratio of them as C(R+0)=ΣTd(R+0)/ΣTf(R+0) (S310).

In S311, the CPU 200 compares the speed variation ratio C(s) of the primary transfer driving motor 201 in a state in which the toner image exists at the nip between the secondary transfer roller 141 and the primary transfer belt 131, with the speed variation ratio C(R+0) of the primary transfer driving motor 201 in a state in which no toner image exists at the nip.

If C(R+0)=C(s), the speed difference between the secondary transfer roller 141 and the primary transfer belt 131 is small, so the CPU 200 determines M=0 in S312. In S313, the CPU 200 stops the primary transfer driving motor 201 and secondary transfer driving motor 204, and ends the control.

In the embodiment, the initial value of M is 0, but is not limited to this. In S311, a predetermined range may be given to the speed variation ratio C(s) of the primary transfer driving motor 201 in a state in which the toner image exists at the nip between the secondary transfer roller 141 and the primary transfer belt 131. Further, when determining M in S312, a predetermined offset may be given to M not to generate a defective image.

If C(R+0)≠C(s) in S311 as a result of comparing the speed variation ratio of the primary transfer driving motor 201 in a state in which the toner image exists at the nip between the secondary transfer roller 141 and the primary transfer belt 131, with that of the primary transfer driving motor 201 in a state in which no toner image exists at the nip, the CPU 200 shifts the process to S320. In S320, the CPU 200 compares C(R+0) and C(s).

If C(R+0)>C(s), the CPU 200 sets M to M+0.2 in S321. Then, the CPU 200 sets the rotational speed of the secondary transfer driving motor 204 in the secondary transfer driving motor rotational speed setting unit 220 (S322). The CPU 200 waits for a predetermined time until the speed of the secondary transfer driving motor 204 changes and its rotational speed stabilizes (S323). The CPU 200 forms a toner image using the black process cartridge PK for a predetermined time in S324. In S325, the CPU 200 waits for a predetermined time until the toner image formed using the black process cartridge PK is conveyed on the primary transfer belt 131 and the trailing end of the toner image passes through the nip.

The CPU 200 measures the delay time Td and lead time Tf of the rotational speed of the primary transfer driving motor 201 in the predetermined time Δt including the timing when the trailing end of the toner image passes through the nip between the primary transfer belt 131 and the secondary transfer roller 141 (S326). Further, the CPU 200 calculates the cumulative values of the delay time Td and lead time Tf as ΣTd(R+0.2) and ΣTf(R+0.2), and the speed variation ratio of them as C(R+0.2)=ΣTd(R+0.2)/ΣTf(R+0.2) (S326). The CPU 200 compares the speed variation ratio C(s) of the primary transfer driving motor 201 in a state in which the toner image exists at the nip between the primary transfer belt 131 and the secondary transfer roller 141, with the speed variation ratio C(R+0.2) of the primary transfer driving motor 201 in a state in which the trailing end of the toner image has passed through the nip (S327).

If C(R+0.2)>C(s), the CPU 200 shifts the process to S321, and repeats the same processes until C(R+M)≤C(s). If C(R+0.2)≤C(s), the CPU 200 calculates an optimum rotational speed R+M of the secondary transfer driving motor 204 in S328, and determines an optimum M value in S329. In S330, the CPU 200 stops the primary transfer driving motor 201 and secondary transfer driving motor 204, and ends the control. Also when C(R+0)≤C(s) as a result of comparing C(R+0) and C(s) in S320, the CPU 200 performs the same operation except that it sets M to N−0.2 in S331, so a description thereof will not be repeated. The method of calculating the optimum rotational speed R+M of the secondary transfer driving motor 204 in S328 and S338 is also the same as that described in the eighth embodiment, and a description thereof will not be repeated.

As described above, the rotational speed of the secondary transfer driving motor 204 is obtained so that the speed variation ratio of the primary transfer driving motor 201 in a state in which a toner image exists at the nip between the primary transfer belt 131 and the secondary transfer roller 141 becomes equal to that of the primary transfer driving motor 201 in a state in which no toner image exists at the nip. Therefore, the rotational speed of the secondary transfer driving motor 204 can be obtained, at which the influence of the primary transfer belt 131 and secondary transfer roller 141 on each other can be further reduced. The obtained rotational speed of the secondary transfer driving motor 204 may be periodically updated or stored in a nonvolatile memory or the like.

In the 10th embodiment, the speed variation ratio of the primary transfer driving motor 201 is detected to determine the rotational speed of the secondary transfer driving motor 204. Alternatively, the speed variation ratio of the primary transfer driving motor 201 may be detected to determine the rotational speed of the primary transfer driving motor 201. Also, the speed variation ratio of the secondary transfer driving motor 204 may be detected to determine the rotational speed of the primary transfer driving motor 201. The same effects can be obtained even by detecting the speed variation ratio of the secondary transfer driving motor 204 and determining the rotational speed of the secondary transfer driving motor 204. That is, the 10th embodiment is applicable to two rotation members (first and second rotation members) which can take contact and separated states.

The process cartridge to supply toner for an image is not limited to the black process cartridge PK and may be a process cartridge of another color. The same effects can also be obtained by applying a bias reverse to that in normal image formation to a belt cleaner 129, and supplying, as a lubricant, waste toner discharged to the primary transfer belt 131. In this case, the belt cleaner 129 executes the processes in S306, S324, and S334.

In the above example, the CPU 200 calculates the speed variation ratio ($=\Sigma Td/\Sigma Tf$) to evaluate a change of the speed. However, a change of the speed can also be evaluated by another calculation. For example, a change of the speed may be evaluated from the speed fluctuation difference ($=\Sigma Td-\Sigma Tf$). It is also possible to directly count the output counts/output times of the ACC signal and DEC signal, and evaluate a change of the speed without using the FG signal. In other words, the speed change level (speed control level) can be evaluated using various signals regarding the motor speed, such as the ACC signal and DEC signal in addition to the FG signal. A change of the speed can be evaluated using any of a signal output from the motor, like the FG signal, and a signal input to the motor, like the ACC signal, as long as the signal concerns the motor speed. In this manner, a change of the driving motor speed can be calculated using various kinds of signals such as a speed signal output from the driving motor and a speed control signal input to the driving motor.

11th Embodiment

While the primary transfer driving motor 201 operates, the CPU 200 can always detect the current value of the primary transfer driving motor 201. This current value is not always constant because the current value changes owing to a change of the kinetic frictional force of the primary transfer belt 131, a change of the roller diameter by shaving of the driving roller or attachment of a foreign substance, or the like. Considering this, the 11th embodiment will describe processing of detecting a trigger to execute the rotational speed determination sequence described in each of the first to 11th embodiments. Assume that the driving speed of the first or second driving motor is controlled again when motor driving information obtained by an obtaining unit indicates a speed change exceeding a predetermined threshold.

Figure 20:
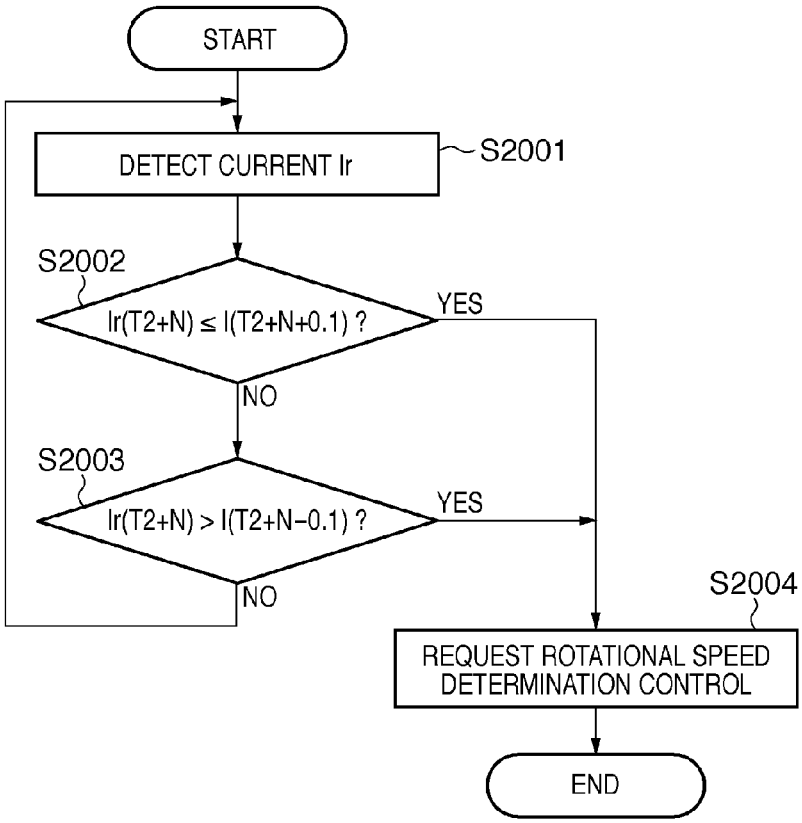
FIG. 20 is a flowchart showing a control sequence executed by a CPU 200 according to the 11th embodiment.

FIG. 20 is a flowchart showing primary transfer driving motor current monitoring processing. In S2001, a CPU 200 detects a current value as motor driving information of a primary transfer driving motor 201. Digital data of the detected current value is defined as Ir. Assume that Ir=180 is detected. In S2002, the CPU 200 determines whether the current value Ir is equal to or smaller than I(T2+N+0.1), in order to determine whether a change of the current value Ir is significant. In S616 of the first embodiment, M=−0.1 and N=−0.1, so whether the current value Ir is equal to or smaller than I(T2+(−0.1)+0.1) is determined. Since I(T2+0)=183 in FIG. 7A, Ir≤I(T2+0) is established. If Ir≤I(T2+N+0.1), the process advances to S2004; if Ir>I(T2+N+0.1), to S2003.

In S2003, the CPU 200 determines whether Ir is larger than I(T2+N−0.1), in order to determine whether a change of the current value Ir is significant. If Ir>I(T2+N−0.1), the process advances to S2004; if Ir≤I(T2+N−0.1), returns to S2001. The CPU 200 functions as a comparison unit which compares a current value detected by a current detection unit with a threshold when the image forming apparatus executes image formation. I(T2+N−0.1) and I(T2+N+0.1) are thresholds set in advance to determine whether the target rotational speed needs to be determined again.

In S2004, the CPU 200 issues a request to start the rotational speed determination sequence described in the first or second embodiment, in order to determine again the rotational speed of a secondary transfer driving motor 204. The CPU 200 then executes the rotational speed determination sequence described in the first or second embodiment. In this fashion, the CPU 200 determines again the target rotational speed based on the comparison result of the comparison unit.

According to the 11th embodiment, the current value of the primary transfer driving motor 201 is always monitored, and when it deviates from a predetermined range, the rotational speed determination sequence is executed. Since the rotational speed determination sequence is executed, as needed, the rotational speed of the secondary transfer driving motor 204 can be maintained at high precision. In the above example, the predetermined range is set to I(T2+N−0.1)<Ir≤I(T2+N+0.1). This is because, when an obtained current value changes to a current value corresponding to a rotational speed N−0.1 or N+0.1 around N, it can be estimated that the characteristic of the current value or rotational speed has significantly changed. Note that the predetermined range is not limited to one in the embodiment, and a predetermined width or predetermined ratio is also available.

In the above description, the value of a current supplied to the primary transfer driving motor 201 serving as motor driving information is detected as a determination parameter in S2001 to S2004. However, the present invention is not limited to this. For example, considering the third embodiment, the value of a current supplied to the secondary transfer driving motor may be detected to perform processing in the seventh embodiment described above.

In the description of S2004, the rotational speed of the secondary transfer driving motor 204 is determined again, but the present invention is not limited to this. For example, the rotational speed determination sequence (FIG. 14, 17, or 19) in each of the fourth to sixth embodiments may be executed.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Patent Application No. 2009-270786, filed Nov. 27, 2009, and Japanese Patent Application No. 2010-258887, filed Nov. 19, 2010, which are hereby incorporated by reference herein in their entirety.

What is claimed is:

1. An image forming apparatus comprising:

a primary transfer belt and a photosensitive drum which are a plurality of rotation members for performing image formation and rotate in contact with each other;

a first driving motor which drives said primary transfer belt;

a second driving motor which drives said photosensitive drum;

an obtaining unit which obtains pieces of motor driving information about driving states of one of said first driving motor and said second driving motor at a plurality of different relative driving speeds while a relative driving speed of said second driving motor with respect to a driving speed of said first driving motor is changed to one of the plurality of different relative driving speeds;

a driving speed determination unit which determines a target driving speed based on the pieces of motor driving information obtained by said obtaining unit such that a relative speed difference between a circumferential speed of said primary transfer belt and a circumferential speed of said photosensitive drum is reduced;

a control unit which controls a driving speed of at least one of said first driving motor and said second driving motor in image formation based on the determined target driving speed;

a plurality of developing units which are arranged for a plurality of photosensitive drums corresponding to different colors and are brought into contact with and separated from said respective photosensitive drums; and a memory which stores, as reference motor driving information, motor driving information obtained by said obtaining unit from said first driving motor in advance in a state where said primary transfer belt and said photosensitive drums are in contact with each other and said developing units are in contact with said photosensitive drums, wherein said control unit causes said obtaining unit to re-obtain motor driving information in a state where said control unit makes said primary transfer belt and said photosensitive drums contact each other and separates said developing units from said photosensitive drums, and wherein said control unit controls the driving speed in image formation using, as the target driving speed, the driving speed of at least one of said first driving motor and said second driving motor when motor driving information re-obtained by said obtaining unit coincides with the reference motor driving information stored in said memory.

2. The apparatus according to claim 1, wherein said driving speed determination unit determines, as the target driving speed, a driving speed of said second driving motor that corresponds to an intermediate value among values indicated by the information related to the speed difference obtained by said obtaining unit while changing the relative driving speed.

3. The apparatus according to claim 1, further comprising:

a calculation unit which calculates an average value of values indicated by the information related to the speed difference of said first driving motor that are detected for different driving speeds of said second driving motor, wherein said driving speed determination unit further determines, as the target driving speed, a driving speed of said second driving motor that is obtained when a difference between a speed indicated by the information obtained by said obtaining unit while changing the driving speed of said second driving motor, and the average value becomes a local minimum.

4. The apparatus according to claim 1, wherein the information related to the respective driving speeds indicates a change of the speed of one of said first driving motor and said second driving motor, and is calculated based on a speed signal output from one of said first driving motor and said second driving motor, or a speed control signal input to one of said first driving motor and said second driving motor.

5. The apparatus according to claim 1, wherein when the information obtained by said obtaining unit indicates a speed change exceeding a predetermined threshold from motor driving information of one of said first driving motor and said second driving motor in accordance with a setting of said control unit, said control unit controls again the driving speed of at least one of said first driving motor and said second driving motor.

6. A method of controlling an image forming apparatus including:

a primary transfer belt and a photosensitive drum which are a plurality of rotation members for performing image formation and rotate in contact with each other, a plurality of developing units which are arranged for a plurality of photosensitive drums corresponding to different colors and are brought into contact with and separated from the respective photosensitive drums, a memory, a first driving motor which drives the primary transfer belt, and a second driving motor which drives the photosensitive drum, the method comprising:

an obtaining step of obtaining pieces of motor driving information about driving states of one of the first driving motor and the second driving motor at a plurality of different relative driving speeds while a relative driving speed of the second driving motor with respect to a driving speed of the first driving motor is changed to one of the plurality of different relative driving speeds;

a driving speed determination step of determining a target driving speed based on the pieces of motor driving information obtained in the obtaining step such that a relative speed difference between a circumferential speed of the primary transfer belt and a circumferential speed of the photosensitive drum is reduced;

a control step of controlling a driving speed of at least one of the first driving motor and the second driving motor in image formation;

a storing step of storing in the memory, as reference motor driving information, motor driving information obtained in the obtaining step from the first driving motor in advance in a state where the primary transfer belt and the photosensitive drums are in contact with each other and the developing units are in contact with the photosensitive drums; and a re-obtaining step of re-obtaining motor driving information in a state where the control step makes the primary transfer belt and said photosensitive drums contact each other and separates the developing units from the photosensitive drums, wherein the control step includes a step of controlling the driving speed in image formation using, as the target driving speed, the driving speed of at least one of the first driving motor and the second driving motor when motor driving information re-obtained in the re-obtaining step coincides with the reference motor driving information stored in the memory.

* * * * *